US010622202B2

(12) United States Patent
Cooks et al.

(10) Patent No.: US 10,622,202 B2
(45) Date of Patent: Apr. 14, 2020

(54) ION TRAPS THAT APPLY AN INVERSE MATHIEU Q SCAN

(71) Applicant: Purdue Research Foundation, West Lafayette, IN (US)

(72) Inventors: Robert Graham Cooks, West Lafayette, IN (US); Dalton Snyder, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 15/789,688

(22) Filed: Oct. 20, 2017

(65) Prior Publication Data

US 2018/0114686 A1 Apr. 26, 2018

Related U.S. Application Data

(60) Provisional application No. 62/410,889, filed on Oct. 21, 2016.

(51) Int. Cl.
*H01J 49/00* (2006.01)
*H01J 49/42* (2006.01)

(52) U.S. Cl.
CPC ..... *H01J 49/422* (2013.01); *H01J 49/0013* (2013.01); *H01J 49/0031* (2013.01); *H01J 49/429* (2013.01)

(58) Field of Classification Search
USPC ..... 250/282
See application file for complete search history.

(56) References Cited

U.S. PATENT DOCUMENTS 6,157,029 A * 12/2000 Chutjian ..... H01J 49/0018 250/292
6,483,109 B1 * 11/2002 Reinhold ..... H01J 49/004 250/282
7,034,293 B2 * 4/2006 Wells ..... H01J 49/423 250/292
7,456,396 B2 * 11/2008 Quarmby ..... H01J 49/427 250/282
7,842,918 B2 * 11/2010 Wang ..... H01J 49/426 250/281
8,586,918 B2 * 11/2013 Brucker ..... H01J 49/4245 250/292
9,922,813 B2 * 3/2018 Cooks ..... H01J 49/4285

* cited by examiner

*Primary Examiner* — Phillip A Johnston
(74) *Attorney, Agent, or Firm* — Brown Rudnick LLP; Adam M. Schoen

(57) ABSTRACT

The invention generally relates to ion traps that operate by applying an inverse Mathieu q scan. In certain embodiments, the invention provides systems that include a mass spectrometer having an ion trap and a central processing unit (CPU). The CPU includes storage coupled to the CPU for storing instructions that when executed by the CPU cause the system to apply an inverse Mathieu q scan to the ion trap.

16 Claims, 36 Drawing Sheets

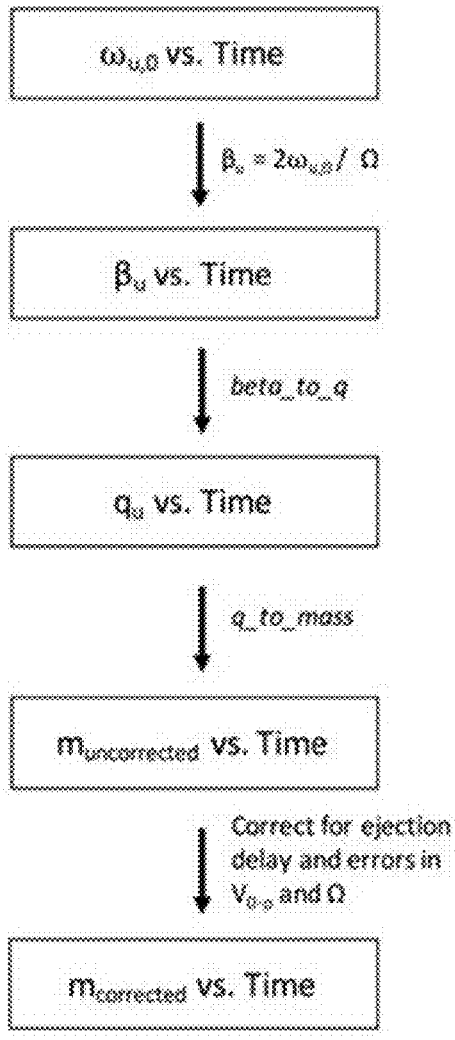

```
Function: beta_to_q

Guess q = 0.5; (prev_q is arbitrarily set to 0)
Set left_bound = 0;
Set right_bound = 1;
Set tolerance = 0.000001;  % tolerance is arbitrarily set
Set LHS_minus_RHS  = 1;    % refers to eq. 9
while (abs(q – prev_q) > tolerance)
        Evaluate LHS of eq. 9;
        Evaluate RHS of eq. 9;
        Calculate LHS_minus_RHS;
        if LHS_minus_RHS > 0
                Set prev_q = q;
                Set q = (q + right_bound) / 2;
                Set left_bound = prev_q;
        elseif LHS_minus_RHS < 0
                Set prev_q = q;
                Set q = (q + left_bound) / 2;
                Set right_bound = prev_q;
        else
                % guess is correct
```

Function: *q_to_mass**

$m_{uncorrected} = 4eV_{0-p} / (\Omega^2 r_0^2 q m_u)$

Steps for mass correction:

1. Obtain ac scan mass spectrum of mass standards
2. Plot true mass vs. $m_{uncorrected}$
3. Perform linear fit of (2) to obtain slope (s) and intercept (b)
4. $m_{corrected} = s^* m_{uncorrected} + b$
5. If necessary, correct for AC amplitude

FIG. 19

ION TRAPS THAT APPLY AN INVERSE MATHIEU Q SCAN

RELATED APPLICATION

The present application claims the benefit of and priority to U.S. provisional patent application Ser. No. 62/410,889, filed Oct. 21, 2016, the content of which is incorporated by reference herein in its entirety.

GOVERNMENT SUPPORT

This invention was made with government support under NNX16AJ25G awarded by the National Aeronautics and Space Administration. The government has certain rights in the invention.

FIELD OF THE INVENTION

The invention generally relates to ion traps that operate by applying an inverse Mathieu q scan.

BACKGROUND

Methods of scanning ions out of quadrupole ion traps for external detection are generally derived from the Mathieu parameters $a_u$ and $q_u$, which describe the stability of ions in quadrupolar fields with dimensions u. For the linear ion trap with quadrupole potentials in x and y, $$q_x=-q_y=8zeV_{0\text{-}p}/\Omega^2(x_0^2+y_0^2)m \quad (1)$$

$$a_x=-a_y=16zeU/\Omega^2(x_0^2+y_0^2)m \quad (2)$$

where z is the integer charge of the ion, e is the elementary charge, U is the DC potential between the rods, $V_{0\text{-}p}$ is the zero-to-peak amplitude of the quadrupolar radiofrequency (rf) trapping potential, Ω is the angular rf frequency, $x_0$ and $y_0$ are the half distances between the rods in those respective dimensions, and m is the mass of the ion. When the dimensions in x and y are identical ($x_0=y_0$), $2r_0^2$ can be substituted for $(x_0^2+y_0^2)$. Solving for m/z, the following is obtained:

$$m/z=4V_{0\text{-}p}/q_x\Omega^2r_0^2 \quad (3)$$

$$m/z=8U/a_x\Omega^2r_0^2 \quad (4)$$

Ion traps are generally operated without DC potentials ($a_u$=U=0) so that all ions occupy the q axis of the Mathieu stability diagram. In the boundary ejection method, first demonstrated in the 3D trap and in the linear ion trap, the rf amplitude is increased so that ions are ejected when their trajectories become unstable at q=0.908, giving a mass spectrum, i.e. a plot of intensity vs m/z since m/z and rf amplitude (i.e. time) are linearly related.

Resonance ejection is a similar method that improves both resolution and sensitivity. A small supplementary AC signal is applied in a dipolar manner across trapping electrodes in order to generate a small dipolar field that oscillates at the applied frequency. When this frequency, generally set near $q_u$=0.88, matches the secular frequency of an ion in the trap, the ion will be excited or ejected from the trap depending on waveform amplitude and time of application. When the trapping rf amplitude is ramped, all ion secular frequencies increase, eventually coming into resonance with the weak dipolar field and causing their ejection in order of increasing m/z. Although a reverse scan can also be performed, the resolution and sensitivity generally suffer because of position-dependent ion frequency shifts which are observed with non-zero even higher-order field contributions (e. g. octopole).

Other variants of resonance ejection are double and triple resonance ejection, in which one or two AC frequencies are applied at nonlinear (hexapole or octopole) resonance points. These scans have been shown to greatly increase resolution and sensitivity in both conventional and miniature instruments. Rhombic ion ejection makes use of multiple frequencies in different directions for reduced space charge effects since ions being ejected will oscillate around the main ion cloud rather than pass through it. Multiple frequencies can also correspond to different ejection points, as in a compressive mass spectrometry scan, which requires acquisition of multiple scans and an algorithm to reconstruct the mass spectrum.

The radius of the trap can theoretically be scanned, but this has not been demonstrated. Instead, a more useful application is an array of traps of different radii for mass selective trapping.

An uncommon method of scanning an ion trap is to scan the main trapping rf frequency. Although useful for the analysis of microparticles and other high mass ions since lowering the rf frequency increases the mass range obtainable with a given rf amplitude maximum, calibration is difficult due to the nonlinear relationship between m/z and rf frequency. In addition, many systems which use LC tank circuits are unable to scan the rf frequency while maintaining the resonance of the circuit. Nonetheless, digital ion traps are better suited to frequency scans since they can easily modulate the period of the driving rf while providing linear calibration with an appropriate nonlinear frequency sweep.

SUMMARY

The invention provides ion traps that operate using a method of secular frequency scanning in which mass-to-charge is linear with time, termed an "inverse Mathieu q scan". This approach contrasts with linear frequency sweeping that requires a complex nonlinear mass calibration procedure. In the current approach, mass scans are forced to be linear with time by scanning the frequency of a supplementary alternating current (supplementary AC) so that there is an inverse relationship between an ejected ion's Mathieu q parameter and time. Excellent mass spectral linearity is observed using the inverse Mathieu q scan. The rf amplitude is shown to control both the scan range and the scan rate, whereas the AC amplitude and scan rate influence the mass resolution. The scan rate depends linearly on the rf amplitude, a unique feature of this scan. Although changes in either rf or AC amplitude affect the positions of peaks in time, they do not change the mass calibration procedure since this only requires a simple linear fit of m/z vs time. The inverse Mathieu q scan offers a significant increase in mass range and power savings while maintaining access to linearity, paving the way for a mass spectrometer based completely on AC waveforms for ion isolation, ion activation, and ion ejection.

In certain aspects, the invention provides systems that include a mass spectrometer having an ion trap, and a central processing unit (CPU). The CPU has storage coupled to the CPU for storing instructions that when executed by the CPU cause the system to apply an inverse Mathieu q scan to the ion trap. The inverse Mathieu q scan includes nonlinearly applying an alternating current (AC) signal to the ion trap that varies as a function of time. The inverse Mathieu q scan may also include applying a constant radio frequency (RF) signal to the ion trap. In certain embodiments, a frequency of the AC signal is varied as a function of time. In certain embodiments, the AC signal is in resonance with a secular frequency of ions of different mass-to-charge ratios trapped within the ion trap.

The disclosed approach can operate with numerous different types of ion traps. Exemplary ion traps include a hyperbolic ion trap, a cylindrical ion trap, a linear ion trap, or a rectilinear ion trap. In certain embodiments, the mass spectrometer is a miniature mass spectrometer. The systems of the invention may include an ionization source.

Other aspects of the invention include methods for operating an ion trap of a mass spectrometer that involve applying an inverse Mathieu q scan to the ion trap. That may involve nonlinearly applying an alternating current (AC) signal to the ion trap that varies as a function of time. In certain embodiments, the Mathieu q scan further involves applying a constant radio frequency (RF) signal to the ion trap. In certain embodiments, a frequency of the AC signal varies as a function of time. In certain embodiments, the AC signal is in resonance with a secular frequency of ions od different mass-to-charge ratios trapped within the ion trap.

In certain embodiments, prior to the apply step, the method further involves ionizing a sample to produce sample ions, and directing the sample ions into the ion trap of the mass spectrometer.

In certain embodiments, applying the inverse Mathieu q scan extends a mass range of the mass spectrometer without instrumental modification. In other embodiments, the inverse Mathieu q scan is applied in a manner that excites a precursor ion while a second AC signal ejects a product ion from the ion trap. In certain embodiments, both the excitation of the precursor ion and the ejection of the product ion occur simultaneously.

In other embodiments, the method further involves ejecting one or more target ions at a target mass-to-charge ratio from the ion trap while non-target ions at a higher or lower mass-to-charge ratio remain in the ion trap. In certain embodiments, the method may additional involve simultaneously monitoring multiple ions. In other embodiments, the method may additional involve simultaneously monitoring multiple precursor ion to product ion transitions. In other embodiments, the inverse Mathieu q scan is applied in a manner that ion injection, ion cooling, and mass scanning occur in a single step.

BRIEF DESCRIPTION OF THE DRAWINGS

(FIG. 1A) plot of excited ion's Mathieu q parameter vs. time, showing an inverse relationship which gives a linear m/z vs time relationship, (FIG. 1B) plot of secular frequency vs. Mathieu q parameter, (FIG. 1C) applied AC frequency vs time for an inverse Mathieu q scan, and (FIG. 1D) the scan of sinusoidal phase $\phi$ (for smooth frequency scanning) as a function of time. Note that (FIG. 1D) is obtained by integrating (FIG. 1C).

(FIG. 2A) plot of intensity vs. time for an Ultramark 1621 calibration solution obtained with an rf amplitude of ~1290 $V_{0\text{-}p}$ (LMLO of ~460 Da) and AC amplitude of 3 $V_{pp}$ where the AC frequency was scanned so that the excited ion's Mathieu $q_u$ parameter varied inversely with time from q of 0.908 to 0.05, and (FIG. 2B) the same spectrum with a higher AC amplitude. FIGS. 2C-D show best fit lines for m/z vs time (i.e. mass calibration) for FIGS. 2A-B, respectively. The scan speed was approximately 30,000 Da/s.

FIGS. 3C-D show resolution and peak width vs time for scans FIGS. 3A-B, respectively. Intensities are negative because a differential signal was obtained from the LTQ electrometer board. The scan rate in (FIG. 3A) was approximately 26,000 Da/s. The rf amplitude was ~1290 $V_{0\text{-}p}$. Injection time was 5 ms.

(FIG. 4A) shows resolution for selected Ultramark 1621 calibrant ions as a function of AC amplitude, (FIG. 4B) is resolution as a function of scan rate for m/z 1422 (scan rate was varied by keeping rf amplitude constant and changing the mass scan time but keeping the scan range the same), and (FIG. 4C) shows resolution vs scan rate for a mixture of 3 quaternary ammonium ions, indicating that resolution decreases with scan rate for ions that experience less space charge, whereas the opposite is true for ions that experience more space charge effects (those ejected earlier in the scan).

(FIG. 5A) shows decreasing resolution with Mathieu q parameter due to increasing space charge effects (50 ms injection time), and (FIG. 5B) shows resolution and mass shifts for m/z 1422 as a function of injection time. The rf amplitude and frequency were held constant and an inverse Mathieu q scan was performed on Ultramark 1621 calibrant ions (m/z 1022-2022, every 100 Th). Each point in (FIG. 5A) represents an ion of a different m/z. The scan rate was approximately 30,000 Da/s (rf amplitude of ~1290 $V_{0\text{-}p}$).

(FIG. 6B) higher AC amplitudes result in faster ion ejection, though high mass ions will experience a greater shift in ejection time, which results in an increase in apparent scan rate (FIG. 6C).

FIG. 7A, FIG. 7C, FIG. 7E, FIG. 7G show low q resonance ejection at q=0.46 and FIG. 7B, FIG. 7D, FIG. 7F, FIG. 7H show the inverse Mathieu q scan with the given low-mass cutoff. Analytes were FIGS. 7A-B bovine serum albumin (66 kDa), FIGS. 7C-D cesium tridecafluoroheptanoic acid clusters with inset resolution, FIGS. 7E-F polyethylene glycol 4,400 (MW=4,400 Da), and FIGS. 7G-H polyethylene glycol 14,000 (MW=14,000 Da). Note the apparent resolution in the full MS in (FIG. 7D) is lower than the actual resolution because the data system undersamples the spectrum.

FIG. 12A shows the mass scan, in which ions of m/z 922, 1022, and 1122 are monitored as a function of time (all detected with a single ion injection), which is accomplished by (FIG. 12B) sweeping the frequency of the resonance ejection waveform using the inverse Mathieu q scan with frequency "hops". Continuity of the waveform is maintained because the phase of the sine wave is swept instead of the frequency.

FIG. 13A shows an array of Mathieu q values is created and those values within the isolation range ($q_{iso}-\Delta q/2<q<q_{iso}+\Delta q/2$) are removed from the array. The remaining q values are converted to β values and then to frequencies and finally phases. FIG. 13B shows applied frequency as a function of time for an inverse Mathieu q isolation scan from q=0.908 to q=0.05 over 30 ms with an isolation notch at q=0.83 and a width Δq of 0.02 (in Mathieu q units, equivalent to 20 kHz in frequency units). Inset emphasizes the frequency hop in the isolation waveform.

FIG. 17B shows that a dual notch isolation waveform of amplitude 3.2 $V_{pp}$ using notches at q=0.83 and 0.305 was used to isolate caffeine and MRFA simultaneously. The width of isolation for caffeine was 0.02 and was 0.04 (in Mathieu q units) for MRFA. Note that isolation efficiencies are calculated with respect to the full scan taken just before each respective experiment. The intensities in FIGS. 17A-B should not be compared.

FIG. 19 shows a procedure for mass calibration for secular frequency scanning in an ion trap in which the ac frequency is swept linearly with time, unlike the inverse Mathieu q scan in which the AC frequency is scanned nonlinearly. The applied AC frequency ($\omega_{u,0}$) is linearly correlated with time based on the parameters from the data system and waveform generator (e.g. scan rate, scan frequency range, data collection rate, etc.). These frequencies are then converted into $\beta_u$ and subsequently into $q_u$ using an iterative algorithm, beta_to_q. These $q_u$ values are then converted into uncorrected masses. The delay in ion ejection, which is mass dependent, is taken into account by linearly correlating true mass and uncorrected mass to obtain a slope (s) and intercept (b). Finally, the corrected mass is obtained by multiplying $m_{uncorrected}$ by s and adding b. Note that $m_u$ is the atomic mass constant. *Note that changes in $V_{0-p}$ can be taken into account in this step. For example, in the 'Ultrazoom' scans on the LTQ, the rf amplitude is incremented such that the scan rate is 27 m/z units/s at a qx of 0.88. Thus, $V_{0-p}$ is incremented linearly at each time point, the increment being calculated from the scan rate.

DETAILED DESCRIPTION

Discussed herein is a new mode of secular frequency scanning in which the frequency of the supplementary AC waveform is scanned nonlinearly such that the ejected ion's Mathieu q parameter and time are inversely related, thereby giving a linear m/z vs time calibration. This mode, referred to herein as an "inverse Mathieu q scan", may be particularly well-suited for miniature and portable instruments since a linear rf ramp is not required. Rather, a stable rf signal suffices.

Figure 1A:
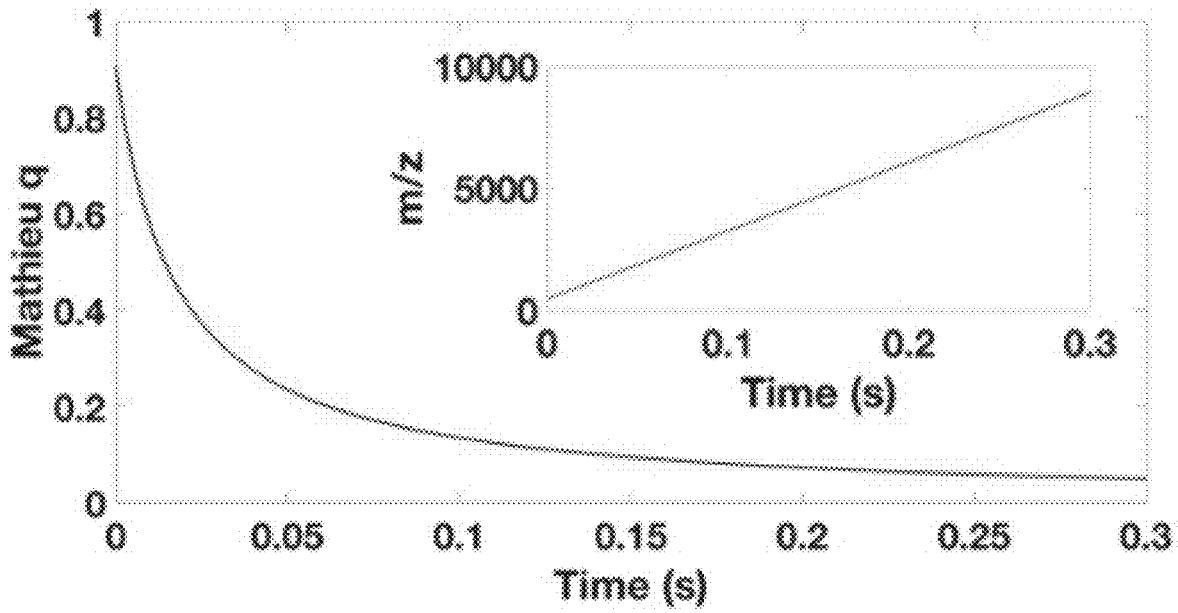
FIGS. 1A-D show calculating the custom waveform for the inverse Mathieu q scan.

The basis for an inverse Mathieu q scan is derived from the nature of the Mathieu parameter $q_u$ (eq. 3). In order to scan linearly with m/z at constant rf frequency and amplitude, the $q_u$ value of the m/z value being excited should be scanned inversely with time t (FIG. 1A) so that $$q_u=k/(t-j) \tag{5}$$

where k and j are constants determined from the scan parameters. In the mode of operation demonstrated here, the maximum and minimum $q_u$ values ($q_{max}$ and $q_{min}$), which determine the m/z range in the scan, are specified by the user. Because the inverse function does not intersect the q axis (e.g. $q_u=1/t$), the parameter j is used for translation so that the first q value is $q_{max}$. This assumes a scan from high q to low q, which will tend to give better resolution and sensitivity due to the ion frequency shifts mentioned above.

The parameters j and k are calculated from the scan parameters, $$j=q_{min}\Delta t/(q_{min}-q_{max}) \tag{6}$$

$$k=-q_{max}j \tag{7}$$

where Δt is the scan time. Operation in Mathieu q space gives advantages: 1) the waveform frequencies depend only on the rf frequency, not on the rf amplitude or the size or geometry of the device, which implies that the waveform only has to be recalculated if the rf frequency changes (alternatively, the rf amplitude can compensate for any drift in rf frequency), and 2) the mass range and scan rate are controlled by the rf amplitude, mitigating the need for recalculating the waveform in order to change either parameter. It is important to note that we purposely begin with an array of $q_u$ values instead of m/z values for these very reasons.

Figure 1B:
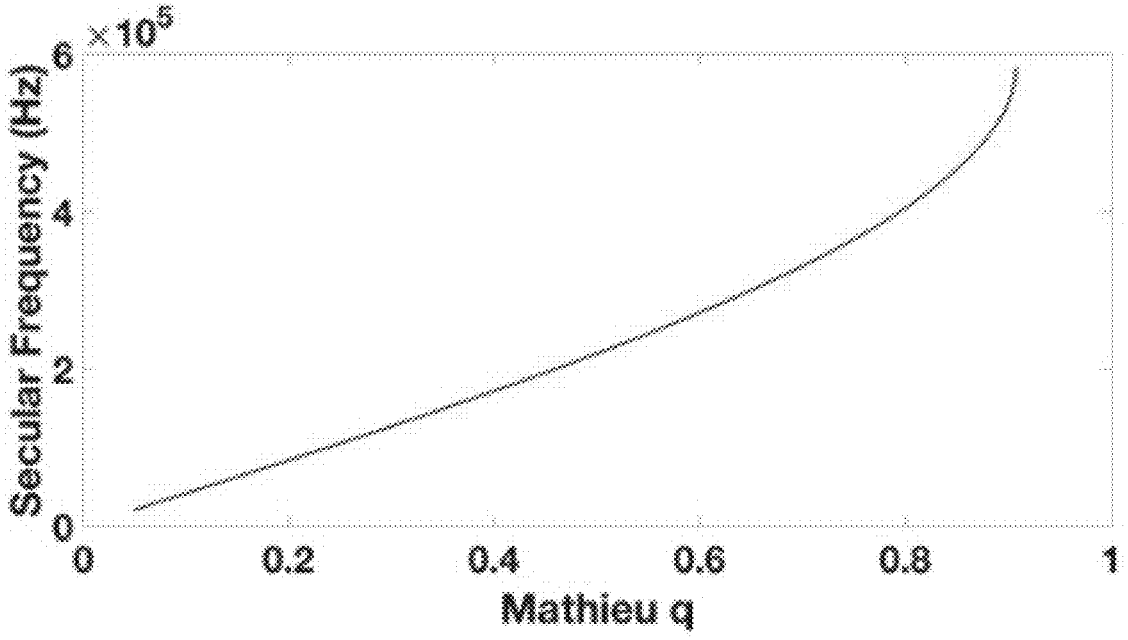

Once an array of Mathieu $q_u$ values is chosen, they are converted to secular frequencies (FIG. 1B), which proceeds first through the calculation of the Mathieu $\beta_u$ parameter, $$\beta_u^2 = a_u + \cfrac{q_u^2}{(\beta_u+2)^2 - a_u - \cfrac{q_u^2}{(\beta_u+4)^2 - a_u - \cfrac{q_u^2}{(\beta_u+6)^2 - a_u - \dots}}} + \tag{8}$$

Figure 1C:
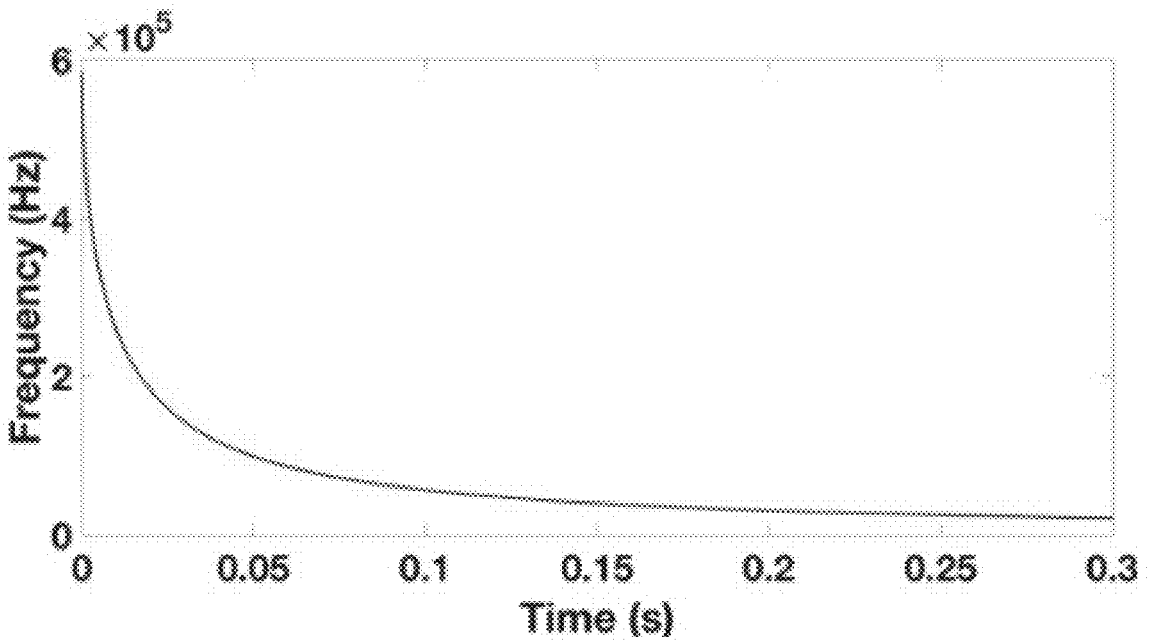

-continued $$\cfrac{q_u^2}{(\beta_u-2)^2 - a_u - \cfrac{q_u^2}{(\beta_u-4)^2 - a_u - \cfrac{q_u^2}{(\beta_u-6)^2 - a_u - \dots}}}$$

a conversion that can be done by using the algorithm described in Snyder et al. (Rapid Commun. Mass Spectrom. 2016, 30, 1190), the content of which is incorporated by reference herein in its entirety. The final step is to convert Mathieu $\beta_u$ values to secular frequencies (eqns. 9, 10) to give applied AC frequency vs time (FIG. 1C). Each ion has a set of secular frequencies, $$\omega_{u,n}=|2n+\beta_u|\Omega/2 \quad -\infty<n<\infty \tag{9}$$

where n is an integer, amongst which is the primary resonance frequency, the fundamental secular frequency, $$\omega_{u,0}=\beta_u\Omega/2 \tag{10}$$

This conversion gives an array of frequencies for implementation into a custom waveform calculated in a mathematics suite (e.g. Matlab).

Prior work used a logarithmic sweep of the AC frequency for secular frequency scanning, but, as described here, the relationship between secular frequency and m/z is not logarithmic, resulting in very high mass errors during mass calibration. This can be clearly observed in FIGS. 1A and C, which show an inverse relationship for the excited ion's Mathieu $q_u$ parameter and time and the more complex relationship between time and applied frequency in an inverse Mathieu q scan, respectively. The curvature clearly differs between the two plots.

In theory, once the Mathieu $q_u$ parameters are converted to secular frequencies, a waveform is obtained. However, this waveform should not be used for secular frequency scanning due to the jagged edges observed throughout the waveform (i.e. phase discontinuities). In the mass spectra, this is observed as periodic spikes in the baseline intensities. Instead, in order to perform a smooth frequency scan, a new parameter Φ is introduced. This corresponds to the phase of the sinusoid at every time step (e.g. the $i^{th}$ phase in the waveform array, where i is an integer from 0 to v*Δt−1). Instead of scanning the frequency of the waveform, the phase of the sinusoid is instead scanned in order to maintain a continuous phase relationship. The relationship between ordinary (i.e. not angular) frequency f and phase Φ is:

$$f(t)=(1/2\pi)(d\Phi/dt)(t) \tag{11}$$

so that $$\Phi(t)=\Phi(0)+2\pi\int_0 f(\tau)d\tau \tag{12}$$

where variable τ has been substituted for time tin order to prevent confusion between the integration limit t and the time variable in the integrand. Thus, the phase of the sine wave at a given time t can be obtained by integrating the function that describes the frequency of the waveform as a function of time, which was previously calculated.

We begin with the phase of the waveform set equal to zero:

$$\Phi(0)=0(t=0) \tag{13}$$

The phase is then incremented according to eqns. 14 and 15, which accumulates (integrates) the frequency of the sinusoid, so that $$\Delta=\omega_{u,0}/v \tag{14}$$

$$\Phi(i+1)=\Phi(i)+\Delta \tag{15}$$

where v is the sampling rate of the waveform generator. Note that $\omega_{u,0}$ is the angular secular frequency ($2*\pi*f_{u,0}$, where $f_{u,0}$ is the ordinary secular frequency in Hz) in units of radians/sec.

Thus, sweeping through phase Φ (FIG. 1D) instead of frequency gives a smooth frequency sweep.

Figure 1D:
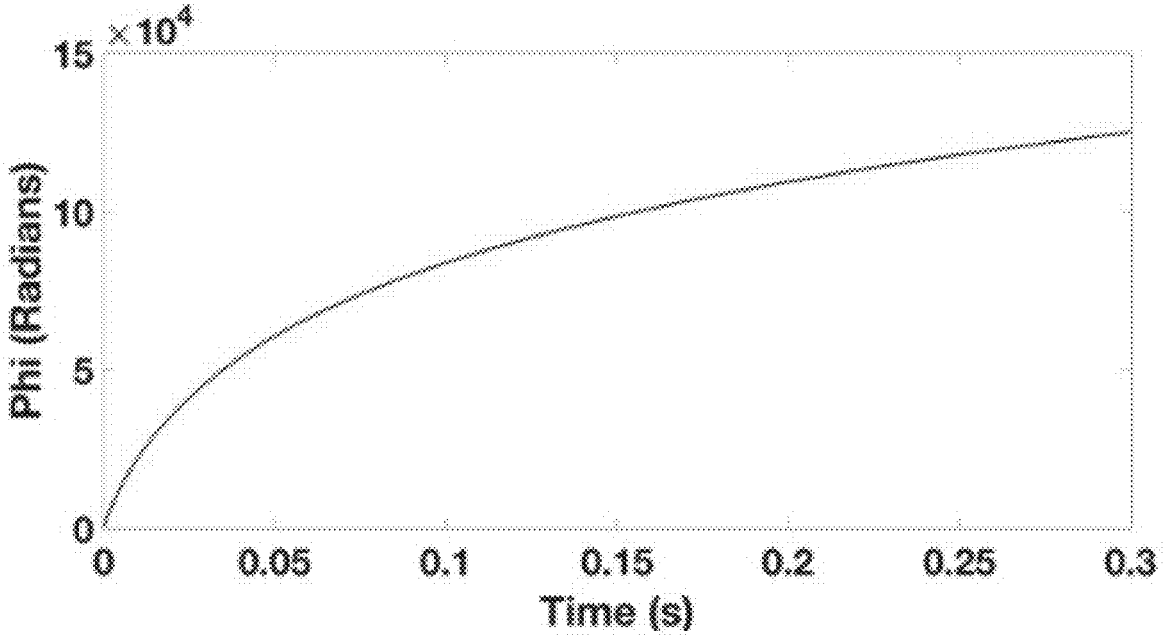

Because the relationship between secular frequency and time is approximately an inverse function, the phase will be swept according to the integral of an inverse function, which is a logarithmic function (FIG. 1D is approximately logarithmic with time). However, because the relationship between secular frequency and m/z is only approximately an inverse relationship, the phase Φ will deviate from the log function and thus cannot be described analytically (due to eq. 8).

FIGS. 2A-D show the mass spectra obtained from analyzing an Ultramark 1621 calibration solution with an inverse Mathieu q scan (scan rate here was 30,000 Da/s). These scans are indicative of several effects: 1) the linearity of the scan, 2) the effect of AC amplitude on resolution, and 3) the effect of space charge on resolution with respect to m/z. As shown in the insets, the linearity is excellent in both the high and the low AC amplitude cases. Ultramark 1621 peaks are expected from m/z 922 to m/z 2022, with equal spacing of 100 m/z units. The most noticeable features of the spectra are the significant differences in resolution with respect to both m/z and AC amplitude. Since the AC frequency sweeps from high Mathieu q to low q, low mass ions are ejected first. They therefore experience a greater space charge effect than the high mass ions that are scanned out later. This gives rise to differences in resolution with mass, quantified later. Increasing the AC amplitude greatly increases the resolution in the scan, evident in FIG. 2B, in part due to a reduction in space charge broadening at higher AC amplitudes. The peak width is approximately constant in this scan. Overall, the resolution in FIG. 2A was quite low, ranging from ~20 to ~200, whereas the resolution in FIG. 2B ranged from ~120 to ~850. In the absence of space charge, the resolution is expected to improve (see below).

Figure 2A:
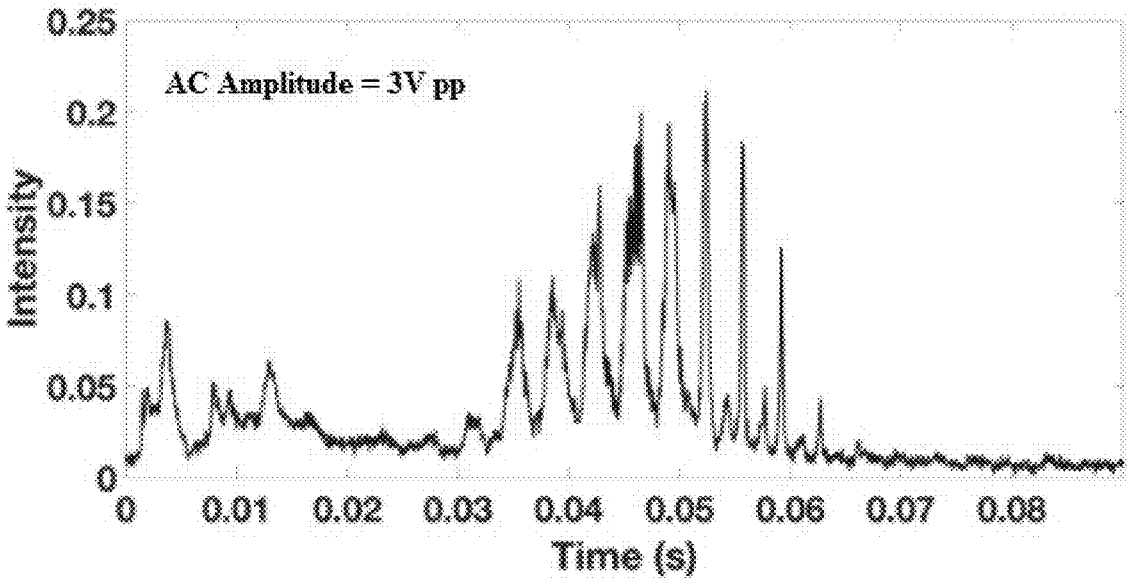
FIGS. 2A-D show secular frequency scanning linear in m/z (inverse Mathieu q scan).
Figure 2B:
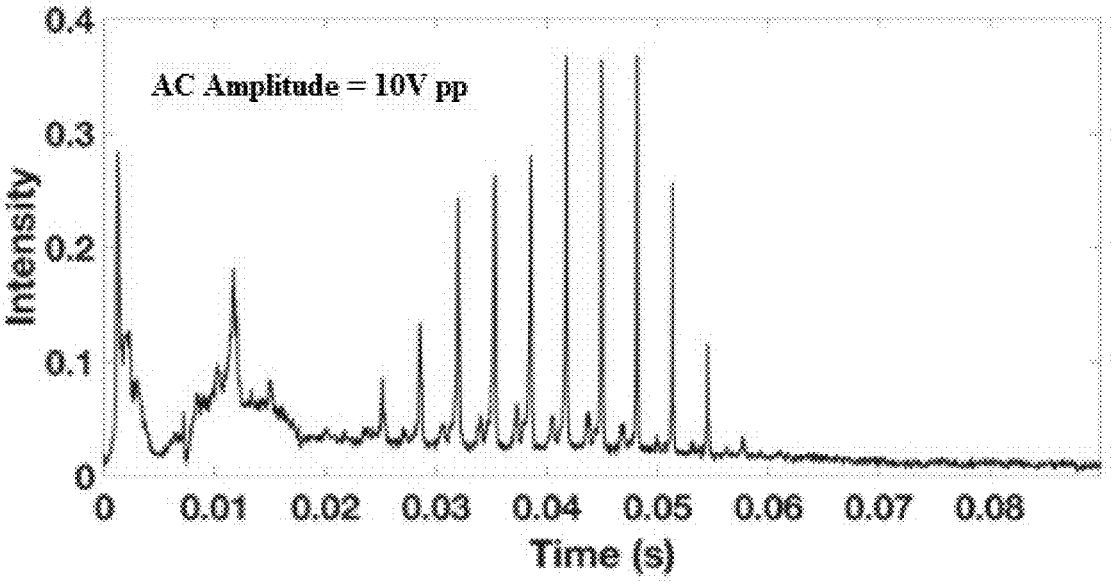
Figure 2C:
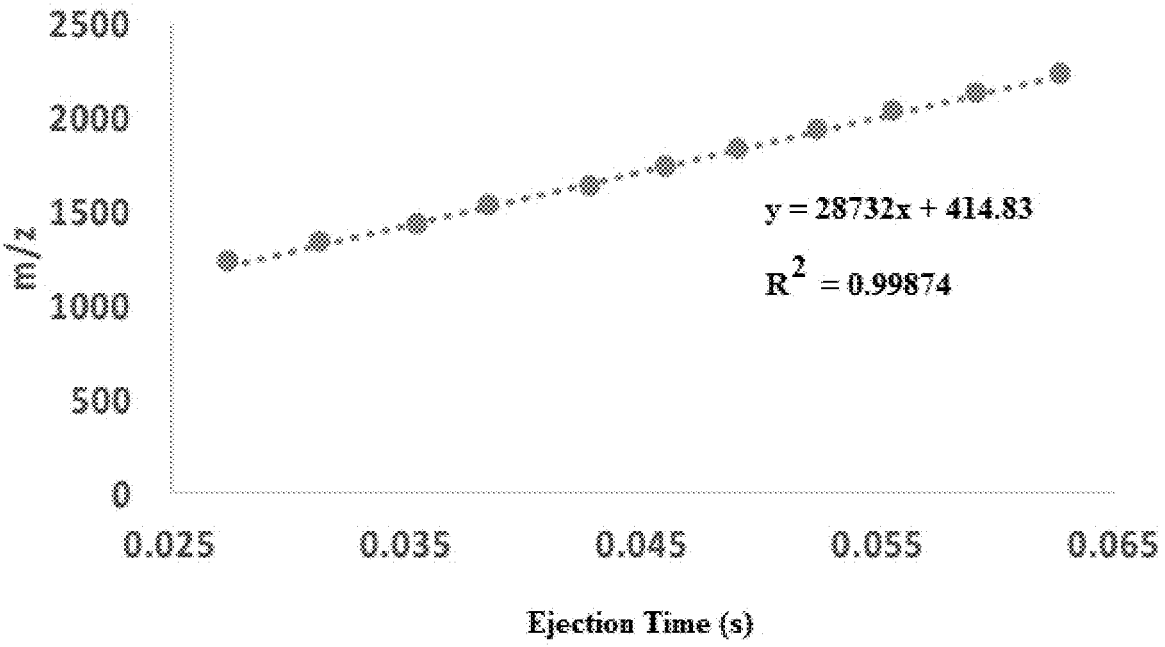
Figure 2D:
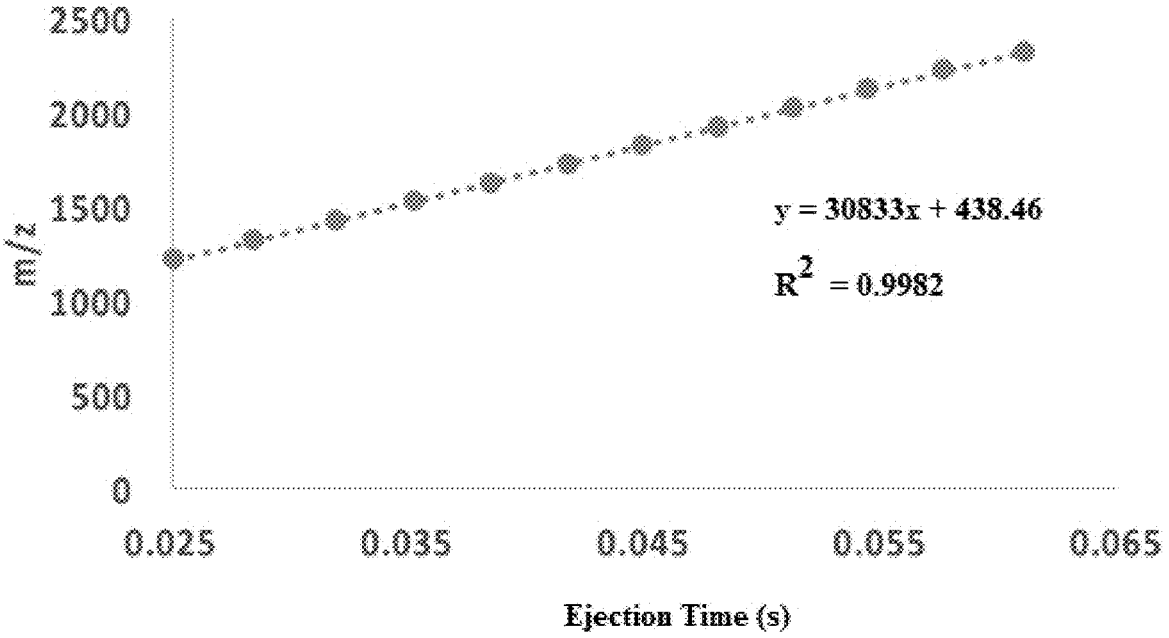

The calibration plots in FIGS. 2C-D show m/z vs ejection time; both show excellent linearity. The slope of the curve is the experimental scan rate and the m/z intercept is the apparent LMCO, both of which are discussed later.

Although mass range extension has been demonstrated with low q resonance ejection, secular frequency scanning linear in frequency, secular frequency scanning with a logarithmic frequency sweep, and rf frequency sweeping, there has usually been an inevitable tradeoff with either resolution or mass calibration. With an inverse Mathieu q scan there is no such tradeoff. Although the initial waveform calculation is not intuitive or analytical and can take a significant amount of time, it need only be performed once for a given rf frequency and device.

Unlike resonance ejection, the mass range is no longer limited by the maximum value of the trapping rf amplitude. Instead, the highest mass obtainable ought to correspond to the highest mass ion trapped; this in turn is determined by the pseudo-potential well depth (when this limits ion trapping, or otherwise it is generally pressure-limited) or by the lowest q value the waveform scans through:

$$m/z_{max}=4V_{0\text{-}p}/q_{min}\Omega^2(r_0^2) \quad (16)$$

FIGS. 3A-D illustrate the wide mass range (m/z 500 to m/z 3,500) over which this scan allows data to be collected with excellent resolution, even with fast scanning (26,000 Da/s). For comparison, the LTQ resonance ejection mode yields unit resolution up to m/z 2,000 while scanning at ~16,666 Da/s, although a "high mass" low q resonance ejection mode also exists, which extends the mass range to m/z 4,000 but the scans are then significantly slower and the resolution and sensitivity suffer.

Figure 3A:
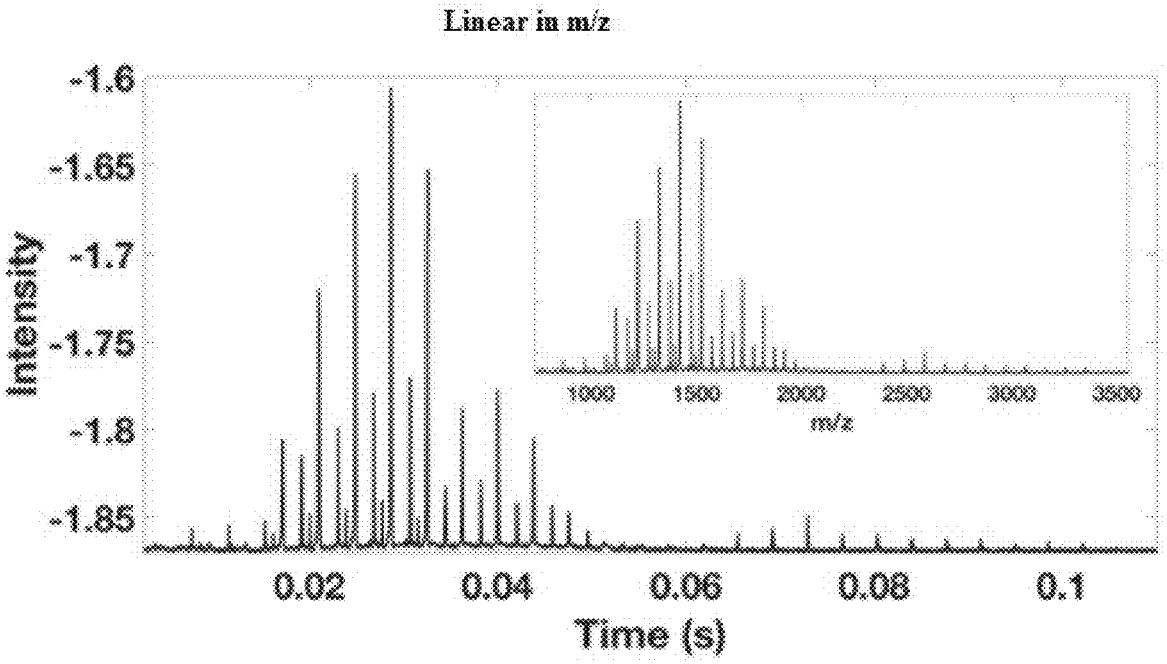
FIGS. 3A-D show resolution in inverse Mathieu q scans: plot of intensity vs. time for Ultramark 1621 calibration solution obtained with a secular frequency scan (FIG. 3A) linear in m/z (i.e. inverse Mathieu q scan, inset shows mass calibrated spectrum) and (FIG. 3B) linear in frequency, both of which show a wide mass range (m/z 500 to m/z 4,000) at low rf amplitudes.
Figure 3B:
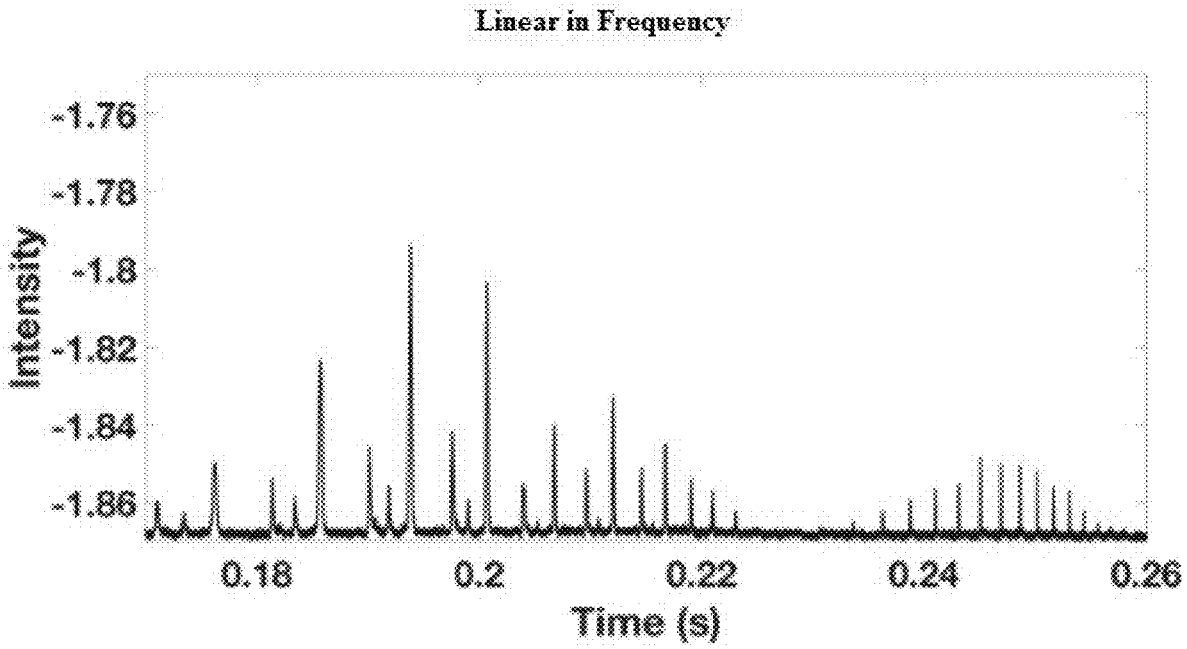

With an inverse Mathieu q scan, resolution, sensitivity, and ease of calibration are all maintained. FIGS. 3A and 3B, shows scans in the absence of significant space charge effects using an injection time of 5 ms. FIG. 3A shows a scan linear in m/z, whereas FIG. 3B shows a scan linear in frequency. As expected from the approximately inverse relationship between m/z and secular frequency, a high degree of nonlinearity between m/z and time is observed at low mass (FIG. 3B). For a truly linear mass scale, the low mass ions would have ejection times closer together than they are with a linear frequency sweep. In other words, low mass ions have secular frequencies that are farther apart than those of high mass ions.

Theoretically, the resolution in resonance ejection with either an rf amplitude ramp or AC frequency sweep should be numerically equivalent to the frequency resolution. In particular, in the absence of higher order fields and space charge effects, the mass resolution should vary inversely with the scan rate in terms of frequency units per unit time. However, the scan rate only changes significantly at high Mathieu q, so this cannot account for the observed differences in resolution, seen clearly in FIG. 1C. The slope of the curve (i.e. the scan rate) changes dramatically below a Mathieu q of ~0.3, but most ions will have low Mathieu q parameters, so the scan rate for most ions is approximately the same.

Figure 3C:
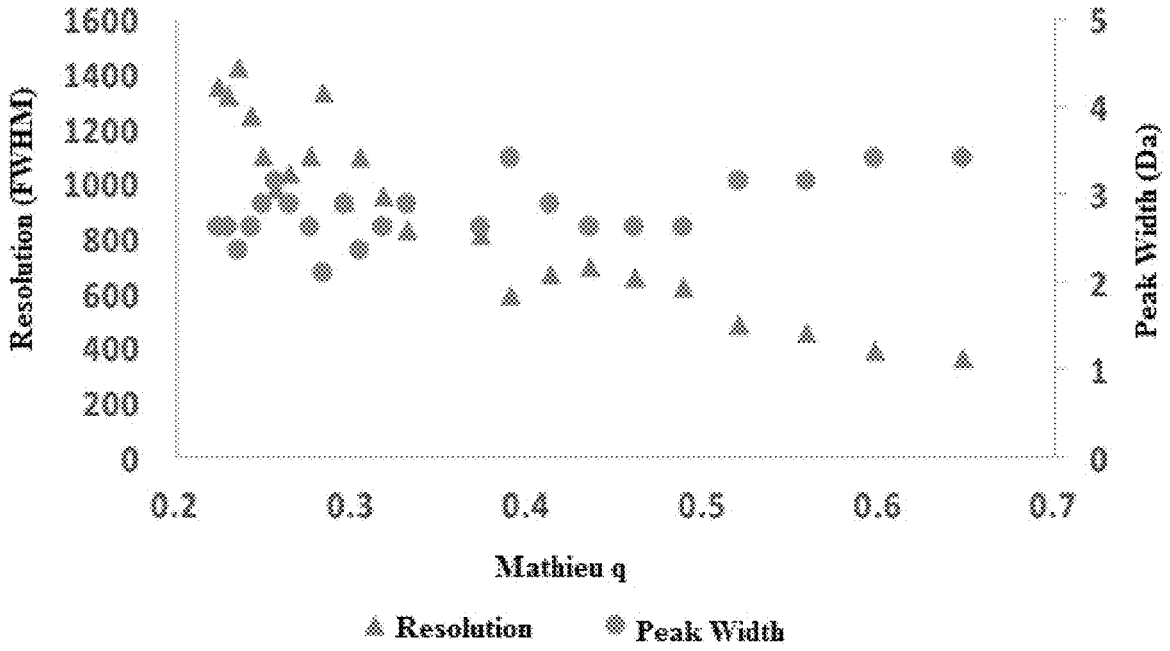
Figure 3D:
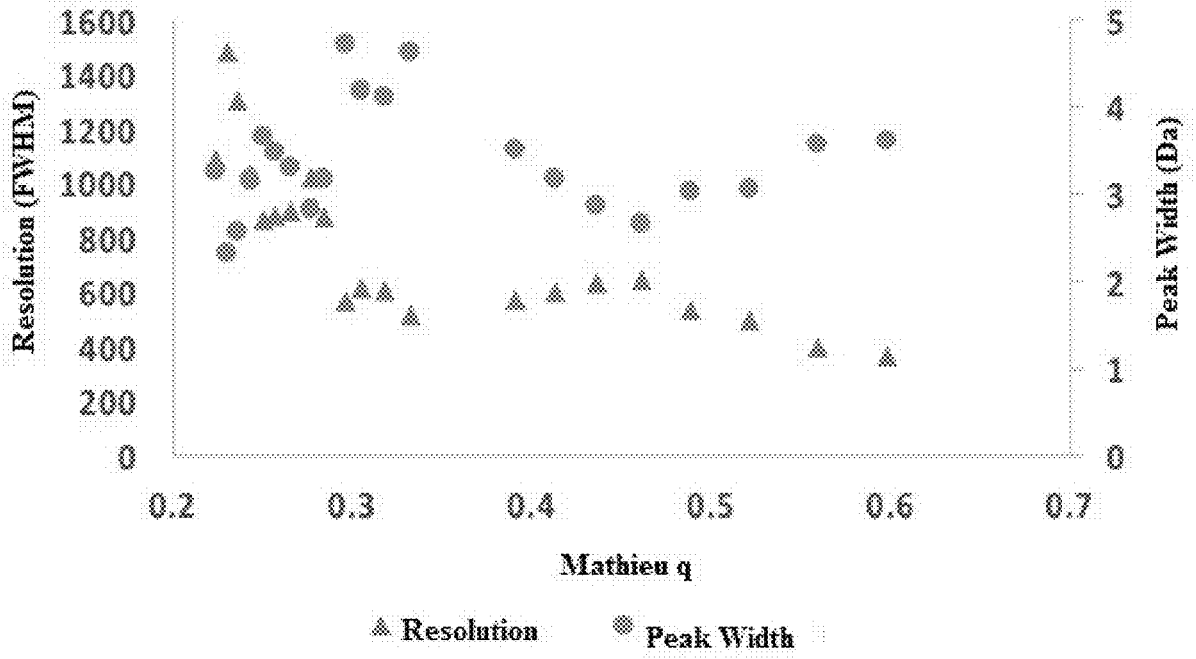

As shown in FIG. 3C, the resolution ranged from ~400 to ~1500 (FWHM) and generally increased with mass since the peak width was constant. When the frequency was scanned linearly, the resolution again generally decreased with Mathieu q. Since the scan rate in radians/sec$^2$ is constant for this type of scan, the difference in scan rate cannot account for the difference in resolution in this scan either. Differences in ejection q values and potential well depths also contribute to differences in resolution, which is well known from the theory of resonance ejection. Usually the resolution in resonance ejection decreases at low Mathieu q; however, the opposite effect is observed here. It may be the case that space charge decreases the resolution of low mass ions relative to high mass ions as would be expected, even in the case where space charge is controlled. Because low mass ions occupy the center of the ion cloud, a resonance ejection scan is analogous to peeling an onion from the inside out, thereby resulting in an increase in resolution with m/z. For now, the exact mechanism of resolution increase at low q is unknown.

Figure 4A:
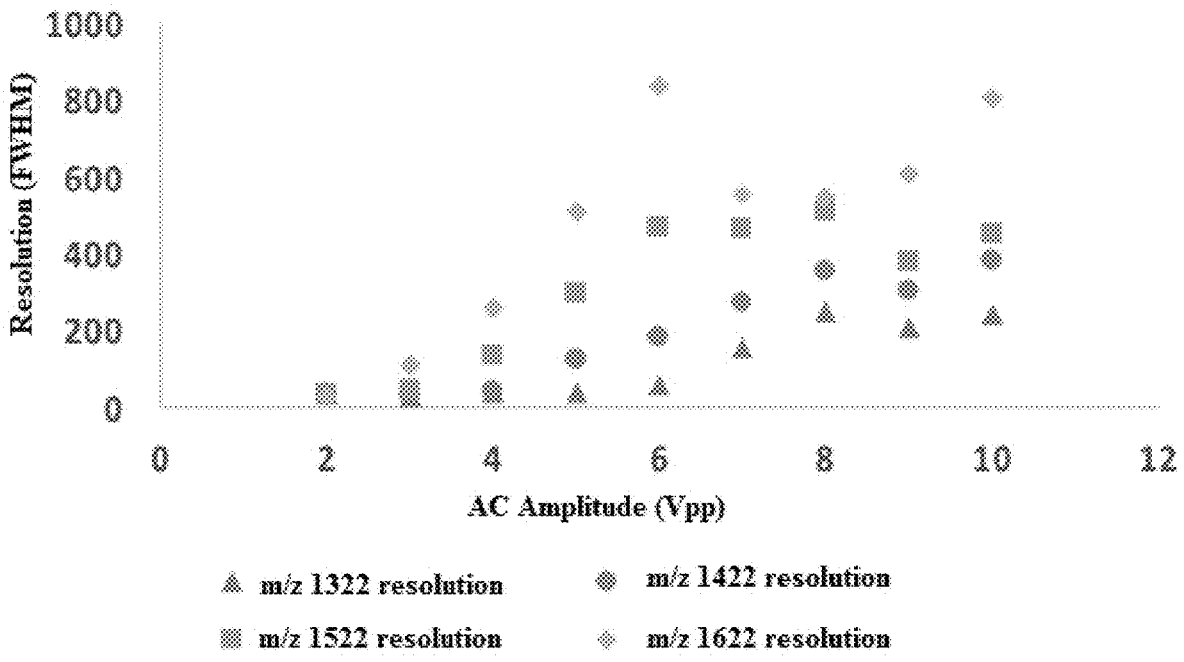
FIGS. 4A-C show resolution in inverse Mathieu q scans.
Figure 4B:
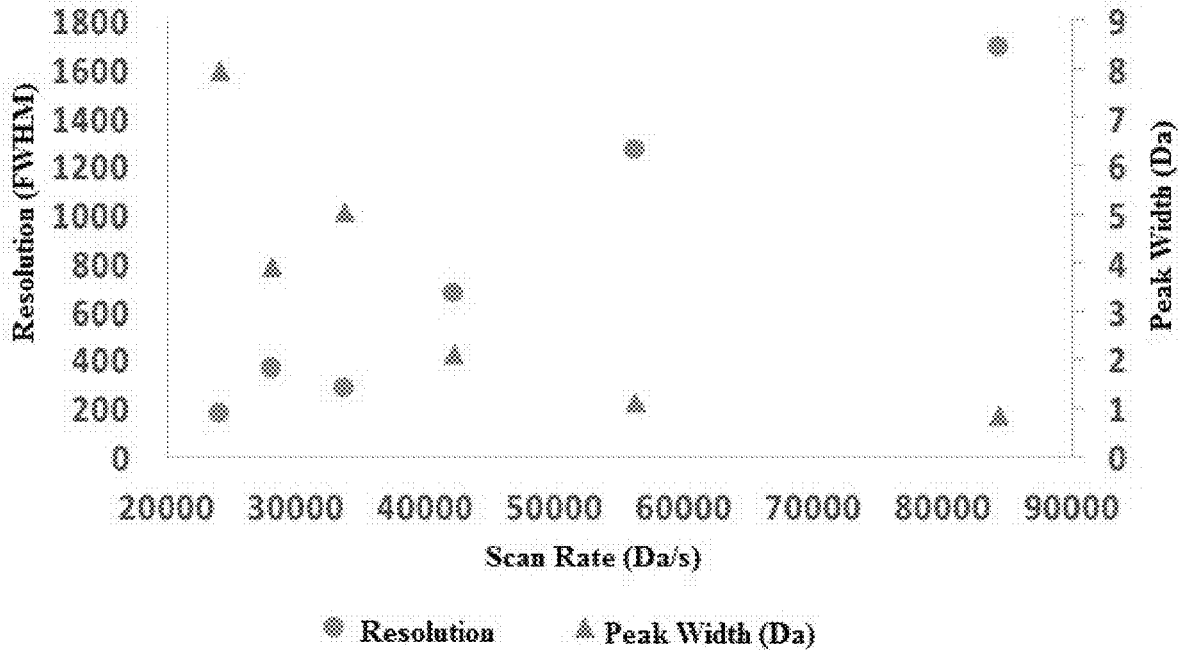

Resolution also depends on AC amplitude and scan rate. Surprisingly, the resolution for all ions increased up to the maximum amplitude of the generator (FIG. 4A), in contrast to previous results using linear frequency sweeping which showed significant peak broadening at AC amplitudes higher than ~1 $V_{pp}$. This could be due to the faster scan rate in these experiments than in the scans applied previously. Surprisingly, for m/z 1422, the resolution increased with scan rate (FIG. 4B), which should not be the case. The scan rate is calculated as the slope of the calibration equation (m/z vs time), the peak width was determined as full width at half maximum (FWHM), and the resolution was calculated as m/Δm (Δm=FWHM peak width). For this experiment, the scan rate was changed not by altering the rf amplitude, but rather by varying the mass scan time Δt while keeping the scan range the same.

Figure 4C:
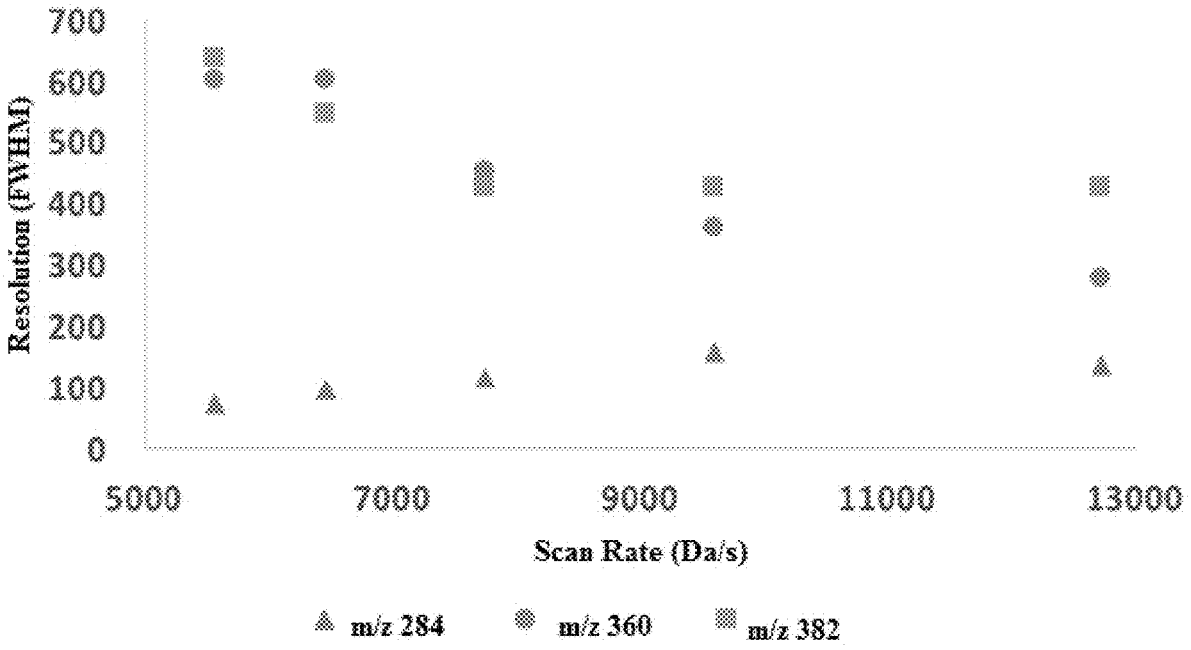

In order to quantify the effects of space charge, we used a simple mixture consisting of three pre-charged ions (quaternary amines, m/z 284, 360, and 382). The resolution of each ion as a function of scan rate is given in FIG. 4C. For the ion ejected first in the scan (m/z 284), which experiences the most space charge effects while being ejected, the resolution increased with scan rate. However, for the other two ions, the resolution decreased with scan rate, which is the expected result. This implies that increasing the scan rate can somewhat compensate for space charge effects, which has also been observed in resonance ejection. Presumably the ejected ions have fewer cycles through the rest of the ion cloud at high scan rates, reducing the interaction time and thereby resulting in less of a decrease in resolution.

Although unit resolution is not demonstrated here, the scan rate can be decreased and AC amplitude can be increased further in order to increase the resolution. The pressure can also be optimized for this scan. In addition, the time required to calculate the waveform and import it to a function generator increases with the length of the waveform, which is determined by the sampling rate and scan time. This application, however, is concerned primarily with empirical observations rather than resolution optimization.

Figure 5A:
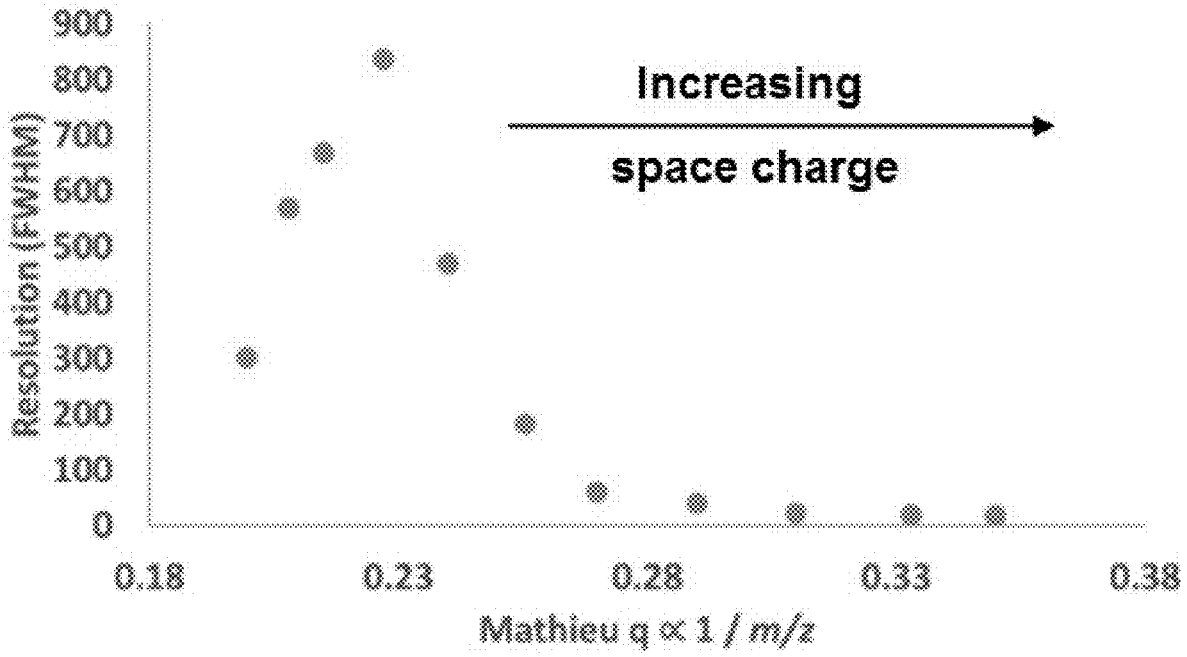
FIGS. 5A-B show space charge effects in secular frequency scanning.

As shown in FIG. 2A, which shows the result of a mass scan for a relatively long 50 ms injection time, space charge effects appear to play a significant role in determining both resolution and peak position. The resolution as a function of Mathieu q parameter for an inverse Mathieu q scan with a long 50 ms injection time is shown in FIG. 5A for ions with different m/z and therefore different Mathieu q parameters. The absolute resolution is significantly decreased from the scan in FIG. 3A since the injection time is 40 ms longer. The profile of resolution as a function of q is also significantly different. Most notable is that low mass ions (high q) suffer significantly from space charge effects, resulting in quite low resolution (R~20). As discussed previously, this is because these ions are ejected first, when the ion cloud is relatively dense. In addition, a deep potential well causes a physically tight ion packet and increases space charge effects, an effect made worse by the distribution of ions of different m/z, with low mass ions at the center of the cloud and high mass ions near the periphery. Curiously, high mass ions also appear to suffer from resolution degradation. We speculatively attribute this to non-optimal AC amplitudes for the high mass ions. In general the optimal resolution in resonance ejection will be obtained by ramping the AC amplitude linearly with m/z (i.e. time). Here the AC amplitude was kept constant, which may contribute to loss of resolution at high mass.

Figure 5B:
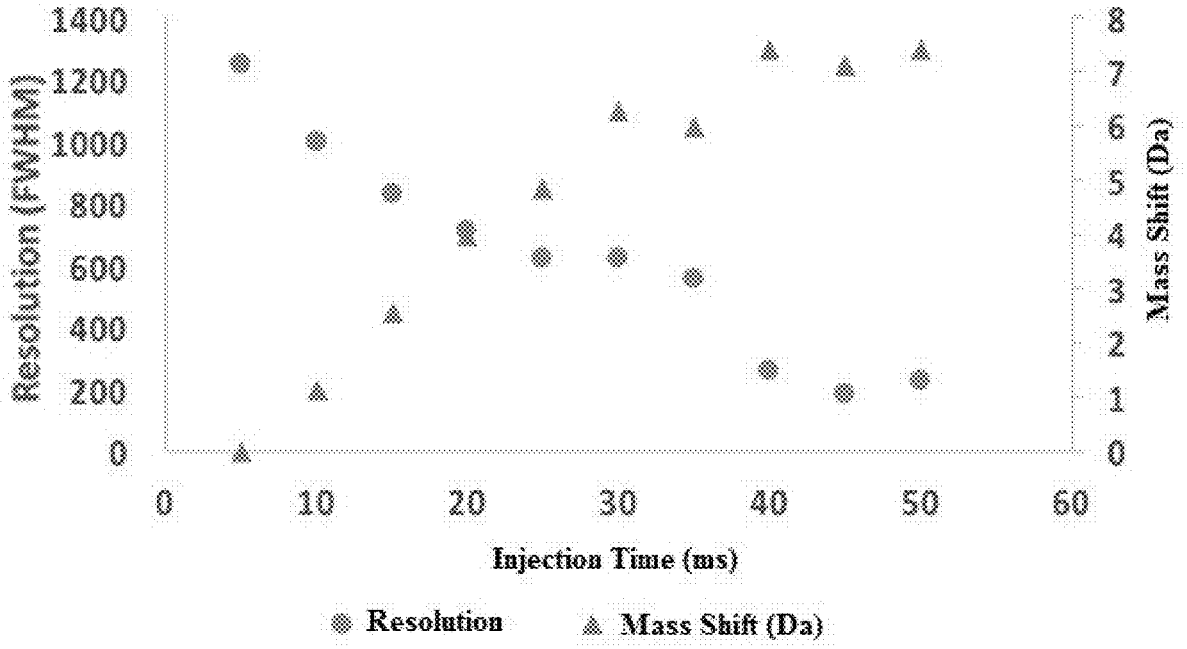

The resolution as a function of injection time for a single peak (m/z 1422) in the mass spectrum is shown in FIG. 5B. As expected, the resolution decreases with injection time due to greater space charge effects. However, more notable is the large mass shift observed at high injection times. These high values are probably due to the fast mass scanning performed here (scan rate ~30,000 Da/s).

The scan rate in an inverse q scan can be derived from the Mathieu q parameter. Differentiating eq. 3 with respect to t, and assuming that the trap parameters are kept constant, we obtain:

$$d(m/z)/dt=-4V_{0\text{-}p}/q^2\Omega^2(r_0^2)*(dq/dt) \quad (17).$$

From eq. 5 we obtain:

$$dq/dt=-k/(t-j)^2 \quad (18).$$

Substituting this into eq. 17, we have $$d(m/z)/dt=[-4V_{0\text{-}p}/[k/(t-j)]^2\Omega^2(r_0^2)]*[-k/(t-j)^2] \quad (19);$$

so that $$d(m/z)/dt=4V_{0\text{-}p}/k\Omega^2(r_0^2)\Omega\Delta\beta\omega\propto\Phi\tau\int\pi. \quad (20)$$

Thus, one expects the scan rate to depend linearly on the rf amplitude, a unique feature of this scan. As shown in FIGS. 4A-D, the scan rate can also be altered by keeping the mass scan range (begin and end q values) the same but altering the mass scan time Δt.

Figure 6A:
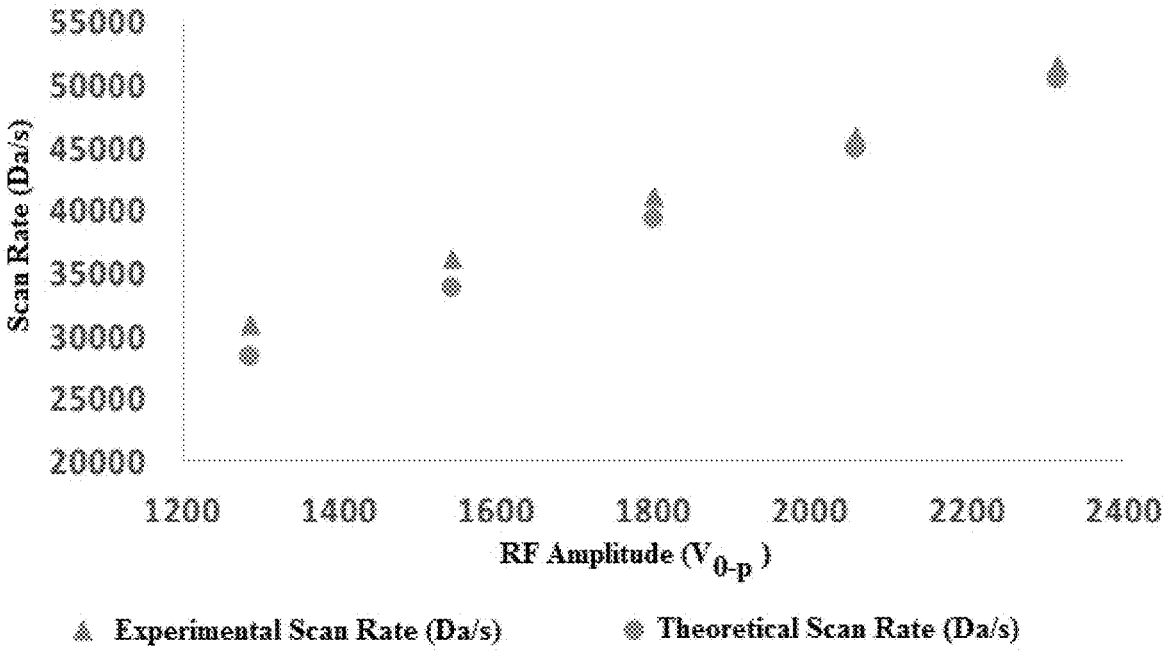
FIGS. 6A-C show effect of AC amplitude and rf amplitude on scan rate. For a constant AC waveform, the rf amplitude (directly proportional to the LMCO) linearly determines the scan rate (FIG. 6A).
Figure 6B:
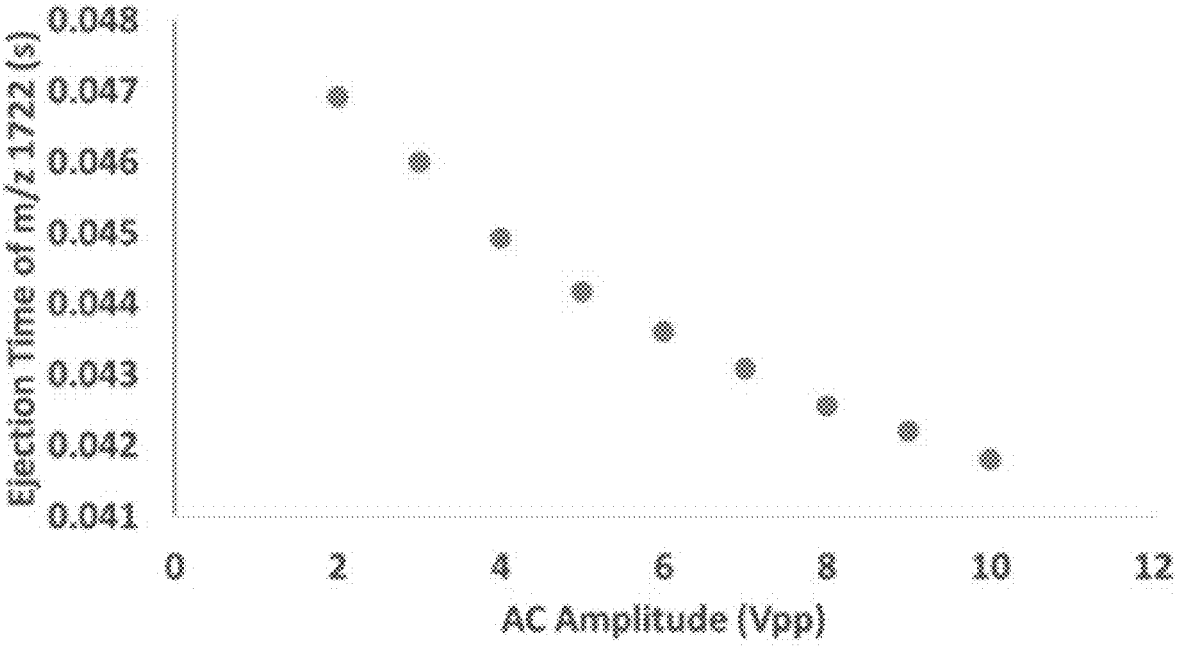
Figure 6C:
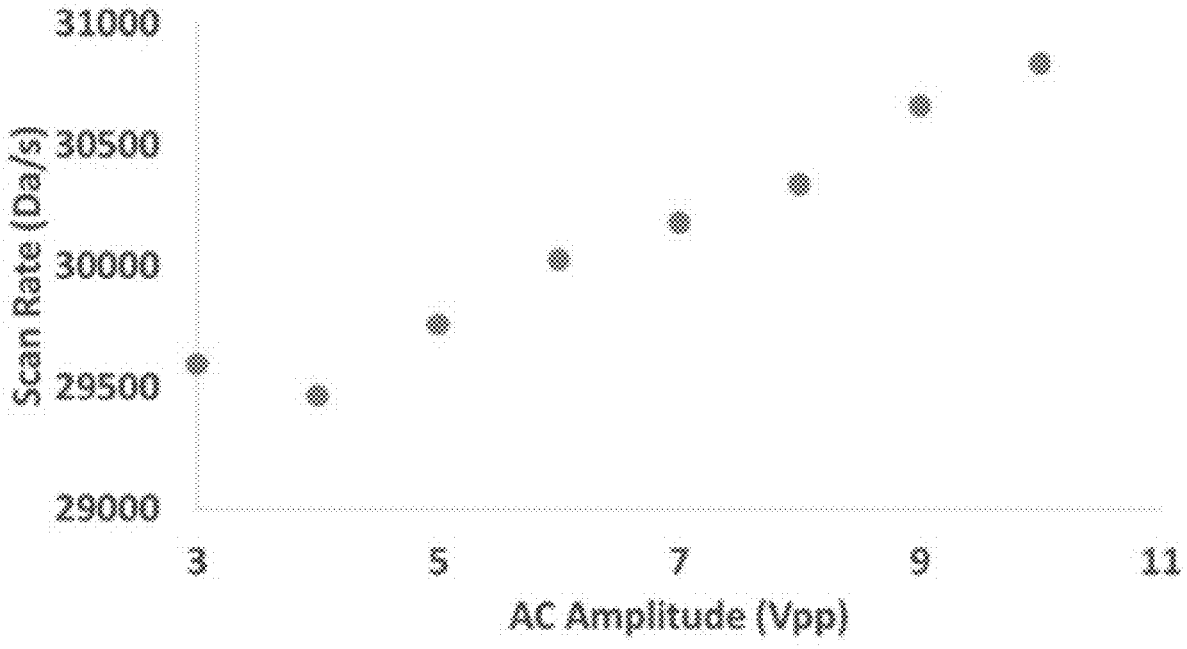

These results are verified in FIGS. 6A-C. To generate FIG. 6A, the Ultramark 1621 calibration solution was examined with a 0.3 s inverse Mathieu q scan from a q of 0.908 to 0.05 while varying the rf amplitude from scan to scan. Mass-to-charge was fitted linearly with time in order to generate a calibration curve, the slope of which was determined to be the scan rate. As shown in FIG. 6A, the experimental and theoretical scan rates are linearly determined by the rf amplitude for a fixed waveform and agree quite closely. The small differences observed between the theoretical and experimental values can be explained by any nonlinear contribution to the electric field (e.g. hexapole and octopole fields), which will change the field strength in the trap and thereby change each ion's Mathieu q parameter. The scan rate will also vary with AC amplitude, which contributes to this error.

The mass range should also depend linearly on the rf amplitude, with the first and last masses, $m/z_{min}$ and $m/z_{max}$, respectively, calculated from $$m/z_{min}=4V_{0\text{-}p}/q_{max}\Omega(r_0^2) \quad (21).$$

and eq. 16. The calculated and experimental LMCOs in these experiments also agreed quite closely. Experimentally, the LMCO is the m/z value that calibrates to time t=0, which is not necessarily the lowest m/z ion in the trap. In general, higher AC amplitudes led to a higher apparent LMCO, which approached the theoretical value as the AC amplitude was increased. This is because when the AC amplitude is increased all the ions are ejected at earlier points in the scan, which causes the calibration line (m/z vs ejection time) to shift leftward toward t=0, thereby increasing the apparent LMCO. As noted above, any nonlinear contribution to the electric field will also tend to change the LMCO, and thus the experimental LMCO may deviate from the theoretical value (which assumes a pure quadrupole field).

FIG. 6B shows the effect of AC amplitude on ion ejection time, which is a nearly linear relationship. Because the slope of ejection time vs AC amplitude may be different for ions of different masses, this leads to varying apparent scan rates, which are experimentally calculated in FIG. 6C. These were determined from the slope of the best fit line of m/z versus experimental ejection time (i.e. the calibration equation). This is a similar result to the change in slope when calibrating a secular frequency scan linear in frequency, as described previously. That is, a higher AC amplitude will tend to increase the rate of ion ejection, but this increase will not necessarily be uniform across Mathieu q space. Since the apparent scan rate increases when the AC amplitude increases, we can deduce that higher mass ions experience a greater shift in ejection time (toward earlier times) than low mass ions, which we observed when plotting the calibration equations at different AC amplitudes on the same plot (compare FIGS. 2C and D).

We have demonstrated a method of secular frequency scanning (scanning through ions of different secular frequency and hence mass/charge) which is linear with mass. The method is unique in that the only instrumental parameter that affects the required frequencies is the rf frequency. The waveform need not be recalculated since the scan rate (and the LMCO) are determined by the rf amplitude. Space charge appears to play a significant role in peak broadening in these scans, and high masses were shown to be easily accessible while maintaining resolution, sensitivity, and ease of calibration.

Unit resolution may be possible using these experiments, although there are tradeoffs with scan time. The scan time here was set at 0.3 s, which is short considering we are working out to high mass (over 8,000 Th, not explicitly shown). To increase resolution one would need to increase the scan time; the waveform would therefore contain more points. This means that it would take longer to calculate the waveform and load it into memory, although a better approach would be to calculate a battery of scan functions ahead of time rather than calculating them in real time. Control of space charge would also improve resolution, but we were not able to utilize automatic gain control in these experiments.

While this method requires complex waveform calculation, it may be particularly well suited for miniature mass spectrometers. We imagine a miniature system based solely on AC waveforms for ion isolation, ion activation, and ion ejection. Ion isolation may be performed by stored waveform inverse Fourier transform or by a similar frequency-based method, ion activation could proceed via resonance excitation, and the method demonstrated here could form the basis for the mass scan. Such a system would have low power consumption and simplify the electronics of the mass spectrometer since the feedback required for the linear rf amplitude ramp would no longer be needed. Instead, only a stable rf at constant amplitude and frequency would be required.

Ion Traps and Mass Spectrometers

Any ion trap known in the art can be used in systems of the invention. Exemplary ion traps include a hyperbolic ion trap (e.g., U.S. Pat. No. 5,644,131, the content of which is incorporated by reference herein in its entirety), a cylindrical ion trap (e.g., Bonner et al., International Journal of Mass Spectrometry and Ion Physics, 24(3):255-269, 1977, the content of which is incorporated by reference herein in its entirety), a linear ion trap (Hagar, Rapid Communications in Mass Spectrometry, 16(6):512-526, 2002, the content of which is incorporated by reference herein in its entirety), and a rectilinear ion trap (U.S. Pat. No. 6,838,666, the content of which is incorporated by reference herein in its entirety).

Any mass spectrometer (e.g., bench-top mass spectrometer of miniature mass spectrometer) may be used in systems of the invention and in certain embodiments the mass spectrometer is a miniature mass spectrometer. An exemplary miniature mass spectrometer is described, for example in Gao et al. (Anal. Chem. 2008, 80, 7198-7205.), the content of which is incorporated by reference herein in its entirety. In comparison with the pumping system used for lab-scale instruments with thousands of watts of power, miniature mass spectrometers generally have smaller pumping systems, such as a 18 W pumping system with only a 5 L/min (0.3 $m^3$/hr) diaphragm pump and a 11 L/s turbo pump for the system described in Gao et al. Other exemplary miniature mass spectrometers are described for example in Gao et al. (Anal. Chem., 2008, 80, 7198-7205.), Hou et al. (Anal. Chem., 2011, 83, 1857-1861.), and Sokol et al. (Int. J. Mass Spectrom., 2011, 306, 187-195), the content of each of which is incorporated herein by reference in its entirety.

Figure 23:
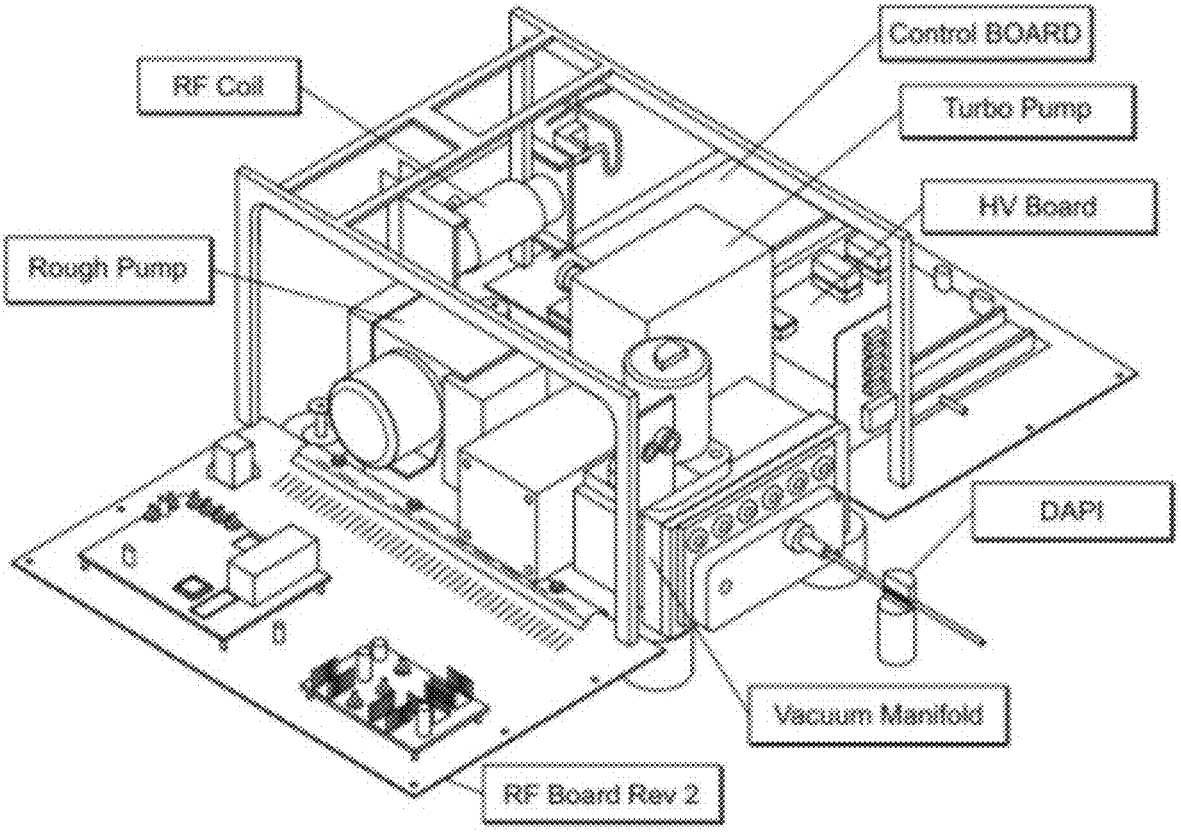
FIG. 23 is a picture illustrating various components and their arrangement in a miniature mass spectrometer.

FIG. 23 is a picture illustrating various components and their arrangement in a miniature mass spectrometer. The control system of the Mini 12 (Linfan Li, Tsung-Chi Chen, Yue Ren, Paul I. Hendricks, R. Graham Cooks and Zheng Ouyang "Miniature Ambient Mass Analysis System" Anal. Chem. 2014, 86 2909-2916, DOI: 10.1021/ac403766c; and 860. Paul I. Hendricks, Jon K. Dalgleish, Jacob T. Shelley, Matthew A. Kirleis, Matthew T. McNicholas, Linfan Li, Tsung-Chi Chen, Chien-Hsun Chen, Jason S. Duncan, Frank Boudreau, Robert J. Noll, John P. Denton, Timothy A. Roach, Zheng Ouyang, and R. Graham Cooks "Autonomous in-situ analysis and real-time chemical detection using a backpack miniature mass spectrometer: concept, instrumentation development, and performance" Anal. Chem., 2014, 86 2900-2908 DOI: 10.1021/ac403765x, the content of each of which is incorporated by reference herein in its entirety), and the vacuum system of the Mini 10 (Liang Gao, Qingyu Song, Garth E. Patterson, R. Graham Cooks and Zheng Ouyang, "Handheld Rectilinear Ion Trap Mass Spectrometer", Anal. Chem., 78 (2006) 5994-6002 DOI: 10.1021/ac061144k, the content of which is incorporated by reference herein in its entirety) may be combined to produce the miniature mass spectrometer shown in FIG. 5. It may have a size similar to that of a shoebox (H20×W25 cm×D35 cm). In certain embodiments, the miniature mass spectrometer uses a dual LIT configuration, which is described for example in Owen et al. (U.S. patent application Ser. No. 14/345,672), and Ouyang et al. (U.S. patent application Ser. No. 61/865,377), the content of each of which is incorporated by reference herein in its entirety.

Ionization Sources

In certain embodiments, the systems of the invention include an ionizing source, which can be any type of ionizing source known in the art. Exemplary mass spectrometry techniques that utilize ionization sources at atmospheric pressure for mass spectrometry include paper spray ionization (ionization using wetted porous material, Ouyang et al., U.S. patent application publication number 2012/0119079), electrospray ionization (ESI; Fenn et al., Science, 1989, 246, 64-71; and Yamashita et al., J. Phys. Chem., 1984, 88, 4451-4459.); atmospheric pressure ionization (APCI; Carroll et al., Anal. Chem. 1975, 47, 2369-2373); and atmospheric pressure matrix assisted laser desorption ionization (AP-MALDI; Laiko et al. Anal. Chem., 2000, 72, 652-657; and Tanaka et al. Rapid Commun. Mass Spectrom., 1988, 2, 151-153,). The content of each of these references is incorporated by reference herein in its entirety.

Exemplary mass spectrometry techniques that utilize direct ambient ionization/sampling methods include desorption electrospray ionization (DESI; Takats et al., Science, 2004, 306, 471-473, and U.S. Pat. No. 7,335,897); direct analysis in real time (DART; Cody et al., Anal. Chem., 2005, 77, 2297-2302.); atmospheric pressure dielectric barrier discharge Ionization (DBDI; Kogelschatz, Plasma Chemistry and Plasma Processing, 2003, 23, 1-46, and PCT international publication number WO 2009/102766), and electrospray-assisted laser desorption/ionization (ELDI; Shiea et al., J. Rapid Communications in Mass Spectrometry, 2005, 19, 3701-3704.). The content of each of these references in incorporated by reference herein its entirety.

System Architecture

Figure 24:
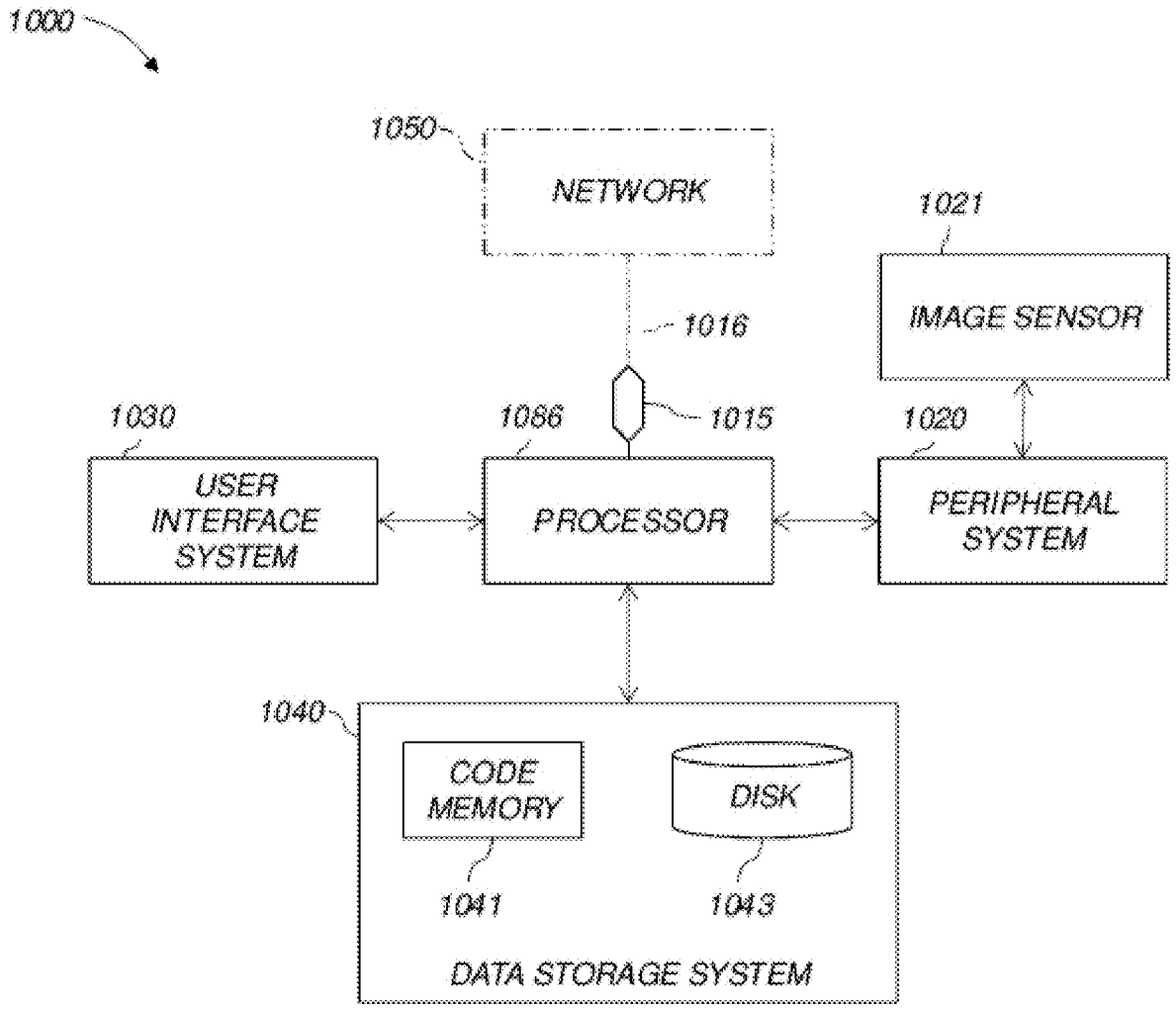
FIG. 24 shows a high-level diagram of the components of an exemplary data-processing system for analyzing data and performing other analyses described herein, and related components.

FIG. 24 is a high-level diagram showing the components of an exemplary data-processing system 1000 for analyzing data and performing other analyses described herein, and related components. The system includes a processor 1086, a peripheral system 1020, a user interface system 1030, and a data storage system 1040. The peripheral system 1020, the user interface system 1030 and the data storage system 1040 are communicatively connected to the processor 1086. Processor 1086 can be communicatively connected to network 1050 (shown in phantom), e.g., the Internet or a leased line, as discussed below. The data described above may be obtained using detector 1021 and/or displayed using display units (included in user interface system 1030) which can each include one or more of systems 1086, 1020, 1030, 1040, and can each connect to one or more network(s) 1050. Processor 1086, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALs), or digital signal processors (DSPs).

Processor 1086 which in one embodiment may be capable of real-time calculations (and in an alternative embodiment configured to perform calculations on a non-real-time basis and store the results of calculations for use later) can implement processes of various aspects described herein. Processor 1086 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. The phrase "communicatively connected" includes any type of connection, wired or wireless, for communicating data between devices or processors. These devices or processors can be located in physical proximity or not. For example, subsystems such as peripheral system 1020, user interface system 1030, and data storage system 1040 are shown separately from the data processing system 1086 but can be stored completely or partially within the data processing system 1086.

The peripheral system 1020 can include one or more devices configured to provide digital content records to the processor 1086. For example, the peripheral system 1020 can include digital still cameras, digital video cameras, cellular phones, or other data processors. The processor 1086, upon receipt of digital content records from a device in the peripheral system 1020, can store such digital content records in the data storage system 1040.

The user interface system 1030 can include a mouse, a keyboard, another computer (e.g., a tablet) connected, e.g., via a network or a null-modem cable, or any device or combination of devices from which data is input to the processor 1086. The user interface system 1030 also can include a display device, a processor-accessible memory, or any device or combination of devices to which data is output by the processor 1086. The user interface system 1030 and the data storage system 1040 can share a processor-accessible memory.

In various aspects, processor 1086 includes or is connected to communication interface 1015 that is coupled via network link 1016 (shown in phantom) to network 1050. For example, communication interface 1015 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM. Communication interface 1015 sends and receives electrical, electromagnetic or optical signals that carry digital or analog data streams representing various types of information across network link 1016 to network 1050. Network link 1016 can be connected to network 1050 via a switch, gateway, hub, router, or other networking device.

Processor 1086 can send messages and receive data, including program code, through network 1050, network link 1016 and communication interface 1015. For example, a server can store requested code for an application program (e.g., a JAVA applet) on a tangible non-volatile computer-readable storage medium to which it is connected. The server can retrieve the code from the medium and transmit it through network 1050 to communication interface 1015. The received code can be executed by processor 1086 as it is received, or stored in data storage system 1040 for later execution.

Data storage system 1040 can include or be communicatively connected with one or more processor-accessible memories configured to store information. The memories can be, e.g., within a chassis or as parts of a distributed system. The phrase "processor-accessible memory" is intended to include any data storage device to or from which processor 1086 can transfer data (using appropriate components of peripheral system 1020), whether volatile or non-volatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), Universal Serial Bus (USB) interface memory device, erasable programmable read-only memories (EPROM, EEPROM, or Flash), remotely accessible hard drives, and random-access memories (RAMs). One of the processor-accessible memories in the data storage system 1040 can be a tangible non-transitory computer-readable storage medium, i.e., a non-transitory device or article of manufacture that participates in storing instructions that can be provided to processor 1086 for execution.

In an example, data storage system 1040 includes code memory 1041, e.g., a RAM, and disk 1043, e.g., a tangible computer-readable rotational storage device such as a hard drive. Computer program instructions are read into code memory 1041 from disk 1043. Processor 1086 then executes one or more sequences of the computer program instructions loaded into code memory 1041, as a result performing process steps described herein. In this way, processor 1086 carries out a computer implemented process. For example, steps of methods described herein, blocks of the flowchart illustrations or block diagrams herein, and combinations of those, can be implemented by computer program instructions. Code memory 1041 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects. These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 1086 (and possibly also other processors) to cause functions, acts, or operational steps of various aspects herein to be performed by the processor 1086 (or other processor). Computer program code for carrying out operations for various aspects described herein may be written in any combination of one or more programming language(s), and can be loaded from disk 1043 into code memory 1041 for execution. The program code may execute, e.g., entirely on processor 1086, partly on processor 1086 and partly on a remote computer connected to network 1050, or entirely on the remote computer.

Discontinuous Atmospheric Pressure Interface (DAPI)

In certain embodiments, the systems of the invention can be operated with a Discontinuous Atmospheric Pressure Interface (DAPI). A DAPI is particularly useful when coupled to a miniature mass spectrometer, but can also be used with a standard bench-top mass spectrometer. Discontinuous atmospheric interfaces are described in Ouyang et al. (U.S. Pat. No. 8,304,718 and PCT application number PCT/US2008/065245), the content of each of which is incorporated by reference herein in its entirety.

Samples

A wide range of heterogeneous samples can be analyzed, such as biological samples, environmental samples (including, e.g., industrial samples and agricultural samples), and food/beverage product samples, etc.

Exemplary environmental samples include, but are not limited to, groundwater, surface water, saturated soil water, unsaturated soil water; industrialized processes such as waste water, cooling water; chemicals used in a process, chemical reactions in an industrial processes, and other systems that would involve leachate from waste sites; waste and water injection processes; liquids in or leak detection around storage tanks; discharge water from industrial facilities, water treatment plants or facilities; drainage and leachates from agricultural lands, drainage from urban land uses such as surface, subsurface, and sewer systems; waters from waste treatment technologies; and drainage from mineral extraction or other processes that extract natural resources such as oil production and in situ energy production.

Additionally exemplary environmental samples include, but certainly are not limited to, agricultural samples such as crop samples, such as grain and forage products, such as soybeans, wheat, and corn. Often, data on the constituents of the products, such as moisture, protein, oil, starch, amino acids, extractable starch, density, test weight, digestibility, cell wall content, and any other constituents or properties that are of commercial value is desired.

Exemplary biological samples include a human tissue or bodily fluid and may be collected in any clinically acceptable manner. A tissue is a mass of connected cells and/or extracellular matrix material, e.g. skin tissue, hair, nails, nasal passage tissue, CNS tissue, neural tissue, eye tissue, liver tissue, kidney tissue, placental tissue, mammary gland tissue, placental tissue, mammary gland tissue, gastrointestinal tissue, musculoskeletal tissue, genitourinary tissue, bone marrow, and the like, derived from, for example, a human or other mammal and includes the connecting material and the liquid material in association with the cells and/or tissues. A body fluid is a liquid material derived from, for example, a human or other mammal. Such body fluids include, but are not limited to, mucous, blood, plasma, serum, serum derivatives, bile, blood, maternal blood, phlegm, saliva, sputum, sweat, amniotic fluid, menstrual fluid, mammary fluid, peritoneal fluid, urine, semen, and cerebrospinal fluid (CSF), such as lumbar or ventricular CSF. A sample may also be a fine needle aspirate or biopsied tissue. A sample also may be media containing cells or biological material. A sample may also be a blood clot, for example, a blood clot that has been obtained from whole blood after the serum has been removed.

In one embodiment, the biological sample can be a blood sample, from which plasma or serum can be extracted. The blood can be obtained by standard phlebotomy procedures and then separated. Typical separation methods for preparing a plasma sample include centrifugation of the blood sample. For example, immediately following blood draw, protease inhibitors and/or anticoagulants can be added to the blood sample. The tube is then cooled and centrifuged, and can subsequently be placed on ice. The resultant sample is separated into the following components: a clear solution of blood plasma in the upper phase; the buffy coat, which is a thin layer of leukocytes mixed with platelets; and erythrocytes (red blood cells). Typically, 8.5 mL of whole blood will yield about 2.5-3.0 mL of plasma.

Blood serum is prepared in a very similar fashion. Venous blood is collected, followed by mixing of protease inhibitors and coagulant with the blood by inversion. The blood is allowed to clot by standing tubes vertically at room temperature. The blood is then centrifuged, wherein the resultant supernatant is the designated serum. The serum sample should subsequently be placed on ice.

Prior to analyzing a sample, the sample may be purified, for example, using filtration or centrifugation. These techniques can be used, for example, to remove particulates and chemical interference. Various filtration media for removal of particles includes filer paper, such as cellulose and membrane filters, such as regenerated cellulose, cellulose acetate, nylon, PTFE, polypropylene, polyester, polyethersulfone, polycarbonate, and polyvinylpyrolidone. Various filtration media for removal of particulates and matrix interferences includes functionalized membranes, such as ion exchange membranes and affinity membranes; SPE cartridges such as silica- and polymer-based cartridges; and SPE (solid phase extraction) disks, such as PTFE- and fiberglass-based. Some of these filters can be provided in a disk format for loosely placing in filter holdings/housings, others are provided within a disposable tip that can be placed on, for example, standard blood collection tubes, and still others are provided in the form of an array with wells for receiving pipetted samples. Another type of filter includes spin filters. Spin filters consist of polypropylene centrifuge tubes with cellulose acetate filter membranes and are used in conjunction with centrifugation to remove particulates from samples, such as serum and plasma samples, typically diluted in aqueous buffers.

Filtration is affected in part, by porosity values, such that larger porosities filter out only the larger particulates and smaller porosities filtering out both smaller and larger porosities. Typical porosity values for sample filtration are the 0.20 and 0.45 μm porosities. Samples containing colloidal material or a large amount of fine particulates, considerable pressure may be required to force the liquid sample through the filter. Accordingly, for samples such as soil extracts or wastewater, a pre-filter or depth filter bed (e.g. "2-in-1" filter) can be used and which is placed on top of the membrane to prevent plugging with samples containing these types of particulates.

In some cases, centrifugation without filters can be used to remove particulates, as is often done with urine samples. For example, the samples are centrifuged. The resultant supernatant is then removed and frozen.

After a sample has been obtained and purified, the sample can be analyzed to determine the concentration of one or more target analytes, such as elements within a blood plasma sample. With respect to the analysis of a blood plasma sample, there are many elements present in the plasma, such as proteins (e.g., Albumin), ions and metals (e.g., iron), vitamins, hormones, and other elements (e.g., bilirubin and uric acid). Any of these elements may be detected using methods of the invention. More particularly, methods of the invention can be used to detect molecules in a biological sample that are indicative of a disease state.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

Examples

Example 1: Materials and Methods

Chemicals: Didodecyldimethylammonium bromide was purchased from Sigma Aldrich (St. Louis, Mo., USA), hexadecyltrimethylammonium bromide was purchased from Tokyo Chemical Industry Co. (Tokyo, Japan), and benzylhexadecyldimethylammonium chloride was purchased from JT Baker Chemical Co (Phillipsburg, N.J., USA). In general, the concentrations were 5-10 μg/mL. Pierce ESI LTQ calibration solution (containing Ultramark $1621_{[38]}$) was obtained from Thermo Fisher (Rockford, Ill., USA). A reference spectrum for this calibration solution can be found on the manufacturer's website (currently, https://www.thermofisher.com/order/catalog/product/88322).

Ionization: Ions were generated by nanoelectrospray ionization (nESI) at ~1500 V using 5 μm nanospray tips pulled from borosilicate glass capillaries (1.5 mm O.D., 0.86 I.D., Sutter Instrument Co., Novato, Calif., USA) by a Flaming/Brown micropipette puller (Sutter Instrument Co. model P-97).

Instrumentation: All experiments were performed using a Thermo LTQ linear ion trap[9] (San Jose, Calif., USA) with the rf frequency tuned to 1.175 MHz. The rf amplitude of the instrument was kept approximately constant by using the "Ultrazoom" feature (rf scan rate of 27 Da/s) set at an appropriate lower mass cutoff (LMCO). All LMCO values reported herein describe the m/z value at q=0.908. Rf voltages are also reported, in units of $V_{0-p}$ (rod to ground). Helium at a pressure of 1 mtorr was used for collisional cooling.

The resonance ejection waveform was replaced by a custom waveform generated in Matlab using the method described above. The waveform was generally 0.3 s in length with the waveform generator (Keysight 33612A, Newark, S.C., USA) sampling rate set to 10 MSa/s. Note that it is important to oversample the waveform to maintain the fidelity of the frequency scan. Here we sample at ~16 times the highest frequency (~600 kHz) in the frequency sweep.

The AC waveform was triggered at the beginning of the mass scan using the triggers in the LTQ Tune diagnostics menu and was swept from high frequency to low frequency so that an inverse relationship between the excited ion's Mathieu q parameter and time was obtained, thereby giving a linear m/z calibration (see FIG. 1). Generally, $q_{max}$, was set to 0.908 and $q_{min}$ was 0.05. In most scans, the rf amplitude was set at 1290 $V_{0-p}$ so that the LMCO was m/z 460, which resulted in a scan rate of ~30,000 Da/s.

Data were obtained from either the single-ended or differential output(s) on the LTQ electrometer board and recorded using an oscilloscope (Tektronix TDS 2024C, Beaverton, Oreg., USA, or Agilent Technologies InfiniiVision MSO-X 4154A) which was triggered using the "Sync" output on the waveform generator. This increased the density of data points in time compared with the LTQ data collection rate of 1 point every 0.37 ms. All spectra and data points are based on the average of 16 scans.

Example 2: Extending the Mass Range of a Miniature Ion Trap Mass Spectrometer Using the Inverse Mathieu q Scan The mass/charge range of a mass spectrometer, operated in either the boundary or resonance ejection mode, is usually limited by the highest radiofrequency (rf) voltage that can be attained, although lowering the resonance ejection Mathieu q value can increase this range at the expense of resolution and spectral complexity. High voltage requirements are particularly troublesome for miniature instruments, which have tight electronic constraints. This example demonstrates an alternative approach to mass range extension based on scanning the resonance ejection frequency nonlinearly in the form of an inverse Mathieu q scan. The results show an increase in mass range of up to 3.5 times without instrumental modifications.

Introduction

Miniaturization of mass spectrometers has been the subject of extensive investigation over the past two decades, resulting in the development of more than thirty complete systems from both academic and commercial laboratories. These devices can be designed for targeted or general applications ranging from environmental and drug screening to bacterial discrimination and hazardous or explosive compound detection. For these applications, usually only modest performance is required—unit resolution over a mass range from 50 Da to <1,000 Da and detection limits in the ppm range.

Ionization of complex samples for miniature mass spectrometers commonly is performed using either a spray- or plasma-based ambient ionization method due to the experimental simplicity and since little to no sample workup is required. Common ambient spray sources are desorption electrospray ionization, paper spray ionization, leaf spray ionization, and relay electrospray, along with their closely related variants. Plasma sources, though generally limited to volatile analytes, include low-temperature plasma, dielectric barrier discharge ionization, and desorption atmospheric pressure chemical ionization. In the experiments using pure samples or simple mixtures described here, nanoelectrospray ionization (nESI) sufficed.

The vacuum system is perhaps the most troublesome component for miniaturization because i) it is the most power-hungry subsystem and ii) small pumps inherently have small pumping capacities. Point (ii) is particularly cumbersome because mass analyzers require good vacuum in order to obtain the desired level of performance. The standard configuration for miniature mass spectrometers is to use either a membrane introduction interface, an analytically limited option, or to use a discontinuous interface (i.e. DAPI or PP-API) with a 5 L/min diaphragm pump and a 10 L/s turbo pump. This latter choice provides analytical versatility and good performance at some cost in terms of analysis time. Continuous atmospheric pressure interfaces enabled by differential pumping do exist but they trade performance for continuity. Demonstrations of ion trap mass analysis at relatively high pressures, from 15 mtorr up to ~1 torr, signal possible reduction in the need for high performance pumps.

Ion traps are preferable to other mass analyzers in miniature instruments because they operate at higher pressure, their resolution does not inherently depend on device size, and they have capabilities for single analyzer tandem mass spectrometry. Geometry is usually simplified in smaller traps for ease of fabrication, as in cylindrical (simplified from 3D quadrupole ion trap), rectilinear (linear 2D), and halo (toroidal) ion traps.

The performance requirements of ion traps in miniature mass spectrometers usually includes unit mass resolution with ppm or lower detection limits and a mass/charge range approaching m/z 1,000. Higher performance may be achieved without sacrificing simplicity and ease of operation. Resolution scales inversely with operating pressure and directly with rf frequency. In addition, space charge effects will tend to increase with smaller traps, and sensitivity also tends to degrade with pressure.

The subject of this Example is mass range, which in miniature ion traps is primarily determined by the maximum rf voltage ($V_{0\text{-}p,max}$) obtainable during the resonance ejection scan. The highest mass-to-charge value accessible for a linear ion trap is $$m/z_{max}=8V_{0\text{-}p,max}/q_x\Omega^2(x_0^2+y_0^2) \quad \text{Eq. 1}$$

where $q_x$ is the Mathieu parameter at which the resonance ejection signal is set, $\Omega$ is the angular rf frequency, and $x_0$ and $y_0$ are the internal radii of the quadrupole field. Mass range in a quadrupole ion trap is additionally dependent upon i) the pressure in the device and in the ion optics and ii) the Dehmelt pseudo-potential well depth ($D_{x,y}=qV_{RF}/4$) of analyte ions. In general, in order to trap high m/z ions, a higher pressure must be used in order to collisionally cool larger ions, which will tend to have high kinetic energies and low pseudo-potential well depths.

Experimentally, mass range can be extended by i) decreasing or scanning the main rf drive frequency, ii) decreasing the size of the trap, or iii) decreasing the Mathieu resonance q value (i.e. using a lower resonance frequency). Both (i) and (ii) require instrumental modification, whereas (iii), resonance ejection, is the more common method due to its simplicity. However, resolution inevitably suffers at lower resonance q values and spectral complexity from associated boundary ejection can be problematic. A fourth alternative, which is described herein, is to scan the resonance ejection frequency at constant rf amplitude, viz. to perform a secular frequency scan.

In secular frequency scanning a linear ramp of the resonance ejection frequency is applied at constant rf amplitude and frequency. Our original aim in exploring this scan was motivated by the possibility of performing very simple single analyzer precursor scans in a miniature mass spectrometer. Although this type of precursor scan can be done, its performance is limited by the range of q values over which ions are fragmented. Nonetheless, we investigated the secular frequency scan (or AC scan) further as a simple alternative to resonance or boundary ejection.

Two of the principal concerns with AC scanning are i) the effects of nonlinear resonance points and ii) the nonlinear relationship between m/z and secular frequency (and hence time). We showed that nonlinear resonance points resulted in either blank intensity profiles or broadened mass peaks, depending on scan direction. However, in hyperbolic traps, these effects will tend to be minimal. We also demonstrated the complex nonlinear calibration procedure needed for secular frequency scanning. In this method, applied resonance frequencies are correlated to m/z through the Mathieu parameters q and β, and a final linear fit using calibration standards gives the correct calibration. However, because calibration will change with rf amplitude, rf frequency, AC amplitude, and start and end AC frequencies, it is preferable to have a linear calibration procedure, which we have recently demonstrated, as described in examples herein. This Example shows that by scanning the frequency of the resonance ejection signal so that an inverse relationship between Mathieu q and time is obtained, a linear relationship then exists between m/z and time, a feature which has been sought for years.

Materials and Methods

Chemicals: Renin substrate tetradecapeptide (angiotensinogen 1-14), neurotensin, insulin-like growth factor fragment 3-40, bovine serum albumin, cesium hydrogencarbonate, and perfluoroheptanoic acid were purchased from Sigma-Aldrich Co. (St. Louis, Mo., USA). Human Ghrelin was purchased from Phoenix Pharmaceuticals, Inc. (Belmont, Calif., USA). Trimethylamine hydrochloride and polyethylene glycol (PEG) 4,400 and 14,000 were purchased from Aldrich Chemical Company, Inc. (Milwaukee, Wis., USA). Concentrations for salts were ~2 mM in methanol/water. Bovine serum albumin was dissolved in water at 20 ug/mL. Polymers were dissolved in methanol/water at ~1 mM with 5,000 ppm triethylamine added as charge reducing agent. Peptides were dissolved in water to concentrations of ~200 uM.

Ionization: In all experiments ions were produced by nESI at ~1500 V using 5 μm nanospray tips pulled from borosilicate glass capillaries (1.5 mm O.D., 0.86 I.D., Sutter Instrument Co.) by a Flaming/Brown micropipette puller (Sutter Instrument Co. model P-97, Novato, Calif., USA).

Instrumentation: Experiments were performed using both a benchtop Thermo LTQ linear ion trap mass spectrometer (San Jose, Calif., USA) as well as the Mini 12 miniature mass spectrometer (Wells, M. J. Roth, A. D. Keil, J. W. Grossenbacher, D. R. Justes, G. E. Patterson, D. J. Barket, Jr., Implementation of DART and DESI ionization on a fieldable mass spectrometer, J Am Soc Mass Spectrom, 19 (2008) 1419-1424).

For conventional scans on the LTQ, the rf frequency was tuned to 1.175 MHz and built-in scan functions were used with automatic gain control (AGC) turned on. The "normal" scan rate is 16,666 Da/s at an ejection frequency of 490 kHz, whereas the "high mass" (i.e. low q resonance ejection) scan uses a lower scan rate of 2,500 Da/s at 200 kHz (q=0.46) which increases the upper mass/charge limit from 2,000 Th to 4,000 Th (Th=Thomson=mass-to-charge).

The inverse Mathieu q scan was performed using the LTQ by substituting a swept frequency resonance ejection signal for the LTQ's built-in fixed resonance signal during an Ultrazoom scan with a given lower mass cutoff (LMCO). As we have described previously, the Ultrazoom scan is a very slow scanning method that allows the rf amplitude to remain nearly constant (other scan capabilities are disallowed if no RF scan is implemented). The resonance ejection signal was constructed in Matlab using the algorithm previously described (L. Gao, A. Sugiarto, J. D. Harper, R. G. Cooks, Z. Ouyang, Design and characterization of a multisource hand-held tandem mass spectrometer, Anal. Chem., 80 (2008) 7198-7205). Briefly, the resonance frequency is scanned to maintain an inverse relationship between Mathieu q and time, thereby giving a linear mass scan. The waveform was imported to an arbitrary waveform generator (Keysight 36612A, Newark, S.C., USA) with sampling rate set to 10 MSa/s. The AC waveform was triggered at the beginning of the mass scan using the triggers in the LTQ Tune diagnostics menu. In general, the scan time was 0.3 s and the highest and lowest Mathieu q values were 0.908 and 0.05. The amplitude of this resonance signal was generally 2-10 $V_{pp}$. Automatic gain control (AGC) was turned off during the inverse Mathieu q scan to prevent triggering the AC waveform on the AGC scan. Data were collected using either the built-in hardware and software of the LTQ or, in cases where resolution was of interest or where a higher density of data points was desired, as a differential signal from the LTQ electrometer board (collected with an oscilloscope, Tektronix TDS 2024C, Beaverton, Oreg., USA).

For scans using the Mini 12 mass spectrometer (rf frequency=0.999 MHz), the waveform generator was triggered using a high frequency AC waveform output from the AC/waveform board. The discontinuous atmospheric pressure interface was held open for 12 ms and the collisional cooling time was set to 300 ms. The Mini 12 data collection system was sufficient for the inverse Mathieu q scan.

All spectra were calibrated by comparing mass spectral peak locations in cesium tridecafluoroheptanoic acid clusters to standard spectra obtained using the LTQ's "high mass" scan (low q resonance ejection).

Mass Range Extension Using a Benchtop Mass Spectrometer

This Example relates to extending the mass range of a miniature mass spectrometer without instrumental modifications. That is, the goal is to increase mass range while keeping rf amplitude within readily achievable ranges and maintaining the rf frequency and the trap size at constant values.

Figure 7A:
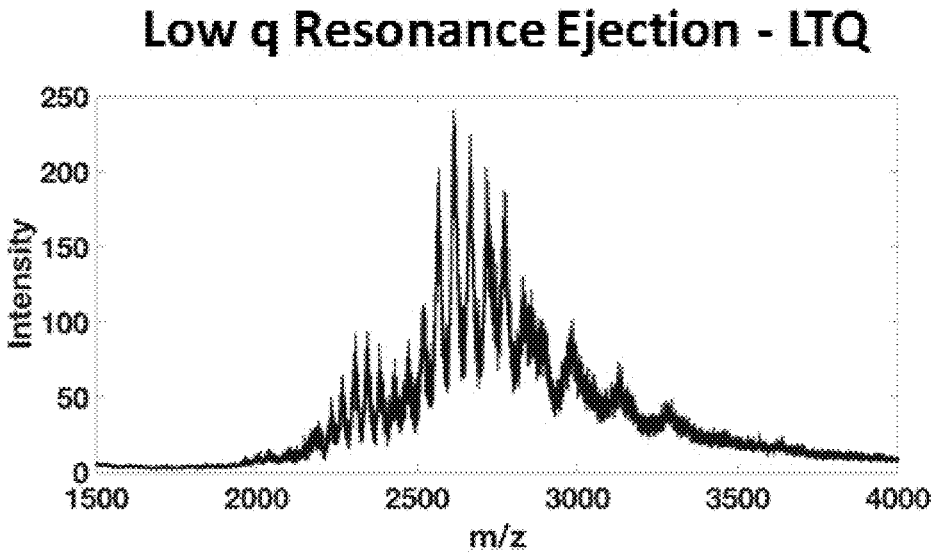
FIGS. 7A-H show mass range extension using the inverse Mathieu q scan on a benchtop LTQ linear ion trap mass spectrometer.
Figure 7B:
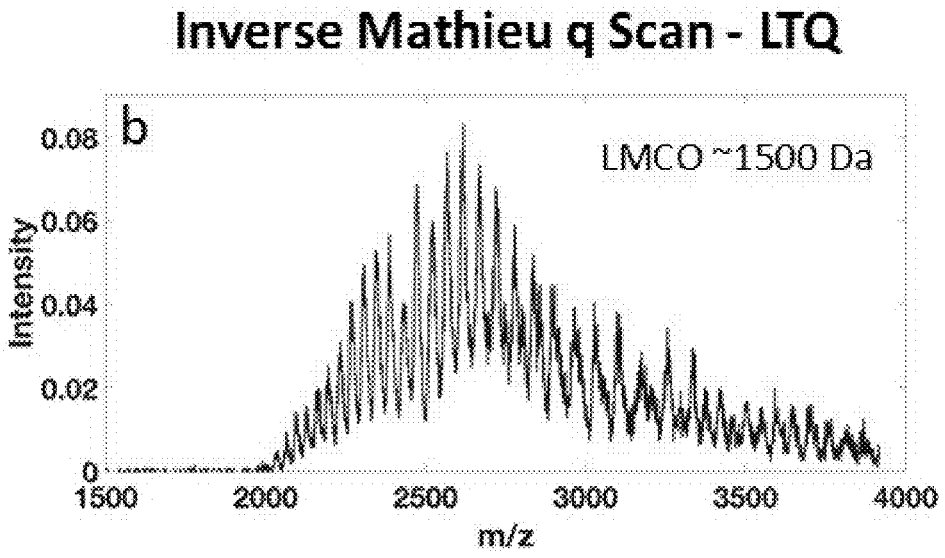

FIGS. 7A-H compare several spectra obtained by low q resonance ejection (left column) with data acquired using the inverse Mathieu q scan (right) on a commercial LTQ linear ion trap. FIGS. 7A-B compare typical spectra obtained for bovine serum albumin (66 kDa). The two spectra are nearly identical in terms of the charge state profile and resolution. Because the scan rate in the inverse Mathieu q scan is much higher (82,000 Da/s compared to 2,500 Da/s), fewer ions are lost (e. g. to charge transfer to the background gas) before they are ejected, therefore resulting in higher sensitivity and observation of more charge states. The inverse Mathieu q scan requires a fairly high LMCO in order to observe these ions. The higher LMCO will increase these ions' Mathieu q values, which i) increases their potential well depth so they are not removed from the trap prematurely by the constant amplitude frequency sweep, and ii) puts them within the Mathieu q range of the scan, which here was set from 0.05 to 0.908. That is, ions with q values below 0.05 will not be detected.

It is also important to note that for a given frequency sweep the scan rate, scan range, and resolution will depend on the rf amplitude, the rf frequency, and the trap size. Since the rf amplitude is the only adjustable parameter, it will determine the scan rate and scan range. A higher LMCO will increase the mass range but it will also increase the scan rate. In contrast, in the resonance ejection experiment, the scan rate is constant; it is set by the rate of change of the rf amplitude with respect to time as well as the resonance q parameter, trap size, and rf frequency. The total scan time for a resonance ejection scan will thus increase with the mass range.

The uppermost m/z value will additionally be limited by the AC amplitude, which here is kept constant. Higher AC amplitudes are typically needed to eject ions of higher mass, despite their lower pseudo-potential well depth, but AC amplitudes that are too high will tend to eject these ions before their resonance condition is met, decreasing the apparent mass range.

Figure 7C:
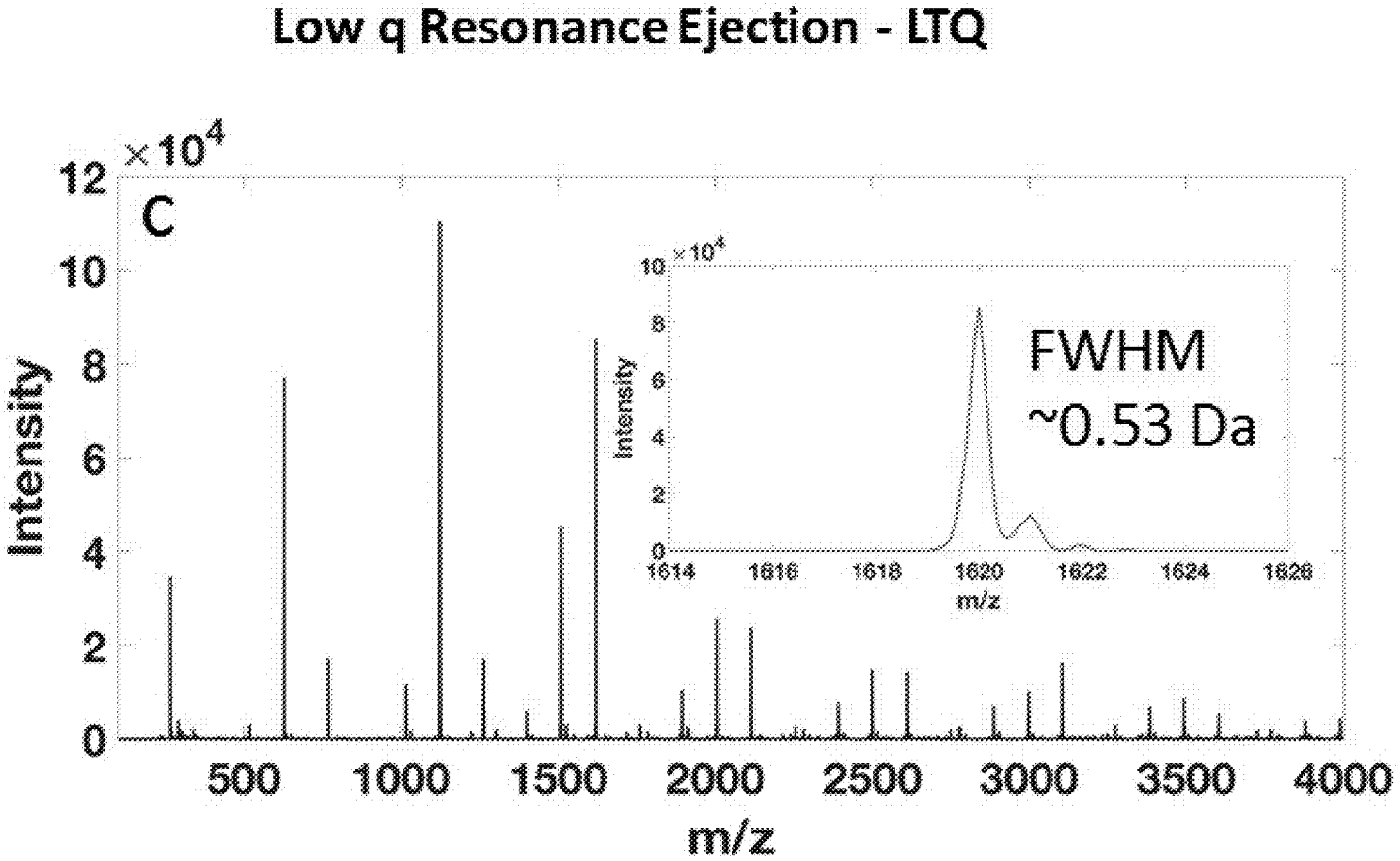
Figure 7D:
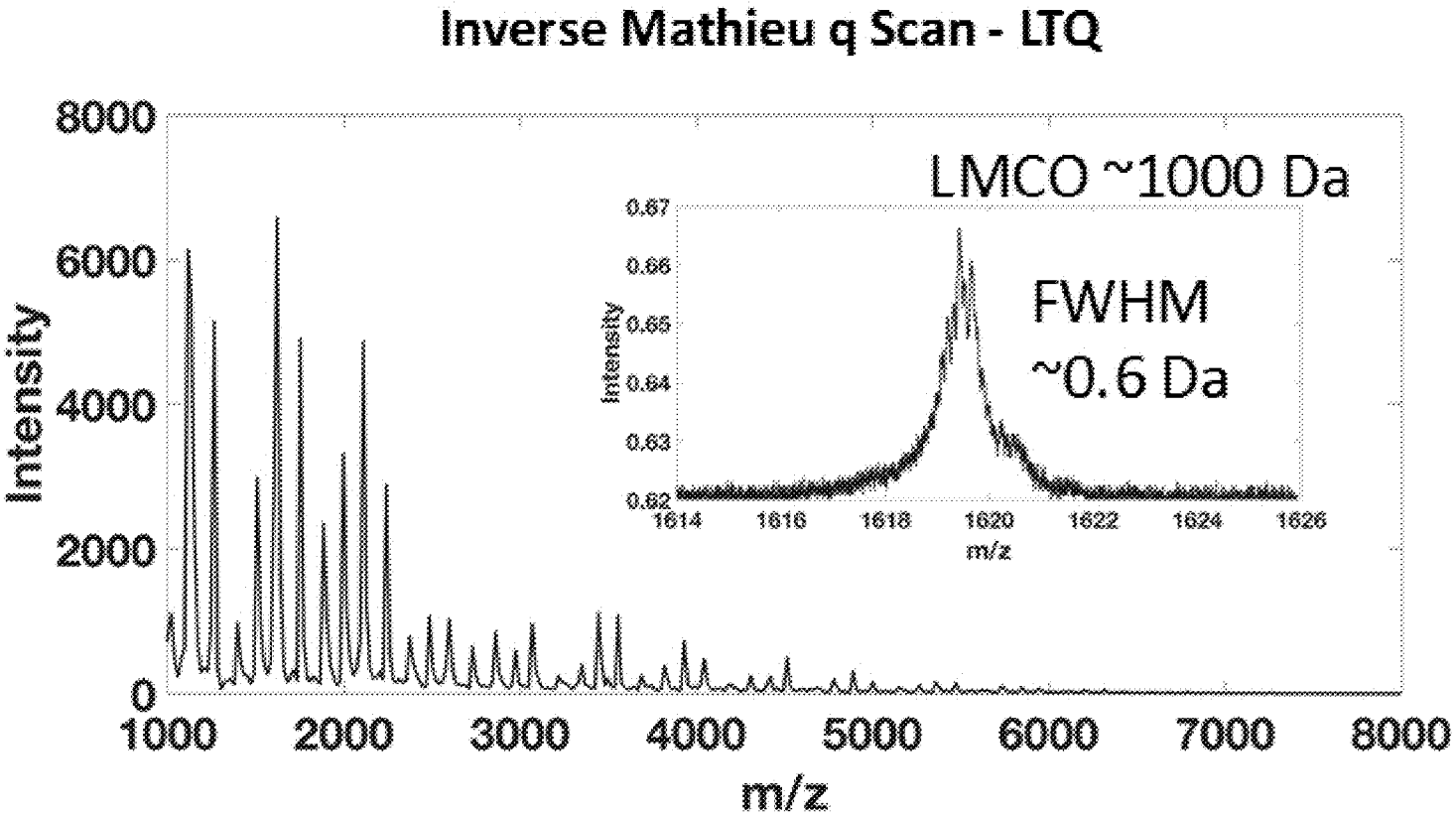
Figure 7E:
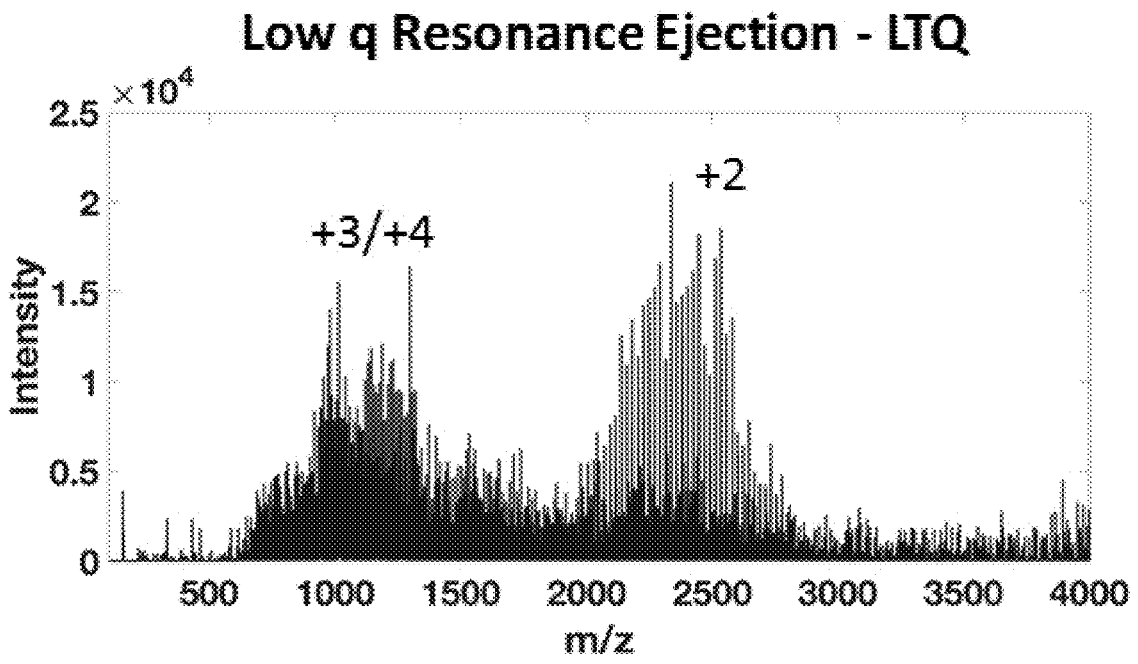

FIGS. 7C-D compare spectra of cesium tridecafluoroheptanoic acid (CsTFHA) clusters. While the mass range of the low q resonance ejection scan has a maximum mass of ~m/z 4,000, which is determined by the maximum rf amplitude, the inverse Mathieu q scan has a (theoretically) limitless range. In fact, mass range will be limited by other factors, particularly pressure and pseudopotential well depth. Clusters beyond m/z 7,000 were detected using this frequency scan. Despite the higher scan rate of 52,300 Da/s, the frequency scan results in nearly identical resolution to resonance ejection, which had the much more favorable slow scan rate of 2,500 Da/s. Note that the inset of FIG. 7D was observed using an oscilloscope. The apparent resolution of the full mass scan is much lower because the built-in data system of the LTQ significantly under-samples the data.

Figure 7F:
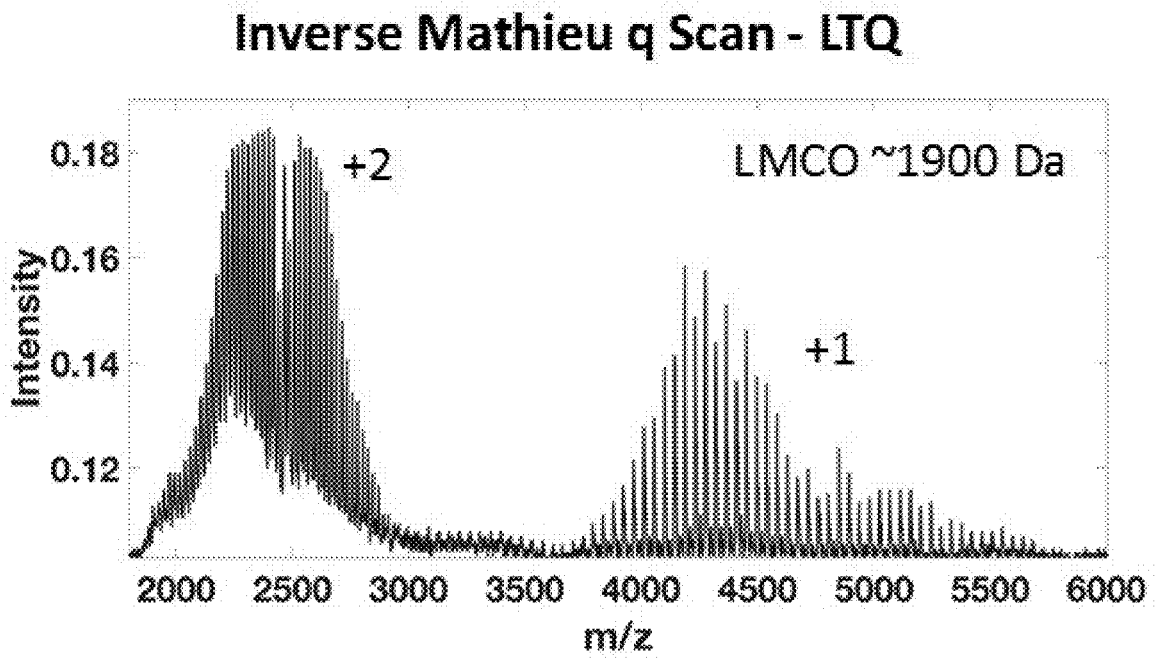
Figure 7G:
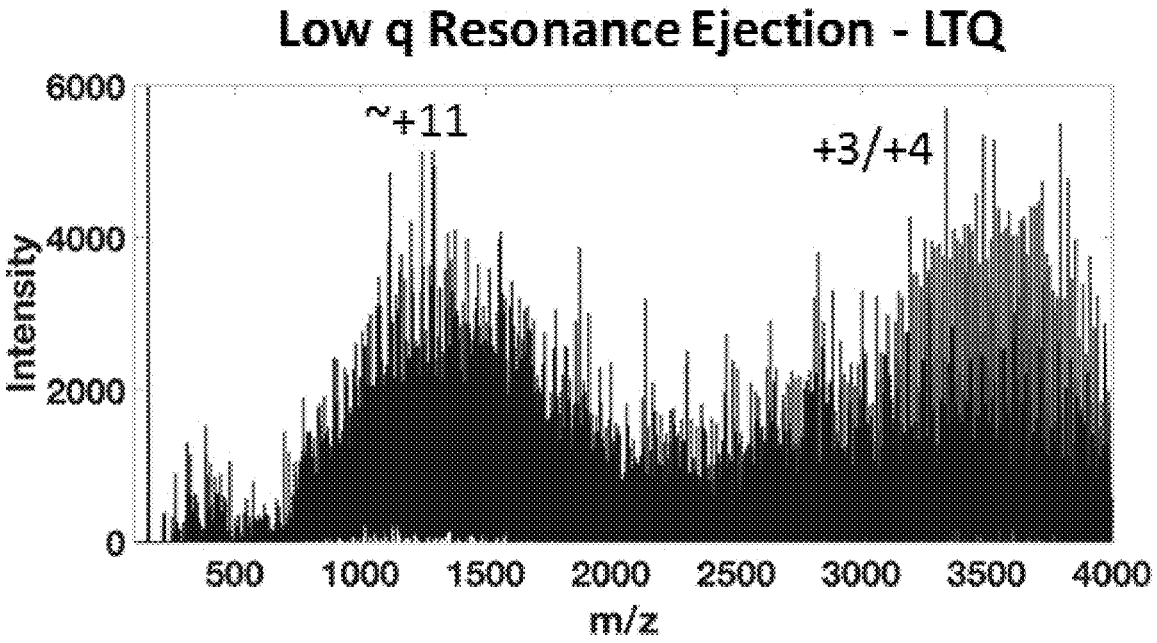
Figure 7H:
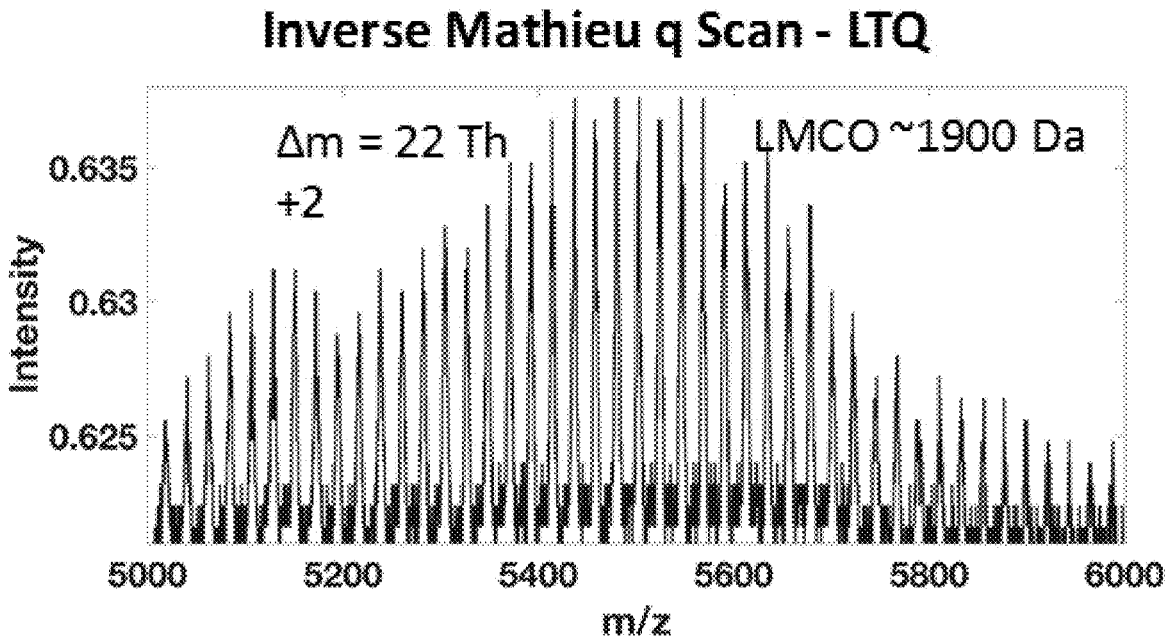

FIGS. 7E-H show mass range extension applied to polymer analysis. Polyethylene glycol 4400 (PEG4400, MW=4,400 Da) and PEG14000 (MW=14,000 Da) were analyzed by low q resonance ejection and the inverse Mathieu q scan. As above, the commercial low q mass scan has a maximum m/z of 4,000 Th and thus fails to detect the +1 charge state of PEG4400 and the +1/+2 charge states of PEG14000. However, we were able to detect these ions using the inverse Mathieu q scan without changing the rf frequency, ion optics, trap size, or pressure. In FIG. 7F the +1 charge state of PEG4400 is detected, though a relatively high LMCO is again required. The +2 charge state of PEG14000 is shown in FIG. 7H. These data were observed using an external oscilloscope with memory limited to 2,500 points (but variable sampling rate), so only a small mass range is observable.

Figure 8:
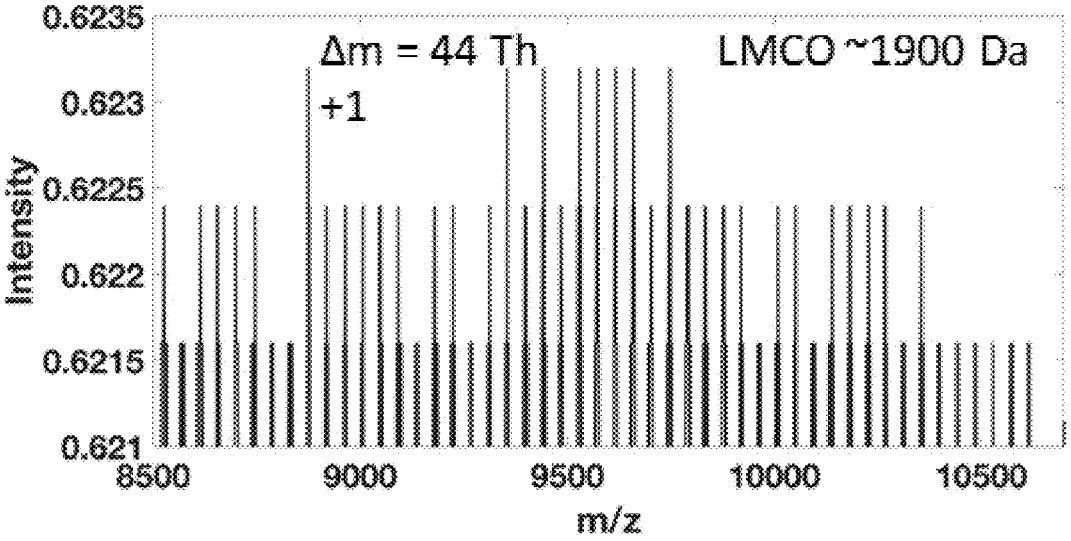
FIG. 8 shows LTQ mass spectrum of the +1 charge state of polyethylene glycol 14,000 (MW=14,000 Da) using the inverse Mathieu q scan, showing peak separations by 44 mass units and mass range extension to >m/z 10,500.

While the mass range of a resonance ejection frequency sweep (i.e. inverse Mathieu q scan) is limitless theoretically, there are practical limitations. We were able to observe ions with m/z>10,000 on the benchtop instrument, which is shown in FIG. 8. The +1 charge state of PEG14000 was observed, though the signal-to-noise is relatively low. This is a 5× improvement over conventional resonance ejection and a 2.5× improvement over the commercial low q resonance ejection scan. While the m/z values appear too low, the difference in m/z between the peaks is 44 Th, which does indicate the presence of the +1 charge state.

Summary of Comparison of Inverse Mathieu q Scans to Low q Resonance Ejection

Given that low q resonance ejection is perhaps the most comparable method to the inverse Mathieu q scan, comparisons should be made. These are summarized in Table 1, which shows calculated scan rates, theoretical low and high mass limits obtained from the experimental calibration of CsTFHA clusters, and resolution achieved for selected peaks using either resonance ejection at the given frequency or the inverse Mathieu q scan. This analysis was performed for data acquired using the commercial benchtop LTQ.

TABLE 1

Comparison of scan parameters and results for mass range extension by low q resonance ejection and inverse Mathieu q scan*

| Resonance Frequency (kHz) | $q_{eject}$ | Scan Rate (Th/s) | Low Mass (Th) | High Mass (Th) | Peak Width at m/z 1620 (FWHM) | Resolution at m/z 1620 (FWHM) |
|---|---|---|---|---|---|---|
| 490 | 0.88 | 16,700 | 50 | 2,000 | 0.7501 | 2159.712038 |
| 390 | 0.78 | 18,600 | 57 | 2,240 | 1.12 | 1446.428571 |
| 290 | 0.63 | 23,100 | 72 | 2,775 | 1.55 | 1045.16129 |
| 190 | 0.44 | 33,290 | 110 | 4,000 | 1.34 | 1208.955224 |
| 90 | 0.21 | 112,000 | 254* | 13,000 | 3.5 | 462.8571429 |
| Inverse Mathieu q Scan† | Variable | 52,300 | 900 | 16,600 | 0.63 | 2571.428571 |

*The analysis performed on a benchtop LTQ linear ion trap and the analytes were CsTFHA clusters.
†See inset in FIG. 7.

For the same rf voltage ramp, scan rate will increase when the resonance ejection q value (frequency) is lowered, which is in agreement with the Mathieu equations. Loss of low mass ions is modest because there is only a small fraction of the ion population with high q values. The increase in scan rate and selection of non-optimal values for ejection q results in resolution degradation. However, although the inverse Mathieu q scan loses ions at the low mass end of the spectrum, the mass range is extended without loss of resolution. Nearly unit resolution is obtained (FIG. 7C, inset) despite the high scan rate and large mass range.

The case for the inverse Mathieu q scan is made even clearer by considering other factors. No linear rf ramp is needed in this scan, which is particularly appealing for miniature instruments since rf correction is often troublesome and requires specialized circuitry. In addition, the potential for discharges is mitigated, and, unlike resonance ejection at low q, there are no interferences from boundary ejection. Also, unlike other frequency scan methods, resolution is maintained at high mass since the rf frequency is constant, and mass calibration is linear. Since many instruments already have software and electronics for complex waveform calculation and synthesis (e.g. the stored waveform inverse Fourier transform, which is implemented on the Mini 12), the inverse Mathieu q scan merely requires software implementation rather than hardware changes.

Mass Range Extension Using a Miniature Mass Spectrometer

In the conventional resonance ejection mode at a Mathieu q value of ~0.81, the mass range of the Mini 12 mass spectrometer is limited to <m/z 1,000. However, it has been shown that extension of this range to m/z 1,300 is achievable by lowering the rf frequency on the Mini 11, which uses similar electronics.

The inverse Mathieu q scan was easy to translate to the Mini 12. The rf frequency on the Mini 12 is 999 kHz, which is lower than the LTQ's 1.175 MHz, and the pressure in the trap is substantially higher during ion injection, so high mass ions ought to be easier to trap. The only instrumental parameter that was altered was the rf amplitude during ion injection, which was increased by ~30% in order to successfully trap ions of high m/z. The custom inverse Mathieu q frequency sweep was triggered on the Mini 12 by outputting a high frequency (kHz) AC signal from the Mini 12 AC/waveform board to an external function generator, and a scan time of 0.3 s was used, the same as that applied to the LTQ (although the duty cycle on the Mini 12 was much reduced because of the need to close the DAPI value to achieve requisite vacuum for mass analysis).

FIGS. 9A-D shows the results of the inverse Mathieu q scan on the Mini 12 for the same analytes as shown in FIG. 7A is the mass spectrum of bovine serum albumin. Resolution is degraded by the higher order fields, increased space charge effects, and the pressure in the trap, but charge states are resolved. Mass range extension up to >m/z 2,000 was observed. Note that the ions around m/z 600 were also observed on the LTQ, but were not shown in that figure. The charge states appear to be substantially lower on the Mini 12, a feature which will be discussed later.

Figure 9A:
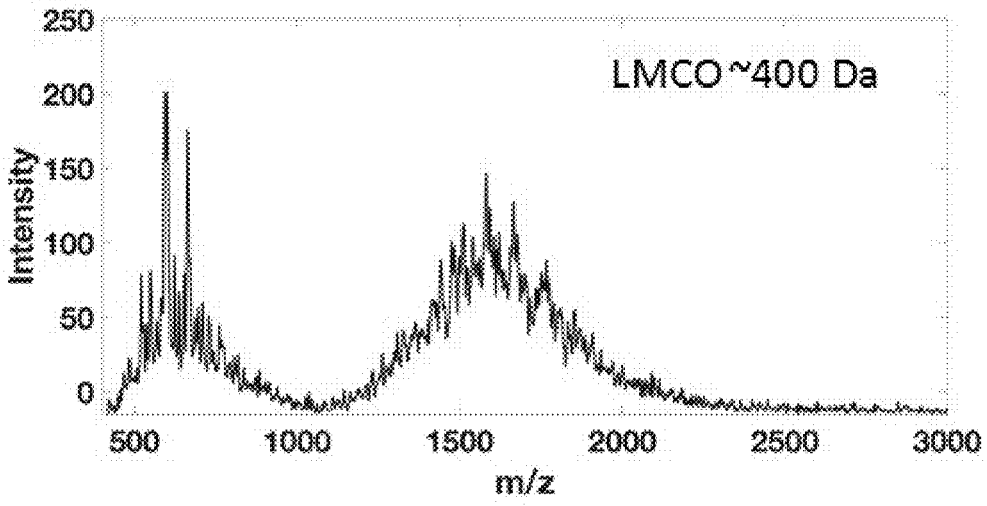
FIGS. 9A-D show mass range extension on the Mini 12 miniature mass spectrometer using the inverse Mathieu q scan. Mass spectra of (FIG. 9A) bovine serum albumin, (FIG. 9B) cesium tridecafluoroheptanoic acid clusters, (FIG. 9C) polyethylene glycol 4400, and (FIG. 9D) polyethylene glycol 14000. The scan rate in (FIG. 9A)/(FIG. 9B) and (FIG. 9C)/(FIG. 9D) was 21,600 Da/s and 24,500 Da/s, respectively.
Figure 9B:
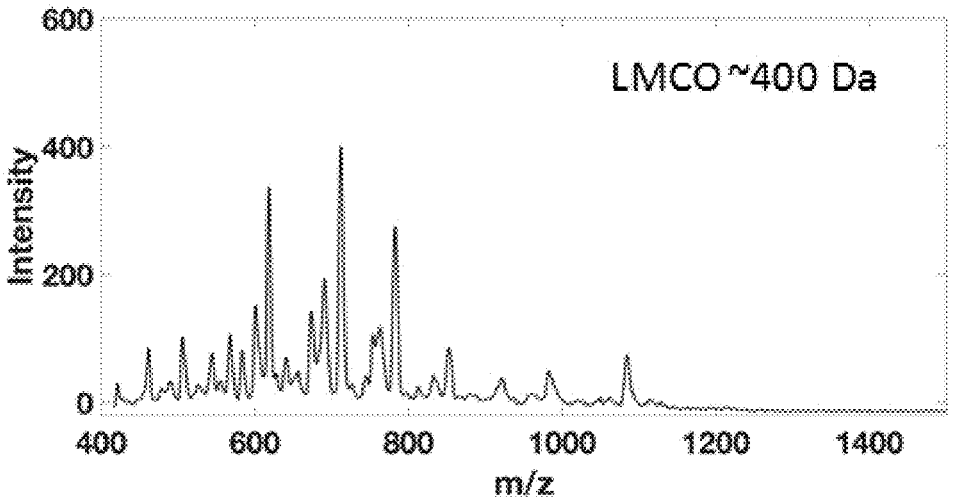

FIG. 9B is the mass spectrum of CsTFHA clusters. For this experiment, the ion transfer capillary (at atmospheric pressure) was heated by wrapping it with heating tape in order to increase the desolvation of these clusters. However, the highest m/z observed was m/z 1,100, which represents only a modest increase in mass range. This is likely due to the ion source conditions in the Mini 12, not the mass scan.

Figure 9C:
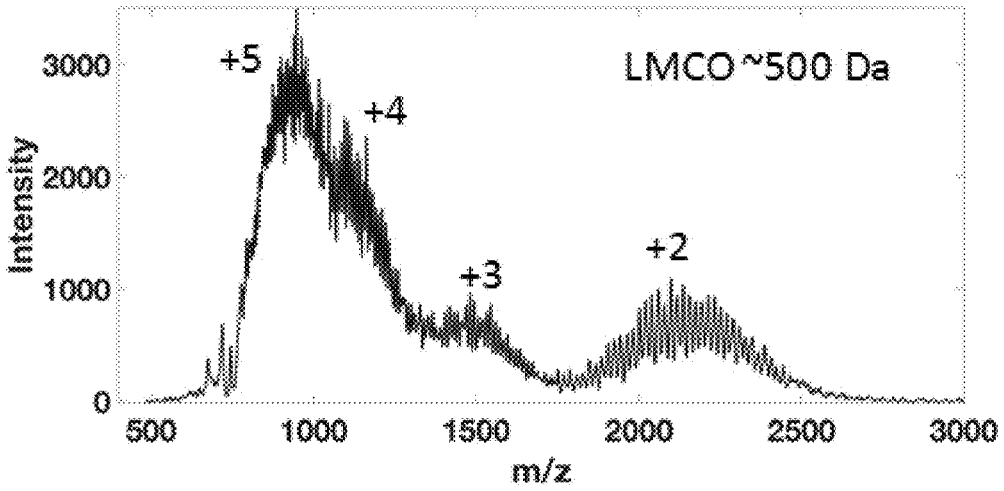
Figure 9D:
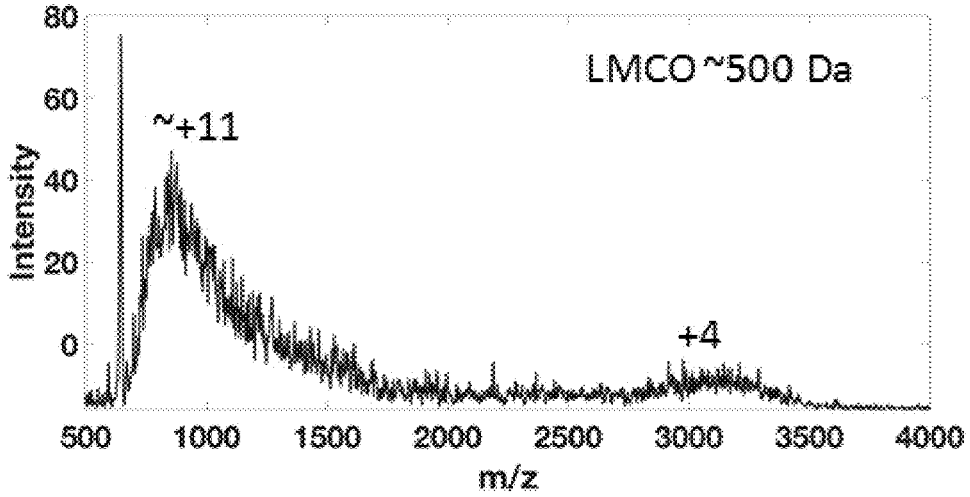

The analysis of polymers PEG4400 and PEG14000 in FIGS. 9C-D, respectively, was more successful. Scan rates were 21,600 Da/s and 24,500 Da/s, respectively (compared to the conventional resonance ejection scan rate of 3,000 Da/s). In the case of PEG4400, charge states +2 through +5 were detected, although peaks were not necessarily resolved. The highest observed m/z was approximately ~2,500 Th in this scan. For PEG14000, both the +11 and +4 charge states were detected for a maximum detected m/z of 3,500 Th, an extension of 3.5× over conventional resonance ejection.

Comparison Between LTQ and Mini 12

There are several differences observed in the spectra when comparing LTQ data (FIG. 7A-H) to Mini 12 data (FIG. 8). For one, unit resolution is not obtained from the Mini 12, which is expected due to the imperfections in trap geometry, pressure, high scan rate, and increased space charge effects in a miniature trap. The LMCO on the Mini 12 was, in general, lower because of its lower rf frequency (0.999 MHz compared to the LTQ's 1.175 MHz). The same mass range could be achieved with a lower rf amplitude because of this. However, other differences, namely in vacuum and source conditions, result in more nuanced differences in performance.

Regarding differences in vacuum conditions, the LTQ uses differential pumping to transfer ions from atmospheric pressure (760 torr) to ~1 torr in the transfer optics just beyond the source and finally to ~mtorr or less in the ion trap itself. This process would be expected to be much gentler than the corresponding journey on the Mini 12, where ions go from 760 torr to ~mtorr or lower pressures over a very short distance (the length of the inlet capillaries). This harsher transfer will tend to cause fragmentation and to unfold proteins and polymers, resulting in higher charge states, which is evident when comparing FIG. 9A to FIG. 7A. We also analyzed the peptides renin substrate tetradecapeptide (angiotensinogen 1-14), neurotensin, insulin-like growth factor fragment 3-40, and human ghrelin and observed higher charge states.

The second major difference between the benchtop and miniature instrument is found in the ion source. Nanoelectrospray ionization was used in both cases, but the ion transfer capillary on the LTQ is heated, whereas it is not on the Mini 12. There is also no curtain gas, sheath gas, or skimmer/tube lens system on the Mini 12, so desolvation will be inherently less efficient than on the LTQ, resulting in lower sensitivity and more difficulty in generating dry clusters (FIG. 9B). Regardless, the improvement in mass range here was approximately 3.5× when compared to conventional resonance ejection at high q.

Conclusion

This Example demonstrates mass range extension using the inverse Mathieu q scan in both a benchtop and a miniature mass spectrometer. This required no instrumental modifications—only implementation in software for systems that already synthesize complex injection/isolation/CID waveforms—and it maintained linear mass calibration. The method is shown to increase the mass range of a benchtop mass spectrometer by almost 2.5× and increase the mass range of a miniature instrument by 3.5× over conventional and low q resonance ejection without altering the rf frequency or trap size. Despite the high scan rate and unconventional method, unit resolution was achieved on the LTQ and was only limited on the Mini mass spectrometer by the method of data acquisition.

Example 3: AC Frequency Scan Ion Trap Mass Spectrometer

Figure 10:
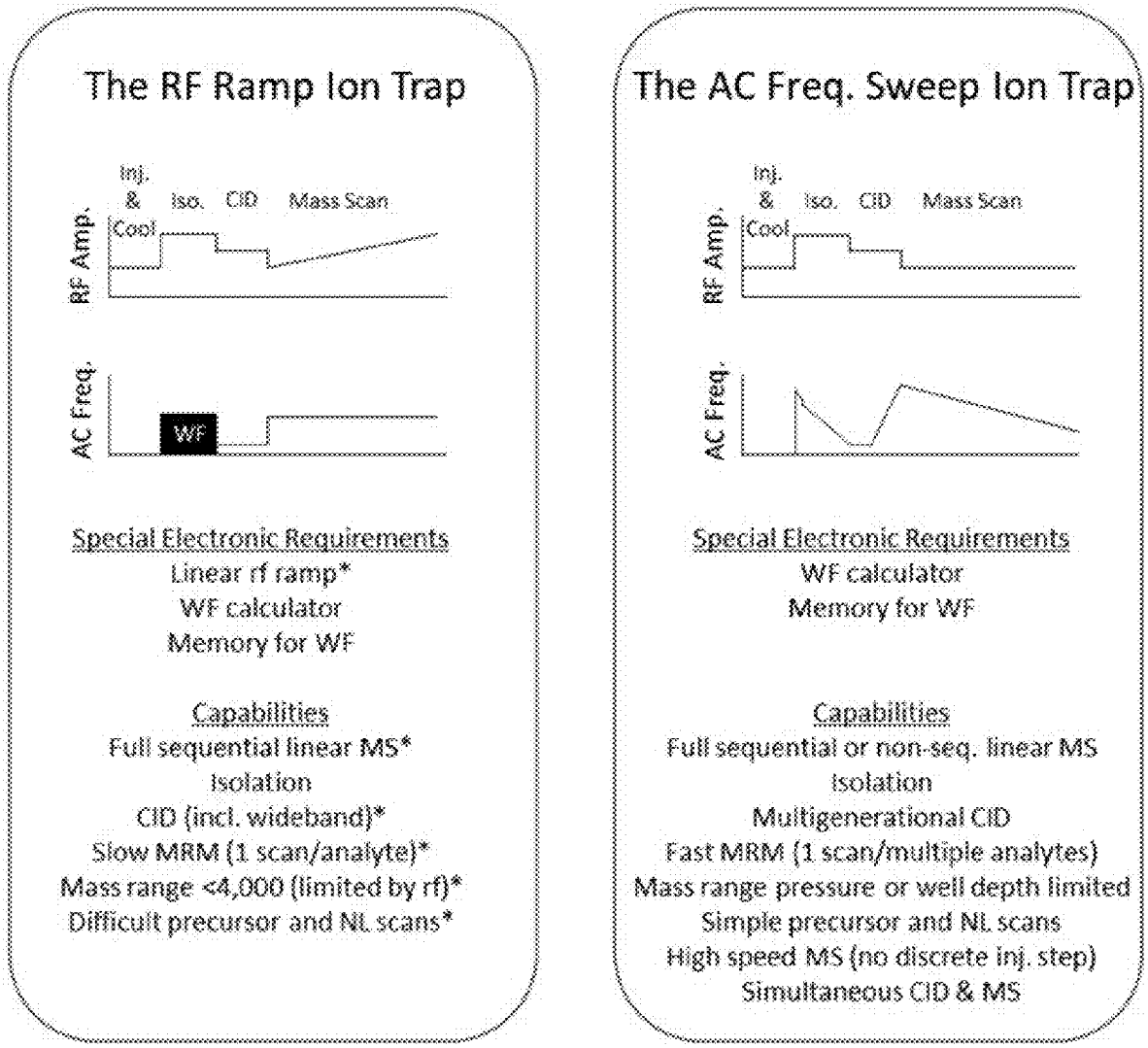
FIG. 10 shows comparison of a conventionally operated ion trap mass spectrometer ('rf ramp') with the proposed AC frequency sweep mass spectrometer. Capabilities highlighted with * in left panel indicate items whose performance is expected to be improved or where instrument simplification is expected in the AC frequency sweep instrument.

The quadrupole ion trap mass spectrometer has traditionally been operated as shown in in FIG. 10 using an "rf ramp". This Example envisions a new kind of ion trap that uses nonlinear AC waveforms for all mass-selective operations, including and especially the mass scan. The notable difference in FIG. 10 is the constant rf amplitude and variable AC frequency during the mass scan step. As shown herein, if the AC frequency is scanned nonlinearly such that there is an inverse relationship between the m/z of the ion being ejected and time, then a linear mass spectrum is obtained, giving the same calibration procedure as the rf ramp method. This kind of scan has been termed the "inverse Mathieu q scan".

Because the AC frequency is scanned and the rf frequency is constant, performance improvements are expected, new capabilities ought to be available, and the instrument is also expected to be simplified.

Implementing a Simple Precursor Scans in a Single Ion Trap Using Orthogonal Excitation and Ejection of Precursor and Product Ions, Respectively The precursor ion and neutral loss scans are general survey methods for determining classes of molecules with similar functional groups. Typically these scans are performed on large multi-analyzer or hybrid systems (e.g. Q-ToFs or triple quadrupoles) which require complex electronic schemes as well as better vacuum systems compared to single ion trap instruments. This Example shows that both scans can be performed quite simply using the AC frequency sweep ion trap.

In prior art methods, a low amplitude frequency sweep at constant rf amplitude is used for mass selective excitation of precursor ions while a second AC frequency with a higher amplitude is fixed on a particular product ion m/z. While this method enables single analyzer precursor scans in an ion trap, there are several limitations: 1) when the excitation and ejection frequencies are applied to the same pair of electrodes, a beat frequency develops which will tend to eject ions even if they are not on resonance with the applied frequencies (resulting in ghost peaks), and 2) additional ghost peaks are observed because excited ions can accidentally be ejected toward the detector and any fragment ions below the low-mass cutoff will also be ejected toward the detector.

Figure 11:
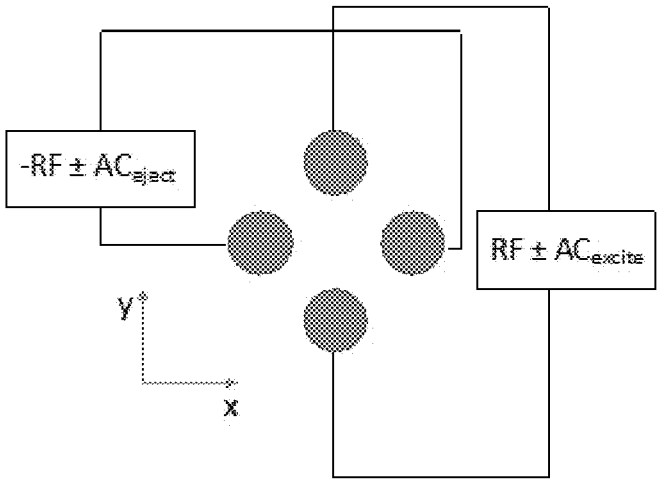
FIG. 11 shows precursor and neutral loss scans in a single ion trap using orthogonal excitation and ejection AC waveforms. During these scans, the rf amplitude is kept constant. In previous demonstrations of these scans, both AC waveforms were applied to the same pair of electrodes.

This Example implements the precursor and neutral loss scans in a single ion trap using orthogonal excitation and ejection schemes (FIG. 11). That is, the same waveforms as the previous method will be used, but the excitation will be applied in Y, where there is no detector, while the ejection waveform is applied in X, the direction in which ions are detected. Because only ions ejected out the X electrodes (in an LTQ ion trap) are detected, no ghost peaks should be observed. Furthermore, no beat frequencies will result from the combination of the two frequencies because the waveforms are applied orthogonally.

The neutral loss scan is a similar experiment. In this case, both the excitation frequency and the ejection frequency are scanned with a constant m/z offset between the two. This can be accomplished by calibrating two simultaneous inverse Mathieu q scans, one for excitation and one for ejection. Furthermore, the inverse Mathieu q scan can also be used for excitation in the precursor scans in order to give linear mass calibration which is otherwise unavailable when sweeping the resonance excitation frequency nonlinearly.

Implement Arbitrary Mass Scanning Using the Inverse Mathieu q Scan

One of the disadvantages of the rf ramp technique for mass spectral acquisition is that the mass spectrum is necessarily obtained in order of m/z, either increasing or decreasing. That is, the "middle" of the mass spectrum cannot be acquired using resonance ejection without dumping the lower or upper half of the ions first; otherwise interferences from boundary ejection are observed.

For example, if we desired to obtain a mass spectrum from m/z 100 to 2,000 using the resonance ejection mode we would have to start at m/z 100 and end at m/z 2,000 or vice-versa. If the middle of the mass spectrum was desired first, then either the low or high mass ions must be dumped from the trap in order to scan out the ions in the middle.

However, when performing a sweep of the auxiliary resonance ejection frequency at constant rf amplitude and frequency, the entire ion population remains stable (except for those ions whose characteristic oscillation frequencies match the ac frequency) because the rf amplitude, and thus the low- and high-mass cutoffs, remains constant. Thus, the mass spectrum can be obtained in any arbitrary direction (forward or reverse), and more importantly any part of the mass spectrum can be obtained while retaining the rest of the ion population in the trap for further manipulations (be they fragmentation, isolation, or further mass scanning).

This is a unique capability of AC frequency scanning that is unavailable to all other scan methods, including digital ion trap scan methods.

Implementing High-Speed Multiple Reaction Monitoring Using AC Frequency Scanning The current generation of LTQ instruments perform very slow selected ion monitoring scans (monitoring one m/z per ion injection). Essentially, an ion packet is injected and a single m/z is isolated and then scanned out using an rf ramp. While high resolution is available in this mode due to reduction of space charge effects and the ability to slowly ramp the rf amplitude, this Example envision an alternative fast multiple ion monitoring method using AC frequency scanning.

Figure 12A:
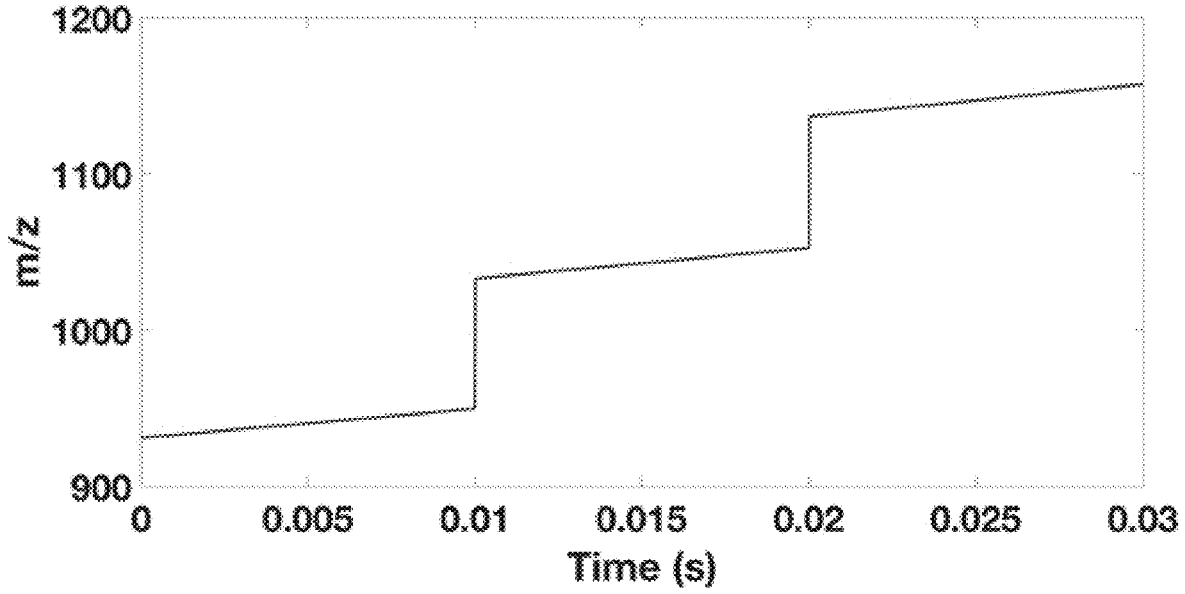
FIGS. 12A-B show a proposed method of fast multiple ion monitoring in an ion trap.
Figure 12B:
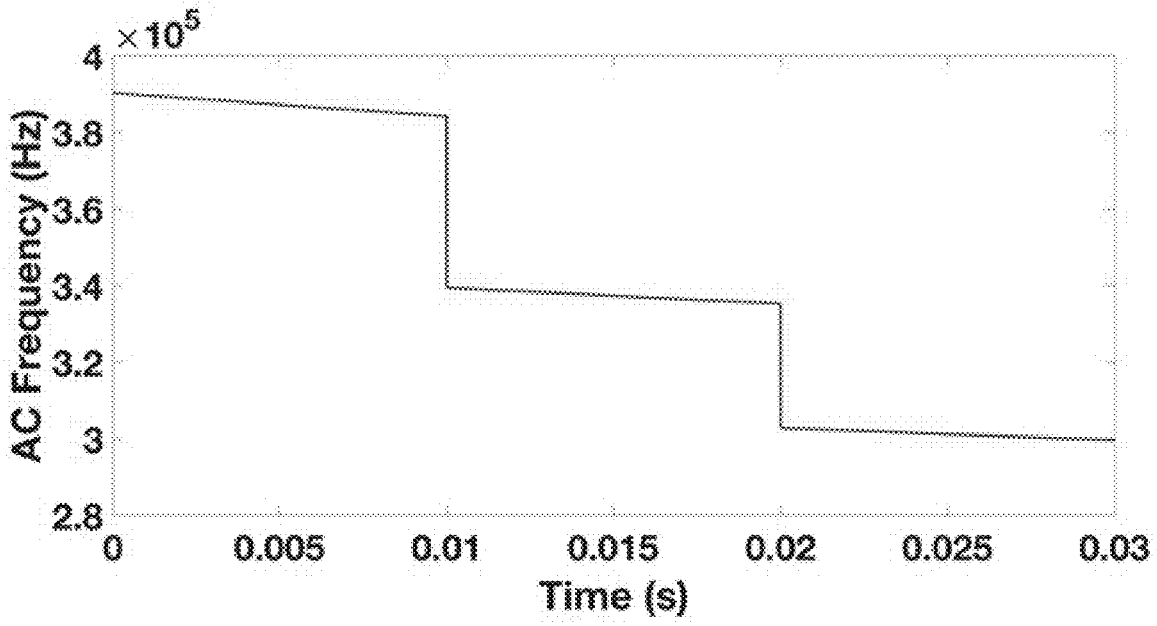

In the proposed method (FIGS. 12A-B), the ions would be injected to the trap, and, if necessary, an isolation step can isolate several different m/z ranges. In this mode of operation, unit isolation width would not be desired and likely is not possible because this typically requires rf ramp capabilities. Instead, after the optional isolation step, the rf amplitude would be held constant while an inverse Mathieu q scan skips between m/z ranges (FIG. 12A). For example, in FIG. 12A an inverse Mathieu q scan is used to obtain bits and pieces of the mass spectrum, that is, the pieces of interest. In this case, the ions to be monitored are Ultramark 1621 ions at m/z 922, 1022, and 1122. In the rf ramp method, such a scan would require large jumps in rf amplitude (e.g. at t=0.01 s), which tend to destabilize ions. In our scan method, the frequency of the AC is scanned instead, as in FIG. 12B. Because the frequency scan is actually a scan of the phase of the AC waveform, phase continuity is maintained and frequency "hops" (that is, large jumps in frequency) do not disturb the continuity of the waveform. Because the rf no longer controls the mass scan and also because multiple ions can be monitored per single ion injected (with some loss in isolation width), we propose that high-speed multiple ion monitoring is possible using AC frequency sweeps.

A natural extension of multiple ion monitoring is multiple reaction monitoring (MRM), which can be similarly accomplished. First several ions of interest would be isolated using an AC frequency sweep or similar waveform method (e.g. SWIFT), and then each of those ions would be dissociated by either sequentially or simultaneously applying a resonance frequency (or frequencies) corresponding to their precursor ion secular frequency. Note that the rf amplitude will play a critical role in this dissociation step because the precursor ion Mathieu q value will determine the success of fragmentation and product ion capture. A variable rf amplitude during the CID step may be necessary if the precursor ions fall over a wide range of q values. After fragmentation, the selected product ions would then be scanned out using the method in FIGS. 12A-B. Because only small portions of the mass spectrum are obtained (e.g. FIG. 12A), the duty cycle of the MRM method should be compatible with chromatographic techniques.

Implementing High-Speed AC Frequency Scanning on a Linear Ion Trap

It has recently been reported that the digital ion trap can perform high-speed frequency scanning by ridding the scan function of discrete ion injection, collisional cooling, and mass scan steps and instead combining all of these into one step. The method sweeps the frequency of the trapping waveform continuously while ions are continuously injected. This example proposes to do a similar experiment in which the trapping (rf) parameters are held constant while the AC frequency is used for mass scanning. Because the low-mass cutoff remains constant during the AC frequency scan, it ought to be possible to integrate injection, cooling, and mass scan steps into a single step, thereby increasing the duty cycle of the ion trap.

Example 4: Ion Isolation and Multigenerational Collision-Induced Dissociation Using the Inverse Mathieu q Scan This Example shows using the inverse Mathieu q scan for ion isolation, ion activation, and ion ejection. Ion isolation is accomplished by frequency hopping, that is, by skipping past the ranges of frequencies corresponding to the ions to be isolated during the frequency sweep. Multigenerational collision-induced dissociation is demonstrated by scanning the frequency of excitation from low to high so that multiple generations of fragment ions can be observed in the product ion mass spectra. Because the excitation frequency is scanned quickly across a large range, fragmentation of some precursor ions can be too limited. However, by first fixing the excitation frequency on the precursor ion and then scanning the frequency using the inverse Mathieu q scan, a higher abundance of product ions can be obtained.

Isolation of a single mass-to-charge (m/z) as well as nonadjacent m/z ions is demonstrated with isolation efficiency greater than 70%. Fragmentation of caffeine and noroxycodone is demonstrated, the latter of which shows multiple generations of product ions. The results demonstrated here provide strong evidence that an ion trap mass spectrometer can be operated under constant radiofrequency conditions, and AC frequency scanning can be used for all mass selective operations.

This Example shows development of an ion trap mass spectrometer based completely on AC waveforms for ion isolation, ion excitation, and ion ejection. In particular, the precise linear rf voltage ramp that is required for the mass scan and some isolation methods is undesirable because of the higher power consumption and the additional electronics needed to ensure rf ramp linearity in the mass scan. Similarly, scans of the rf frequency, which is typically near 1,000 kHz, are more difficult to implement than AC frequency scans and are inherently nonlinear with m/z, complicating mass calibration. Low amplitude AC signals are much more readily implemented and controlled (particularly the ac frequency) and hence are particularly advantageous for space-based and other portable and miniature instruments. This consideration has led us to develop methods of secular frequency scanning for ion trap mass spectrometers. In the secular frequency scan, the rf amplitude and frequency are held constant while the frequency of a small amplitude supplementary resonance ejection signal is ramped through ion secular frequencies. If the frequency scan is linear with time, then a nonlinear mass spectrum is obtained, which must be calibrated to obtain the linear mass spectrum. A further important advantage of the secular frequency scan is that it allows for single analyzer precursor scans to be performed in ion traps, furthering the capabilities of these already advantageous devices.

Further work on the frequency scan has resulted in a nonlinear AC frequency sweep called the "inverse Mathieu q scan". With this method, the AC frequency is swept nonlinearly such that the Mathieu q parameter of the ion being ejected varies inversely with time. Because mass-to-charge and Mathieu q are inversely related $$m/z=4V_{0\text{-}p}/q\Omega^2 r_0^2 \qquad \text{Eq. 1}$$

where $V_{0\text{-}p}$ is the zero-to-peak rf amplitude (volts), $\Omega$ is the angular rf frequency (radians/second), and $r_0$ is the half distance between the quadrupole rods (meters), the relationship between m/z and time is linear. As a result, the calibration procedure for the inverse Mathieu q scan is the same as boundary and resonance ejection; a linear fit between time and m/z is all that is required.

The ability to obtain linear mass spectra using an AC frequency sweep has overcome the biggest hurdle to developing an AC-based mass spectrometer. However, it is additionally desirable to be able to use the same method for both ion isolation and ion activation in order to keep the instrument as operationally simple as possible. In this Example, we add to the demonstrated use of AC scans for ion ejection the demonstration that ion isolation and multi-generational collision-induced dissociation in an ion trap can be performed using AC scans in the inverse Mathieu q scan mode.

Materials and Methods

Ionization: Nanoelectrospray ionization using a 1.5 kV potential was used to generate ions from a borosilicate glass capillary with a ~5 um tip diameter (1.5 mm O.D., 0.86 mm I.D., Sutter Instrument Co.). The capillaries were pulled to a point using a Flaming/Brown micropipette puller from Sutter Instrument Co. (model P-97, Novato, Calif., USA).

Chemicals: Pierce ESI LTQ calibration solution containing caffeine (m/z 195), the peptide MRFA (m/z 524), and Ultramark 1621 was purchased from Thermo Fisher Scientific (Rockford, Ill., USA). A typical mass spectrum of this solution can be found on the manufacturer's website (currently, https://www.thermofisher.com/order/catalog/product/88322). Noroxycodone was purchased from Cerilliant (Round Rock, Tex., USA) and was dissolved in methanol at a concentration of 10 μg/mL.

Instrumentation: Experiments were performed using a Thermo LTQ Orbitrap XL mass spectrometer (San Jose, Calif., USA). The "normal" scan rate of 16,666 Da/s was used for boundary ejection with the rf frequency tuned to 1,175 kHz. The isolation and activation waveforms were replaced with waveforms generated by a Keysight 33612A arbitrary waveform generator (Newark, S.C., USA). The waveforms were triggered at the beginning of the isolation period (~13 ms in length followed by a ~30 ms activation period) using the triggers in the "Diagnostics" menu in the LTQ Tune software.

Isolation and activation waveforms were calculated in Matlab using a custom program similar to the one previously described (Snyder, D. T., Pulliam, C. J., Cooks, R. G.: Linear mass scans in quadrupole ion traps using the inverse Mathieu q scan. Rapid Commun. Mass Spectrom.). The isolation waveform (FIGS. 13A-B) was an inverse Mathieu q scan with a user-defined isolation q value ($q_{iso}$) and isolation width (Δq), both defined in terms of Mathieu q space (these values are easily converted to the frequency domain). The program begins with an array of Mathieu q values (FIG. 13A), with a user-defined start and end q value (typically 0.908 and 0.05, respectively, for isolation). The program then removes q values that satisfy the relationship $q_{iso}-\Delta q/2<q<q_{iso}+\Delta q/2$ to give a smaller array of q values, which are then converted to β parameters using a function beta_calculator (Snyder, D. T., Pulliam, C. J., Cooks, R. G.: Calibration procedure for secular frequency scanning in an ion trap. Rapid Commun. Mass Spectrom. 30, 1190-1196 (2016)). The β values are then converted to frequencies and subsequently given phases, as described previously (Snyder, D. T., Pulliam, C. J., Cooks, R. G.: Linear mass scans in quadrupole ion traps using the inverse Mathieu q scan. Rapid Commun. Mass Spectrom.). The resulting waveform was exported from Matlab as a .csv file (column vector) and imported to the arbitrary waveform generator, set on channel 1 to a sampling rate of 10 MSa/sec. The frequency sweep excites ions over a broad range of m/z values, and if the amplitude and time of application are sufficient, the ions will be ejected from the trap. Because some q values are taken out of the frequency scan, a "notch" or frequency hop is created in a similar manner to stored waveform inverse Fourier transform notches. In the case of the frequency scan, a "jump" is observed in the waveform (FIG. 13B, inset), and the width of the jump (in frequency units or Mathieu q units) is determined by Δq. Because the waveform sweeps through the phase of the sinusoid instead of frequency, phase continuity is maintained regardless of any frequency jumps and thus no discontinuities are observed in the waveform. Multiple frequency hops may be incorporated by specifying additional $q_{iso}$ and Δq values.

Ion activation was performed after ion isolation, again using the inverse Mathieu q scan. The activation waveform was set on channel 2 of the function generator and was also triggered on the isolation event but was set to delay the activation signal for ~13 ms, the duration of isolation. The ion to be isolated was set at a Mathieu $q_z$ value of 0.83, after which point it was placed at $q_z$=0.3 for activation. For activation, the frequency of the ac waveform was swept so that the first $q_z$ value interrogated was 0.15 and the last value was 0.908. That is, the frequency was swept nonlinearly from low to high frequency (high to low m/z), the opposite direction of the isolation scan. Unlike isolation, the activation waveform did not skip q values. The amplitude of the excitation was typically a constant 200 $mV_{pp}$, whereas the amplitude of the isolation waveform was constant in the range ~2-6 $V_{pp}$, depending on the m/z of the ion to be isolated.

After ion isolation and/or excitation, ions were detected by boundary ejection using an analytical rf amplitude ramp. For isolation efficiency calculations, the peak area of the isolated ion before and after isolation was compared.

Results and Discussion

The development of a miniature mass spectrometer using AC frequency sweeps for all mass-selective operations necessitates the investigation of a set of simple, effective, and efficient isolation, activation, and mass scan techniques. The mass scan has recently been explored in the form of the inverse Mathieu q scan, in which the frequency of the AC is swept nonlinearly so that a linear relationship between the m/z of the ion to be ejected and time is obtained. The inverse Mathieu q scan can further be used for both isolation and ion activation, and the same program can be used to generate all frequency swept waveforms, as described in this Example.

Figure 13A:
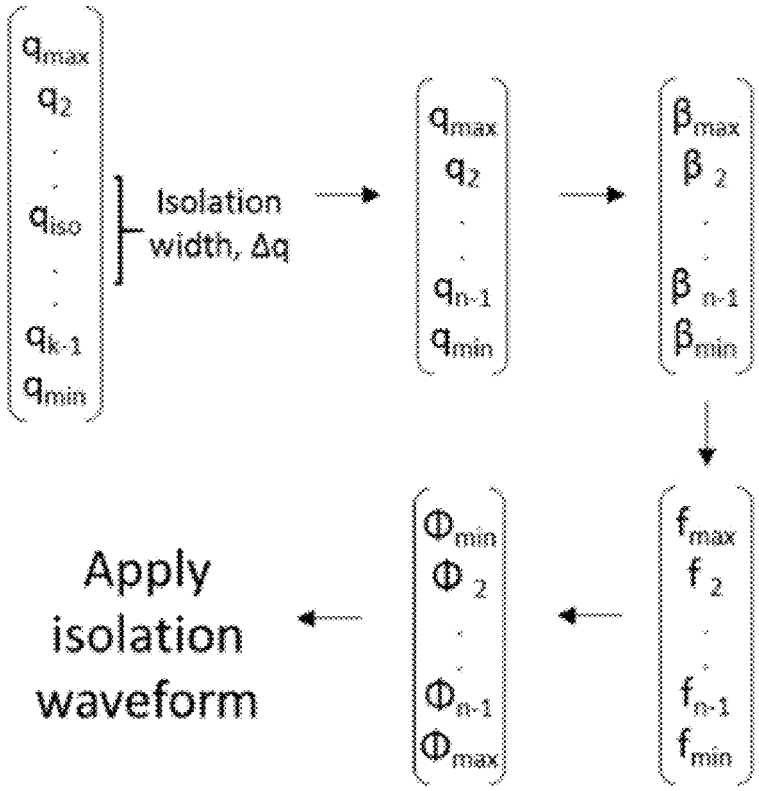
FIGS. 13A-B shows the waveform calculation for ion isolation in a quadrupole ion trap using the inverse Mathieu q scan.
Figure 13B:
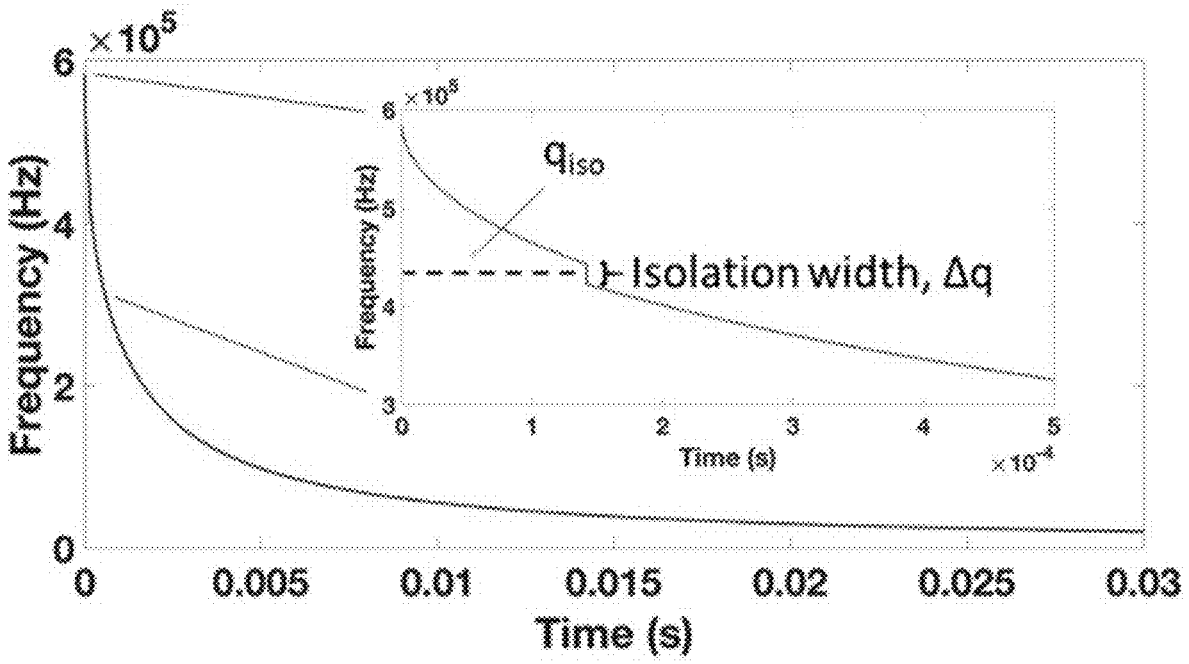
Figure 14:
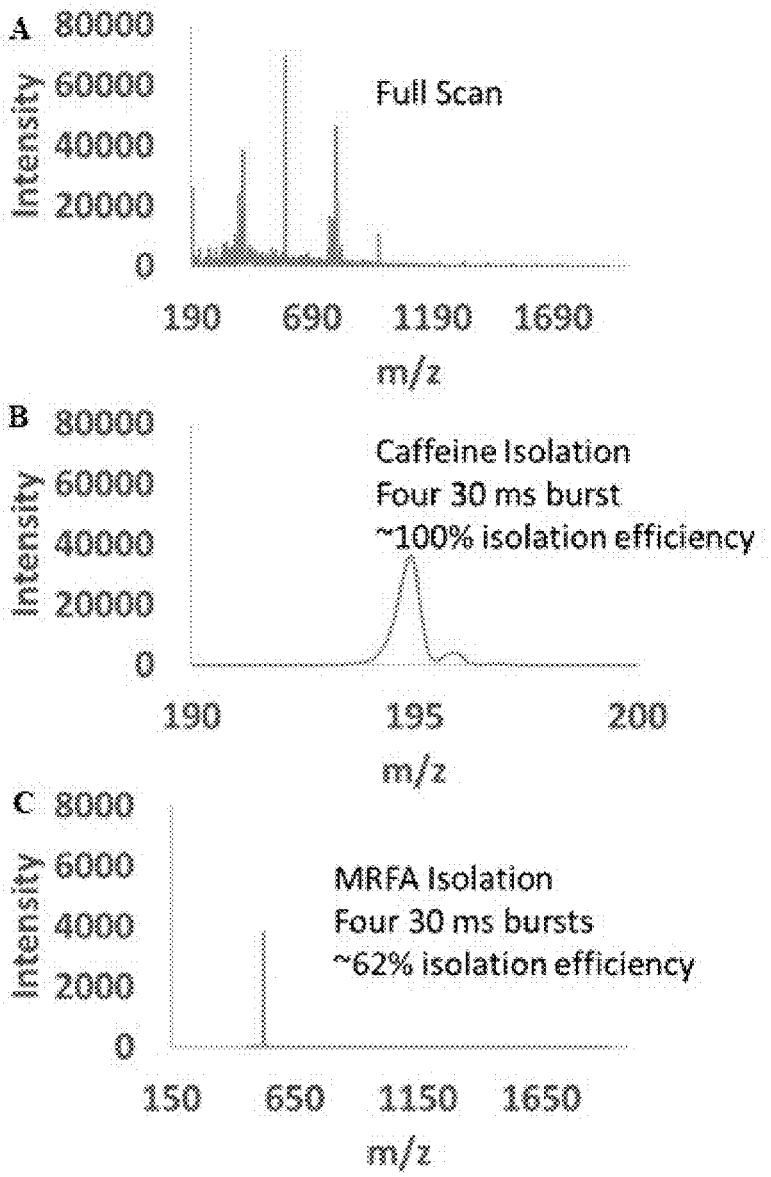
FIG. 14 panels A-C show ion isolation in a linear ion trap using the inverse Mathieu q scan. Panel (A) shows the full scan boundary ejection mass spectrum of a mixture of caffeine (m/z 195), MRFA (m/z 524), and Ultramark 1621 ions. In (B) caffeine is isolated with ~100% efficiency using four consecutive bursts of an inverse Mathieu q scan from 0.908 to 0.05, where each burst was 30 ms in length and 1.3 $V_{pp}$. In (C) the peptide MRFA is isolated using the same method with a 3.6 $V_{pp}$ isolation waveform.

Using the procedure in FIG. 13A and the waveform in FIG. 13B, we were able to isolate caffeine from an LTQ calibration mixture (caffeine, MRFA, and Ultramark 1621) with high efficiency (~100%) and an apparent isolation width of ~2-3 Da (FIG. 14 panel B). The full scan is shown in FIG. 14 panel A for comparison. The peptide MRFA (m/z 524) could also be isolated with ~62% efficiency (FIG. 14 panel C), despite its low intensity relative to other peaks in the spectrum. Note that the scale in panel C has been magnified by a factor of 10.

In these investigations, several variables were altered, including the $q_{iso}$ value at which the ion was isolated, the AC amplitude, the total time of the frequency sweep, the frequency sweep range, the number of bursts of the frequency sweep (that is, the number of successive applications of the isolation waveform), and the isolation window Δq. We found that optimal values were 4 ms sweep time from q=0.908 to 0.05, $q_{iso}$=0.83, three bursts, and Δq=0.02. The reasoning for each of these choices is given below.

The isolation q value was varied (0.2, 0.5, and 0.83 were tested) and it was determined that a $q_{iso}$ of 0.83 was optimal. Isolation using a sum of sines in the LTQ linear ion trap is also performed by placing the ion of interest at a q of 0.83 and applying the isolation waveform for ~12 ms, so it is perhaps not surprising that the we obtained the best results at this value as well. Presumably, the pseudo-potential well depth is near a maximum value at 0.83, which makes isolation easier since other ions will be more easily ejected. Ion secular frequencies are also quite far apart near the stability boundary, making the isolation of adjacent m/z species easier. In principle, however, isolation can be performed at other q values, but the isolation width and isolation efficiency will vary.

Figure 15:
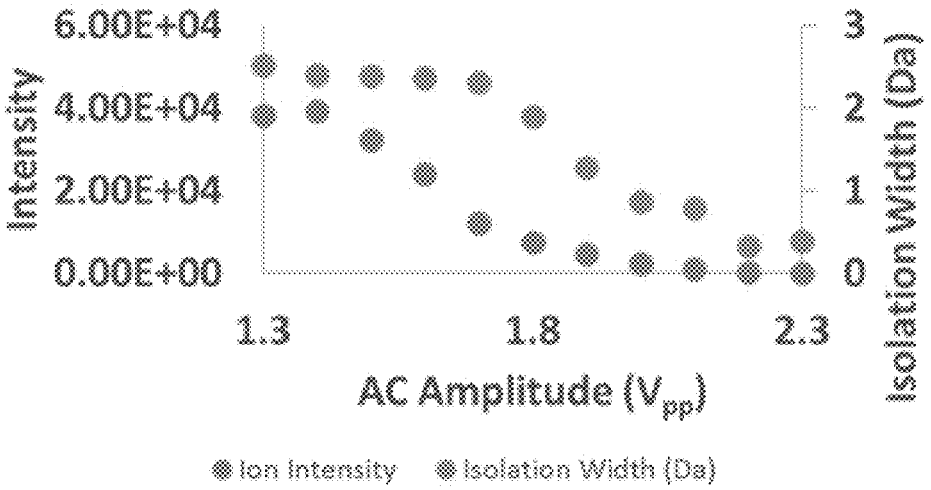
FIG. 15 shows effect of the amplitude of the inverse Mathieu q scan on isolation efficiency and isolation width. The isolation efficiency is near 100% for isolation widths above ~2 Da but decreases to ~6% to achieve unit isolation width. In this experiment, caffeine was isolated at a q of 0.83 while 4 bursts of a 30 ms inverse Mathieu q scan with a frequency hop ('notch') at q=0.83 (Δq=0.02) was applied.

The AC amplitude is a key factor in an isolation experiment. The amplitude should be high enough to eject ions over a wide m/z range but not so high that the ion to be isolated is also ejected. FIG. 15 shows the effect of varying the ac amplitude, which in our investigations was kept constant throughout each scan. Isolation widths of 2-3 Da could routinely be obtained with >90% isolation efficiency for any m/z value placed at q=0.83, although higher AC amplitudes were used for higher m/z ions because potential well depth increases approximately linearly with the rf amplitude according to the Dehmelt approximation. For isolation of caffeine, increasing the AC amplitude beyond ~1.5 $V_{pp}$ results in an improved isolation width at the cost of at least 50% of the analyte ions. Greater than an order of magnitude signal loss is observed when decreasing the isolation width (via ac amplitude increase) to <1 Da. We should note that the effects of signal loss are amplified when the waveform isolation width Δq, specified in terms of Mathieu q units, is decreased, as discussed later. We tried many variants of inverse Mathieu q scanning in order to obtain unit isolation width with near 100% efficiency, including varying the ac amplitude, varying the number of frequency sweeps and frequency sweep range, and implementing a coarse and then fine isolation window, but no combination resulted in unit isolation width without a considerable loss in signal intensity.

Figure 16:
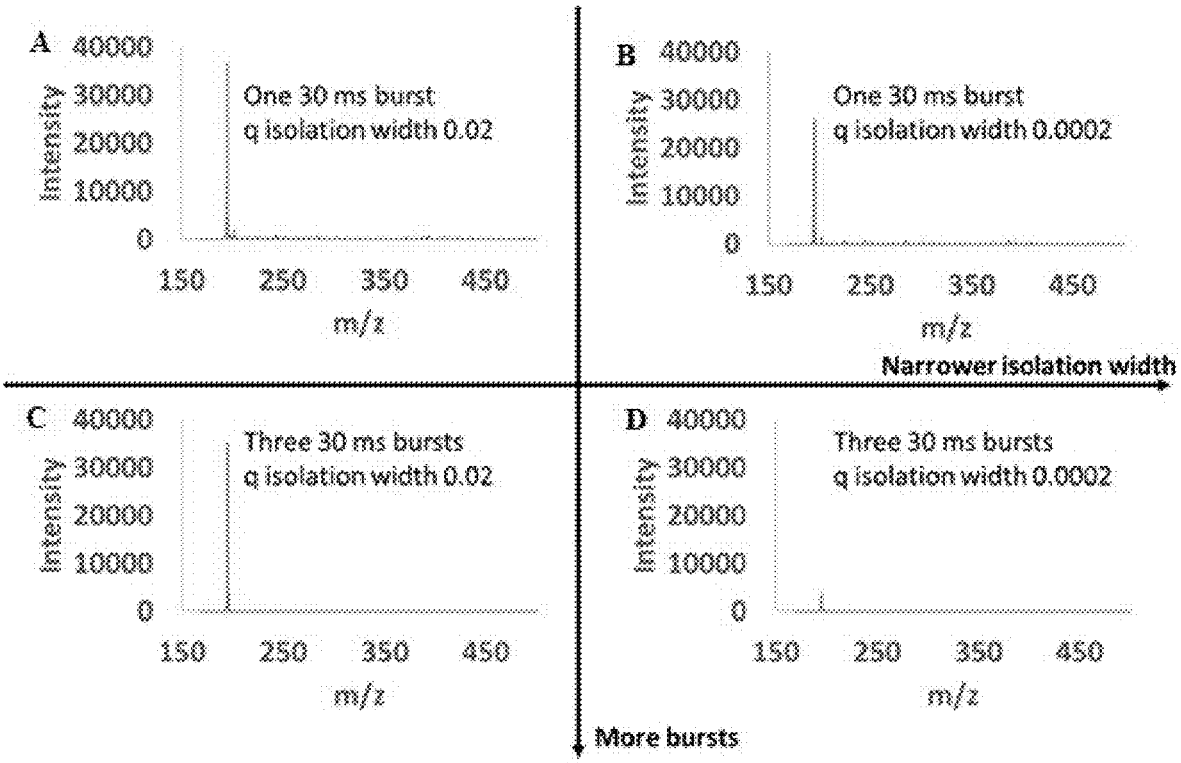
FIG. 16 panels A-D show effect of waveform isolation width Δq (in Mathieu q units) and number of bursts on isolation using the inverse Mathieu q scan. Isolation efficiency decreases drastically when the isolation width is decreased (B and D). However, increasing the number of bursts while using a relatively wide isolation width (C) retains the analyte ions while improving the isolation. In all cases, caffeine was isolated at a $q_{iso}$ of 0.83 and the given number of bursts of a 1.3 $V_{pp}$ isolation waveform was applied during isolation.

FIG. 16 panels A-D emphasize the variation in the user-defined isolation window Δq as well as the number of successively applied frequency sweeps. Each 'burst' is a single frequency sweep, and 'multiple bursts' implies consecutive application of the sweep. Panels (A) and (B) share the same number of frequency bursts but vary the isolation window width. Despite the narrower window, panel (B) still shows chemical noise that is also present in panel (A), which has a much wider window (0.02 vs 0.0002, in frequency units a window of 20 kHz vs. 0.4 kHz). Increasing the number of bursts, as in (C) and (D) gets rid of this chemical noise, but in the case of the narrower isolation width (D) also attenuates the ion signal by an unacceptable amount. Only 7.5% of the original signal remains. In contrast, for the wider isolation width, 92% of the original signal remains.

Figure 17A:
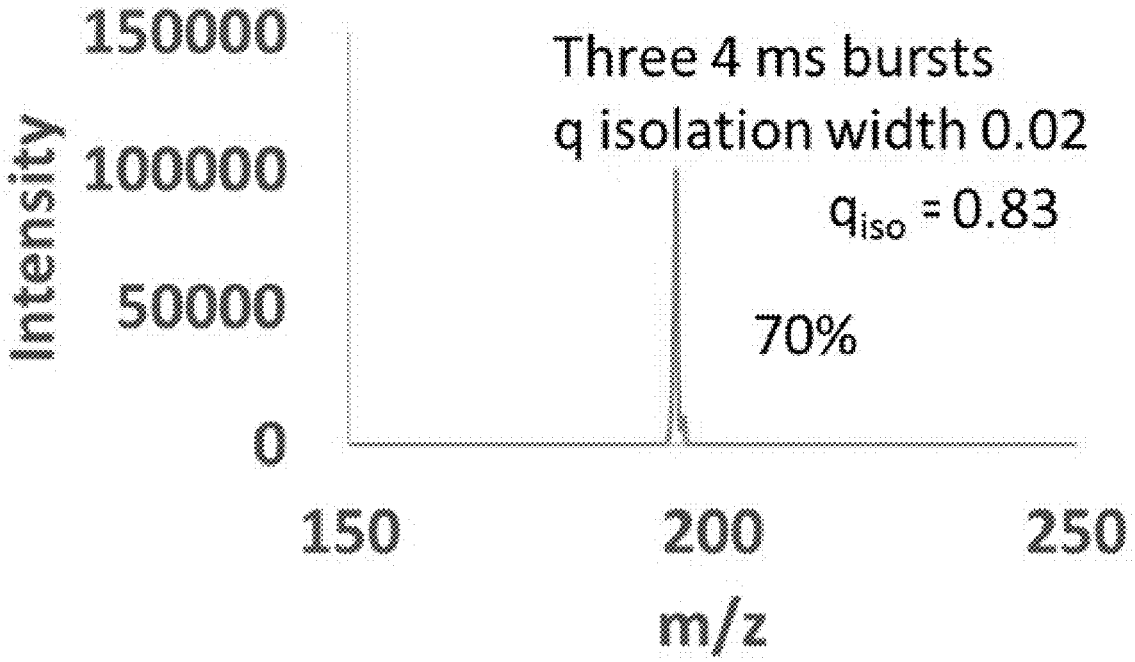
FIGS. 17A-B show isolation of caffeine using a 1.3 $V_{pp}$ inverse Mathieu q scan over 12 ms (three 4 ms bursts), showing retention of 70% of the analyte ions.
Figure 17B:
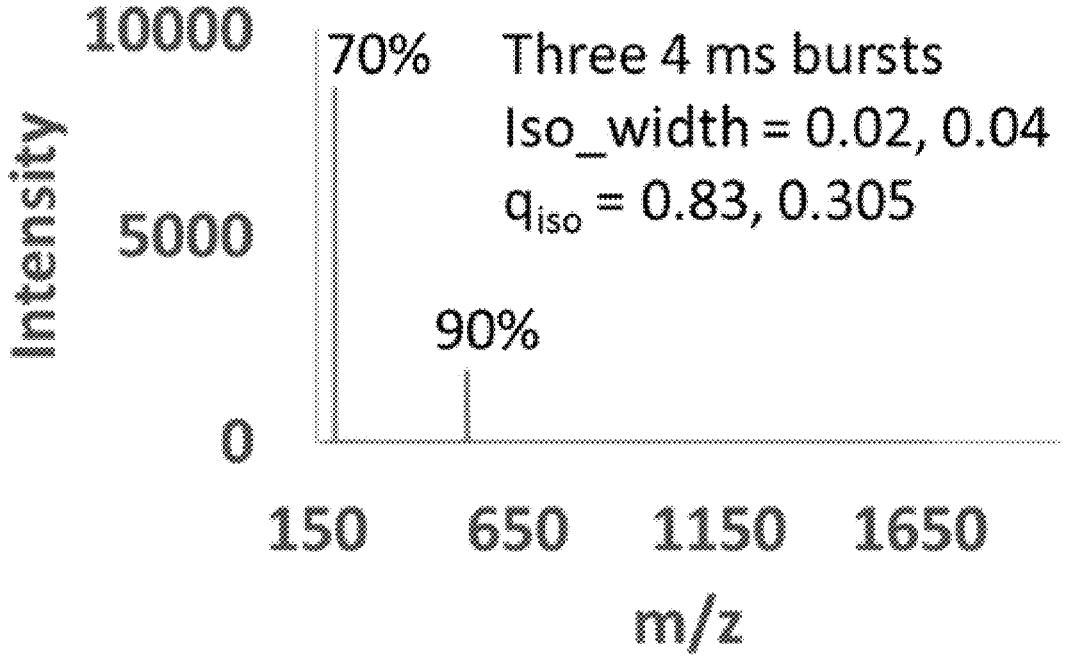

Because the number of bursts appears to be more important than a narrow isolation window and a high AC amplitude, we shortened the duration of the isolation sweep to 4 ms and applied 3 bursts, which made the total isolation time for this technique 12 ms, comparable to the 13 ms needed for isolation on the commercial LTQ. Fortunately, nearly 70% of the original ion intensity remains after isolation (FIG. 17A), and an isolation width of ~3 Da is obtained. Because the waveform sweeps through phase space rather than frequency space, phase continuity is maintained and any arbitrary number of frequency hops (equivalent to 'notches' in SWIFT) can be incorporated, as in FIG. 17B which shows the simultaneous isolation of both caffeine and MRFA (intensities should not be compared with FIG. 17A, separate full scans for each are not shown). Note that the isolation window in terms of Mathieu q units was not the same for the two ions. Presumably this is because 1) the ions are at different q values and thus have different potential well depths, 2) the higher m/z ions have secular frequencies that are much closer together than the low m/z ions, and 3) the amplitude of the ac waveform is kept constant (but can in principle be altered to any desired level at any time).

Figure 18:
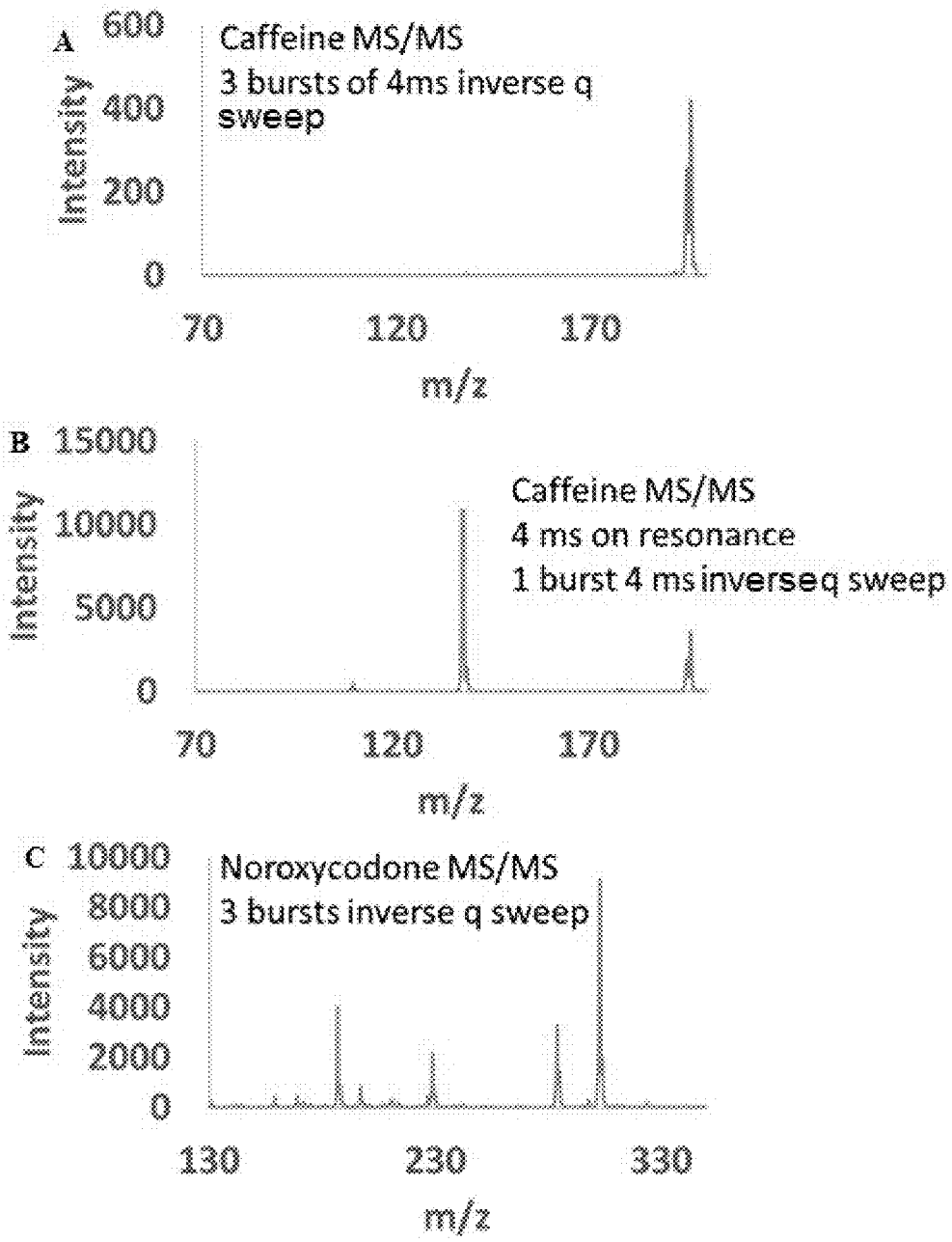
FIG. 18 panels A-C shows multigenerational collision-induced dissociation using the inverse Mathieu q scan, following ion isolation using the technique in FIG. 13. (A) inverse Mathieu q scan CID of caffeine using 3 bursts of a 4 ms scan with amplitude ~250 $mV_{pp}$, where caffeine was placed at q=0.3. Very little fragmentation is observed because the precursor ion is not given much time at resonance. However, if the resonance waveform is altered so that the ac frequency stays on the resonance frequency of caffeine for 4 ms followed by a frequency ramp (B), then more efficient fragmentation is observed. In (C), the multigenerational capabilities of the inverse Mathieu q scan for CID are observed with noroxycodone. The precursor ion (m/z 302) first fragments at q=0.3 by losing water (to m/z 284) (the lone product ion in $MS^2$), but the frequency scan also causes fragmentation of the water loss product, yielding $MS^3$-like ions as well.

Collision-induced dissociation can also be accomplished using the inverse Mathieu q scan. For example, FIG. 18 panel A is a product ion mass spectrum from collision-induced dissociation of caffeine using three bursts of an inverse Mathieu q scan from 0.15 to 0.908. Note that the direction of the frequency sweep is from low to high such that high m/z ions are first to fragment, followed by low m/z ions. Because the precursor ion (m/z 195) is only on resonance for a very short period of time during the frequency sweep, very limited fragmentation is observed, even at higher AC amplitudes. To address this, we created a waveform which has a constant frequency set at the q value of the ion to be fragmented (q=0.3 in this case) for 4 ms followed by an inverse Mathieu q scan from q=0.3 to q=0.908. Because the precursor ion is initially given more time at resonance, a higher intensity of fragment ions m/z 138, 110, etc. is observed (FIG. 18 panel A). However, the additional resonance time was not needed for noroxycodone, which produced abundant fragment ions with three bursts of a 4 ms frequency sweep. Because the frequency sweep is such that ions are fragmented from high to low m/z, the inverse Mathieu q scan produces several generations of product ions and is hence a multi-generational CID technique. This characteristic is clear in the product ion spectrum of noroxycodone, which in a typical $MS^2$ experiment loses only water to produce a highly abundant ion at m/z 284. Due to the multi-generational capabilities of the inverse Mathieu q scan, the water loss product also fragments during the CID step, generating, for example, the $MS^3$-like product ions at m/z 229 and m/z 187.

This Example demonstrates efficient ion isolation using the inverse Mathieu q scan, with efficiencies approaching 100% for isolation widths of 2-3 Da, as well as multi-generational collision-induced dissociation using a reverse inverse Mathieu q scan, which scans from low to high frequency. The work described herein can be fully implemented on a miniature mass spectrometer to use the inverse Mathieu q scan for isolation, activation, and ejection. For comparison, in conventional instruments, various AC waveforms (e.g. SWIFT, single frequency resonance excitation, resonance excitation with an analytical rf amplitude ramp, etc.) are used for isolation and activation and an analytical rf amplitude ramp effects the mass scan. The set of inverse Mathieu q scan techniques is advantageous because, unlike most mass spectrometers, the same scan can accomplish all three steps of CID: isolation, activation, and ejection.

Example 5: Calibration Procedure for Secular Frequency Scanning in Ion Trap Mass Spectrometers Mass spectra can be recorded using ion traps by scanning the frequency of an alternating current (AC) signal that corresponds to the secular frequency of a trapped ion. There is a considerable simplification in the instrumentation needed to perform such a scan compared with conventional scans of the radiofrequency (rf) amplitude. However, mass calibration is difficult. An algorithm that can be used to achieve mass calibration is investigated and the factors that affect ion mass assignments are discussed.

Time domain data, recorded using a commercial benchtop linear ion trap mass spectrometer, are converted to the m/z domain using ion Mathieu parameter $q_u$ values which are derived from the dimensionless frequency parameter $\beta_u$ expressed as a continuing fraction in terms of $q_u$. The relationship between the operating parameters of an ideal ion trap and the ion m/z ratio is derived from the Mathieu equations and expressed as an algorithm which through successive approximations yields the Mathieu $q_u$ value and hence m/z values and peak widths. The predictions of the algorithm are tested against experiment by sweeping the frequency of a small supplementary ac signal so as to cause mass-selective ejection of trapped ions.

Calibration accuracy is always better than 0.1%, often much better. Peak widths correspond to a mass resolution of 250 to 500 in the m/z 100-1800 range in secular frequency scans. A simple, effective method of calibration of mass spectra recorded using secular frequency scans is achieved. The effects of rf amplitude, scan rate, and AC amplitude on calibration parameters are shown using LTQ linear ion trap data. Corrections for differences in ion mass must be made for accurate calibration, and this is easily incorporated into the calibration procedure.

Theory

Here, we introduce a simple algorithmic approach for the mass calibration of secular frequency scan mass spectra. The algorithm assumes a linear sweep of the ac frequency and a 2D quadrupole trapping field, but nonlinear sweeps and other ion trap geometries can easily be accommodated by modifying the code. The objective is to calibrate for accurate unit mass resolution; exact mass measurements are not possible.

Mass calibration in quadrupole ion traps operated in the mass-selective instability mode, is based on the linear relationship between m/z and the rf amplitude, as described by the Mathieu parameters $a_u$ and $q_u$ for a linear ion trap with a 2D trapping field $$a_x \tfrac{1}{4} - a_y \tfrac{1}{4} 8zeU = \Omega^2 r_0^2 m \quad (1)$$

$$q_x \tfrac{1}{4} - q_y \tfrac{1}{4} 4\ zeV_{0\text{-}p} = \Omega^2 r_0^2 \mathrm{m} \quad (2)$$

where z is the integer charge on the ion, e is the unit charge, U is the direct current (dc) potential on the rods, $V_{0\text{-}p}$ is the zero-to-peak (0−p) amplitude of the driving rf potential, Ω is the angular rf frequency (2 πf, where f is the rf frequency), r0 is the characteristic dimension of the trap (half the distance between the rods), m is the mass of the ion in kilograms, and x and y are the characteristic dimensions of the 2D quadrupole trapping field. Note that the dimensions in x and y are often different such that r0 may be replaced by either x0 or y0. Similarly, for a 3D quadrupole ion trap we have:

$$a_z \tfrac{1}{4} - 2a_r \tfrac{1}{4} - 16zeU = \Omega^2 r_0^2 \rho 2z_0^{2)} m \quad (3)$$

$$q_z \tfrac{1}{4} - 2q_r \tfrac{1}{4} 8zeU = V_{0\text{-}p} = \Omega^2{}_{r0}{}^2 \rho 2z_0^{2'} m \quad (4)$$

where r and z are the radial and axial dimensions, respectively, and $r_0$ and $z_0$ are the half distances between the electrodes in their respective dimensions. More generally, we will refer to any arbitrary characteristic dimension as u. Typically au=U=0, so the au may be ignored. In terms of m/z, we have:

$$m = z \tfrac{1}{4} 4V_{0_p} = q_x \Omega^2 r_0^2 \quad (5)$$

for the linear ion trap and $$m = z \tfrac{1}{4} 8V_{0\text{-}p} = q_0 \Omega 2_{,r0} 2\rho 2z_0^2) \quad (6)$$

for the 3D ion trap.

In Eqns. (5) and (6) we have combined e and z and have limited our discussion to the x and z dimensions since they are typically the direction of ion ejection.

Thus, we see that m/z and $V_{0\text{-}p}$ are directly proportional. In order to calibrate a quadrupole ion trap, mass standards are analyzed by either resonance ejection or boundary ejection, resulting in an intensity vs time dataset. The time axis is then linearly correlated to m/z based on the known monoisotopic mass and charge of each ion, giving a slope and an intercept which are used to convert from the time domain into the m/z domain, hence correlating m/z and intensity. Calibration of rf frequency sweeps is inherently more difficult. As given by Eqns. (5) and (6), m/z is inversely proportional to the square of the rf frequency. Nonetheless, frequency sweeps of this kind have been reported in a quadrupole mass filter, quadrupole ion traps, and a digital ion trap. The digital trap is particularly well suited to these scans because a linear sweep through ion mass can be achieved by changing the period of the digital rf waveform using a square root dependence with respect to time.

A third method of obtaining a mass spectrum with an ion trap is to scan the internal radius ($r_0$ in Eqn. (5) or $z_0$ in Eqn. (6)) of the analyzer, but this is mechanically difficult and impractical in that it would require many precise steps to achieve performance similar to standard methods, and the electric field components would change with the varied parameter. Thus, in practice such a scan is impossible.

A secular frequency scan has had few adopters in practice, but has most notably been applied in the halo ion trap and its variants. In contrast to scans which require a linear rf amplitude ramp, secular frequency scanning is a simpler alternative. This method is based on excitation and/or ejection of ions with a dipolar ac field with frequency corresponding to characteristic frequencies of the motion of ions of particular m/z values. The angular frequency components (w u, n) of ion motion in a pure quadrupole field are given by:

$$\omega_{u,0} \tfrac{1}{4} 02n\rho\beta_u\rho\Omega = 2 \quad -\infty < n < \infty \quad (7)$$

where u is the characteristic dimension (x and y for a linear ion trap and r and z for the 3D ion trap), n is an integer, and $\beta_u$ is a parameter between 0 and 1. Setting n=0 in Eqn. (7), we obtain:

$$\omega_{u,0} \tfrac{1}{4} \beta_u \Omega = 2 \quad (8)$$

which is an ion's fundamental secular frequency.

Values of the Mathieu parameter $q_u$ for an ion can then be derived (or vice versa) from a continuing fraction expression for $\beta_u$ in terms of the $q_u$ value, where:

$$\beta_u^2 = a_u + \cfrac{q_u^2}{(\beta_u+2)^2 - a_u - \cfrac{q_u^2}{(\beta_u+4)^2 - a_u - \cfrac{q_u^2}{(\beta_u+6)^2 - a_u - \dots}}} + \cfrac{q_u^2}{(\beta_u-2)^2 - a_u - \cfrac{q_u^2}{(\beta_u-4)^2 - a_u - \cfrac{q_u^2}{(\beta_u-6)^2 - a_u - \dots}}} \quad (9)$$

which simplifies in the ion trap since generally au=0. A ramp of the AC frequency thus excites ions as a function of time, and if the application time and amplitude of the waveform are sufficient, ions will be ejected from the trap in a non-linear mass-selective manner.

Algorithm

An overview of the method for the mass calibration of secular frequency scan mass spectra is shown in FIG. 19. The first step is to correlate applied AC frequency with each data point in time, which can be determined from the sampling rate of the data system and the scan range and scan time of the waveform generator. These frequencies are then converted into $\beta_u$ using Eqn. (8). This step assumes that the fundamental secular frequency (Eqn. (8)) is being interrogated.

Once $\beta_u$ values are obtained, they must be converted into Mathieu $q_u$ parameters by solving a truncated version of Eqn. (9). This can be done by using an iterative algorithm, beta_to_q, which guesses an initial value of 0.5 for $q_u$. The value of $\beta_u$ is bound between 0 and 1 based on the possible values of $q_u$ (typically between 0 and 0.908). Both the left-hand side and the right-hand side of Eqn. (9) are calculated and the difference is obtained. Based on this result, either the left or right bound is changed to coincide with the guessed value of $q_u$. A new value of $q_u$ is then calculated as the average of the other bound and the current guessed $q_u$ value. This process is repeated until the difference between successive guesses of $q_u$ is less than any arbitrarily specified tolerance. While there are algorithms that converge more quickly (i.e. Newton's algorithm), they generally require taking a derivative, thus complicating the calculations.

The calculated values of qu are converted into uncorrected m/z ($m_{uncorrected}$) via Eqn. (5) and the known values of $V_{0\text{-}p}$, Ω and $r_0$, although these values need not be known since they are constant throughout the scan so that any error in the 'guessed' values for the parameters is thus incorporated into the slope and intercept calculated in the final step. Note that Eqn. (5) is relevant only for linear ion traps in which a 2D quadrupole trapping field is established. Equation (6) should be used for the 3D ion trap (Paul trap). It should also be emphasized that the characteristic dimensions of a trap, and thus qu values in different dimensions, may be different. The $q_u$ values used here should be those which correspond to the direction of ion ejection, which is the x direction in the LTQ linear ion trap. For the 3D ion trap, the z direction is typically used for ejection.

Arbitrary sweeps of $V_{0\text{-}p}$, as in the 'Ultrazoom' scans that we employed to minim/ze changes in rf amplitude using a conventional LTQ linear ion trap, can be accommodated by incrementing V appropriately before each mass is calculated, but this is only necessary in systems like the LTQ where data can only be recorded when $V_{0\text{-}p}$ is being scanned. The standard 'Ultrazoom' scan (scan rate of 27 m/z units/s, ejection at q=0.88, see FIG. 19) on the LTQ allowed the acquisition of secular frequency scan mass spectra with near-constant rf amplitude without other instrumental or data system modifications. There are no built-in scan functions on this instrument in which the rf amplitude is constant. While the slow rf sweep changes the resolution obtained, this effect is very small.

Figure 20:
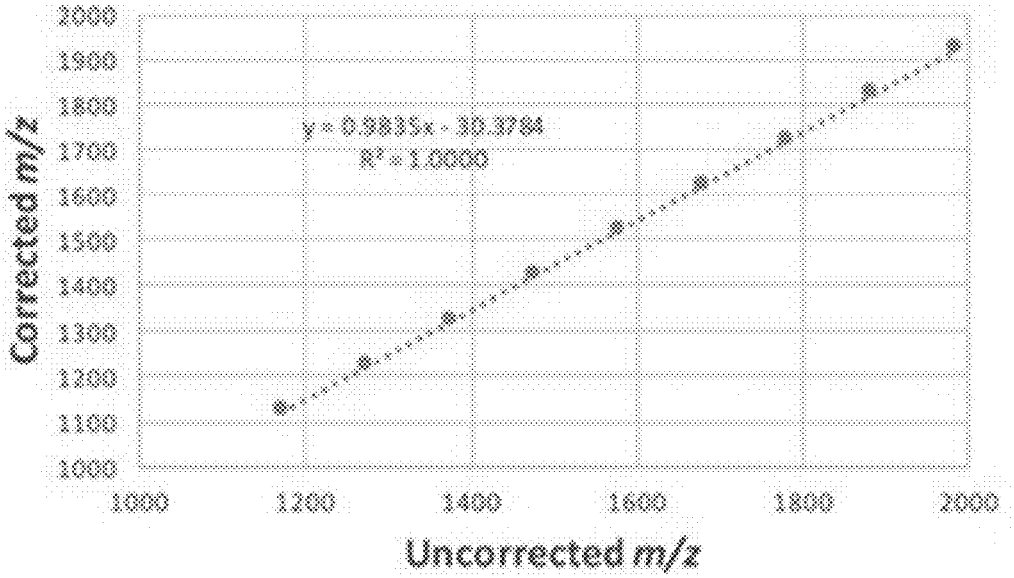
FIG. 20 is a graph accounting for the mass-dependent delay of ion ejection and incorrect inputs for trap parameters. In the calibration procedure for a linear ac frequency sweep, plotting true mass vs uncorrected mass gives a linear fit. The slope and intercept are then used to correct for this delay. Data shown are for an LTQ linear ion trap, ac scan of Ultramark 1621 calibration solution, 10-500 kHz, 1.5 Vpp, over 800 ms during an Ultrazoom scan beginning at a lower mass cutoff of 1000 Th.

The last step in the calibration procedure is to take different ion masses into account and to correct for errors in $V_{0\text{-}p}$ and Ω. Ions of greater m/z will be ejected more slowly than ions of lower m/z due to differences in inertia and differences in ejection frequency. This contrasts with mass shifts in resonance ejection, where ejection delays are principally due to field imperfections and collisions with the surrounding bath gas. The key distinction here is that in resonance ejection all ions are ejected at the same frequency, whereas in secular frequency scanning, ions are ejected at different frequencies. In addition, the 'guessed' values of $V_{0\text{-}p}$, Ω, and the internal radius of the trap (e.g. $r_0$) may be incorrect, but since they are constant during the scan, they are incorporated into the slope obtained as follows. To take these considerations into account in secular frequency scanning, the true monoisotopic masses of the mass standards are plotted against uncorrected mass data, $m_{uncorrected}$, which generates a linear relationship. A dimensionless slope, s, and an intercept, b (in Th), are then used to convert from $m_{uncorrected}$ into $m_{corrected}$, giving the correct calibration. This procedure is illustrated in FIG. 20, where $m_{uncorrected}$ data from analysis of an Ultramark 1621 calibration solution (details in the figure caption) are plotted against the calculated monoisotopic masses of the calibration ions. The result is a linear relationship, the slope and intercept being subsequently incorporated into the final step of the algorithm.

Results and Discussion

Others have shown mass-calibrated data for their secular frequency scan experiments in the halo trap, but quantitative values for calibration accuracy and the effect of scanning parameters on the calibration procedure have not been reported. Using the algorithm in FIG. 19 and the slope and intercept from FIG. 20, we were able to obtain quantitative results for both, as shown in Table 2.

TABLE 2

Mass calibration for the scan in FIG. 20

| Calculated m/z | Corrected m/z | Calibration error (ppm) | FWHM peak width (Th) |
|---|---|---|---|
| 1121.998 | 1122.208 | 188.410 | 0.86 |
| 1221.991 | 1222.040 | 39.583 | 1.81 |
| 1321.985 | 1321.130 | 646.580 | 2.32 |
| 1421.978 | 1421.867 | 78.325 | 2.39 |
| 1521.978 | 1522.565 | 389.864 | 2.87 |
| 1621.966 | 1622.256 | 178.909 | 3.38 |
| 1721.959 | 1722.562 | 350.170 | 3.13 |
| 1821.953 | 1821.181 | 423.908 | 3.57 |
| 1921.946 | 1921.939 | 4.06 | 4.04 |

Peak width increases approximately linearly with mass due to the linear sweep of the ac frequency.

In brief, a Thermo LTQ linear ion trap mass spectrometer was used with the resonance ejection waveform replaced by a swept frequency sinusoidal waveform from an external function generator (Sony Tektronix AFG320) while the standard Ultrazoom scan function was used for rf amplitude control. Thus, system modifications for keeping the rf amplitude constant were not necessary. While the Ultrazoom scan does change the rf amplitude, the effect is very small (scan rate of 27 m/z units/s, resonance ejection at $q_x$=0.88) and can largely be ignored. The standard LTQ bath gas pressure of ~1.0×10-3 Torr was used for collisional cooling. All q values reported from this point on are $q_x$ values since ions are resonantly ejected from the linear ion trap in this dimension (i.e. the resonance ejection waveform is applied in a dipolar fashion between the x rods).

If the last step in the procedure is ignored (i.e. if uncorrected mass values are used for calibration), the calibrated masses will be too high. This is understandable since ions will generally be ejected slightly after their resonance conditions have been met, and the frequency in these experiments was scanned from low to high (high to low mass). However, when these values are corrected for the mass-dependent ejection delay and incorrect inputs for trap parameters (e.g. $V_{0\text{-}p}$), the calibration error decreases to ~10-600 ppm, which is in reasonable agreement with the typical mass accuracy of a linear ion trap, ~50-100 ppm. Some of the calibration error is due to the mismatch between the LTQ's data system, which records a constant 100 points per integer mass, and the variable scan rate of the secular frequency scan. This results in one data point being acquired every ~0.37 ms. More error can be attributed to the necessity of choosing a built-in scan function, in this case the Ultrazoom scan, to minimize the change in the rf voltage.

However, our calculations took this into account by incrementing V at every time step. Even with these difficulties, the calibration accuracy was always less than 0.1%, which is sufficient for determining the integer masses of the analytes.

Peak width, calculated as full width at half maximum (FWHM), increases approximately linearly with mass, as shown in the last column of Table 2. This is the result of scanning the frequency of the AC linearly with time, meaning that the scan rate increases with mass. The increase in scan rate is approximately linear for $q<0.4$ (the approximation loses significance at $q=0.7$).

A second example of mass calibration is shown in Table 3.

TABLE 3

Mass calibration for a set of three quaternary ammonium ions

| Calculated m/z | Corrected m/z | Calibration error (ppm) | FWHM peak width (Th) |
|---|---|---|---|
| 284.33 | 284.35 | 81.36 | 0.29 |
| 360.36 | 360.31 | 130.20 | 0.63 |
| 382.44 | 382.45 | 16.54 | 0.75 |

Scann parameters were ac frequency 10-500 kHz, scan time 800 ms, amplitude 1 $V_{pp}$, LTQ Ultrazoom scan beginning at a lower mass cutoff of 260 Th.

The analytes were didodecyldimethylammonium (M+, m/z 384), hexadecyltrimethylammonium (M+, m/z 284), and benzylhexadecyldimethylammonium (M+, m/z 360), as described in a previous experiment. The calibration error is 10-100 ppm, in agreement with Table 2, and the peak widths increase approximately linearly with mass.

The algorithm can further be used to perform secular frequency scans that are linear in mass. This can be accomplished by varying the frequency of the supplemental AC waveform according to Eqns. (5) (or (6)), (8), and (9), where an array of m/z values corresponding linearly to time domain points is converted into an array of ac frequencies versus time.

We have previously shown that increasing the rf amplitude increases resolution when the ac frequency is swept, that increasing the AC amplitude decreases resolution and sensitivity and ejects ions earlier in the scan, and that increasing scan rate increases resolution. The peak position in time of each ion thus shifts when any of these parameters is altered. Here we explored the effect on the calibration procedure, namely with regard to the slope and intercept incorporated in the final step.

Figure 21:
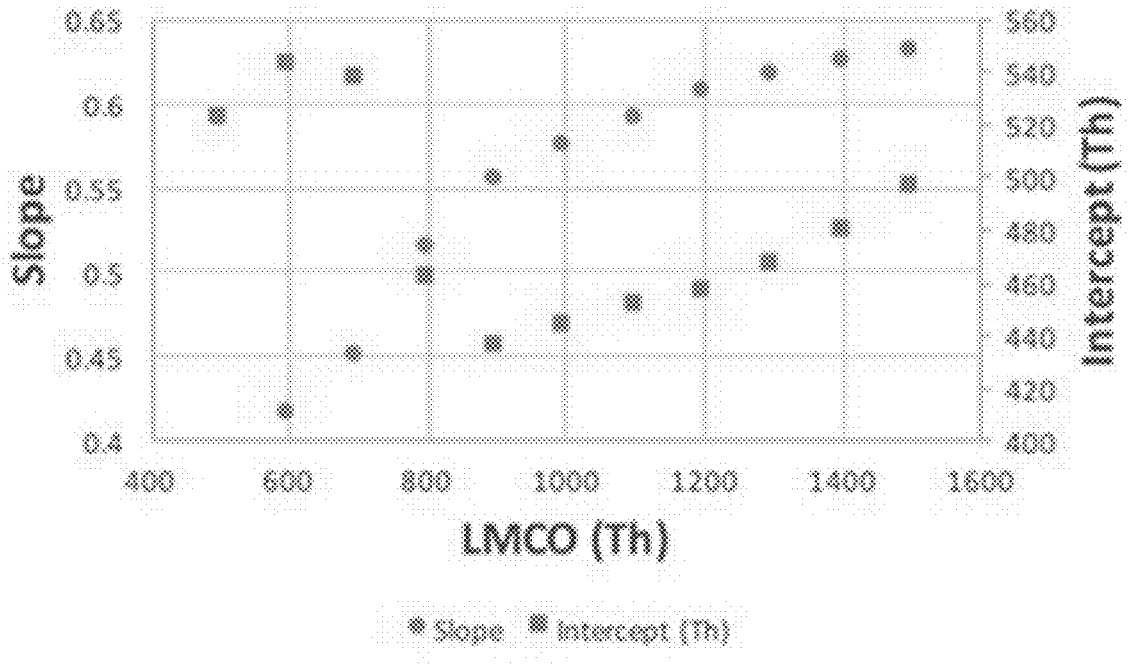
FIG. 21 shows effect of rf amplitude on calibration parameters using an LTQ linear ion trap. As the rf amplitude (LMCO corresponding to qx=0.88) increases, the slope and intercept in the linear fit generally increase. Scan time was 800 ms with a1 $V_{pp}$ supplementary AC waveform swept from 10 to 500 kHz. The analytes were Ultramark 1621 calibration solution ions. Slope and intercept refer to the parameters obtained from fitting true mass vs uncorrected mass, as in FIG. 20.

Increasing the rf amplitude increases the resolution in secular frequency scanning because the secular frequencies of ions are further apart at higher rf amplitudes (Eqn. (8)), but the rf amplitude is also expected to affect the calibration procedure. This is illustrated in FIG. 21, where the slope and intercept parameters are plotted against the lower mass cutoff (LMCO) of the Ultrazoom scan (corresponding to $q_x=0.88$). An increase in rf amplitude tends to increase both the slope and the intercept. A higher slope indicates a greater delay in ion ejection, whereas a lower slope indicates that ions are ejected more rapidly, that is, closer to their true resonance point. Ions would be expected to be ejected more slowly at higher q values due to greater pseudo-potential well depths, which increase with q and $V_{0\text{-}p}$. Thus, the calculated slope increases with LMCO (rf amplitude). The sharp change in the intercept at LMCO=800 Th is due to the coupling of the slope and intercept. The slope curve appears to change concavity at LMCO=800 Th, which results in a sudden increase in the intercept. The intercept is less meaningful than the slope; the slope indicates the rate of ion ejection.

Figure 22A:
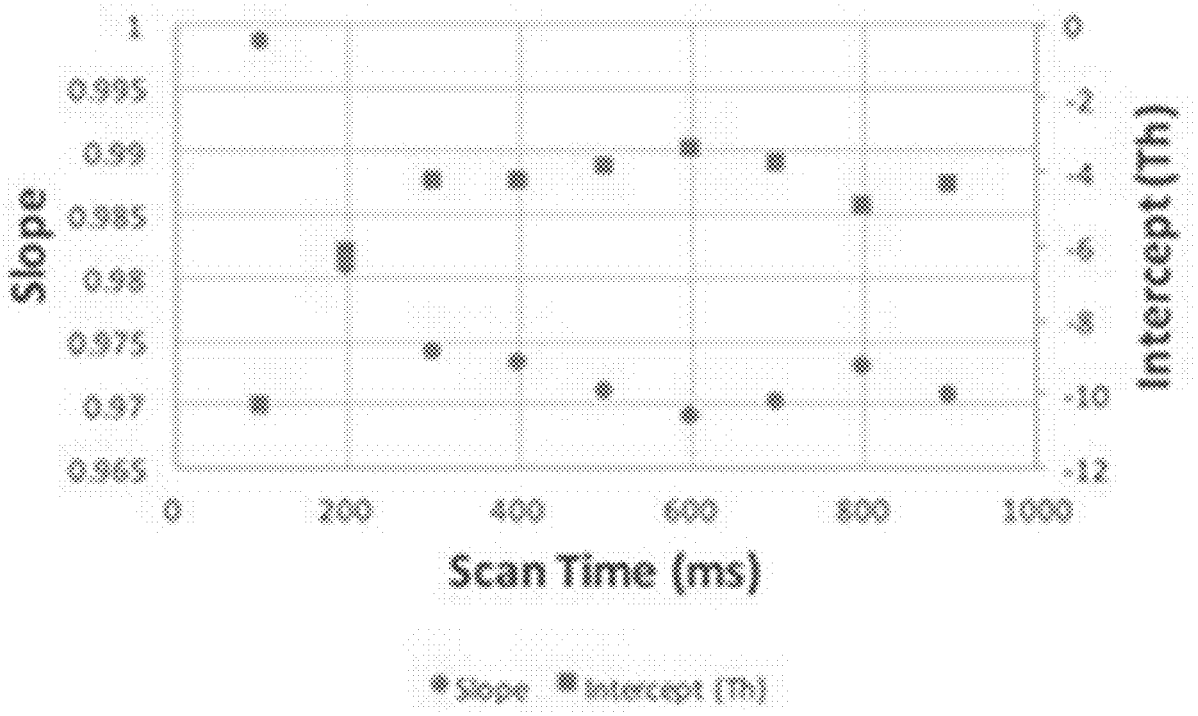
FIGS. 22A-B show effect of (A) scan rate and (B) AC amplitude on calibration parameters using an LTQ linear ion trap. Slope and intercept refer to the parameters obtained from fitting true mass vs uncorrected mass, as in FIG. 20. Scans in (FIG. 22A) were 1 $V_{pp}$, 10-500 kHz over the given scan time, during an Ultrazoom scan beginning at a lower mass cutoff of 100 Th. Scans in (FIG. 22B) were over 800 ms, 10-500 kHz, with the given ac amplitudes, during an Ultrazoom scan beginning at 100 Th. Note that the plot in (FIG. 22A) shows the effect of scan rate since the scan start and end frequencies were constant but the scan time was variable.
Figure 22B:
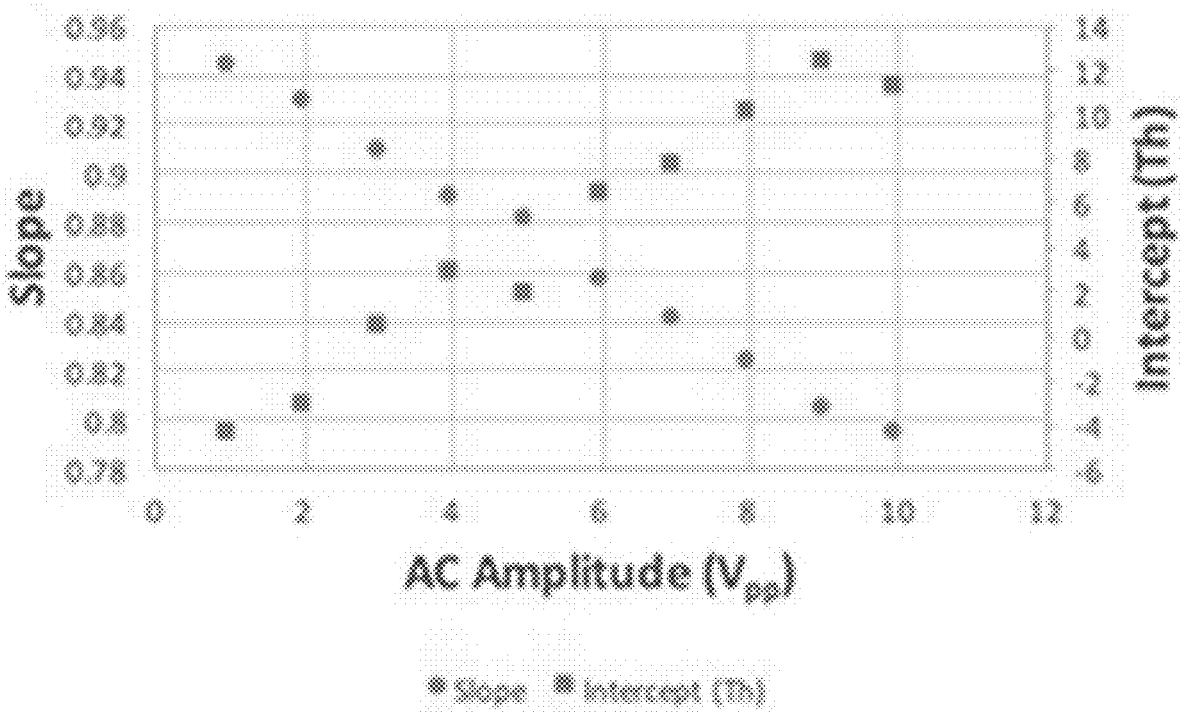

Changing the scan rate or AC amplitude has a large effect on calibration, as shown in FIGS. 22A-B. Note that the scan rate was altered by changing the scan time while keeping the start and end frequencies constant. Thus, a longer scan time will correspond to a slower scan rate. The slope obtained in the final correction step decreases nonlinearly with increasing scan time, and the intercept correspondingly increases. This can be accounted for by considering the amount of time each ion is at resonance during the scan, which increases with scan time for a constant start and end frequency, resulting in more rapid ejection relative to the length of the scan. Both curves level out because further increasing the amount of time that each ion is at resonance does not change the ejection time relative to the scan time (i.e. the optimum resonance time has already been attained). The slope and intercept decrease and increase, respectively, in an approximately linear fashion (FIG. 22B) when the AC amplitude increases. This result is the direct consequence of ions being ejected more swiftly when the ac amplitude is high. Fortunately, this can be automatically accounted for in the mass calibration algorithm by inputting the ac amplitude as a variable. Since the relationship between slope/intercept and ac amplitude is linear, a second correction slope and intercept may be incorporated.

As a final note, higher-order fields are known to cause mass shifts in ion traps, which thus requires alteration in the calibration procedure or alterations to the AC amplitude to correct for these shifts. These fields are introduced in varying magnitudes due to apertures in the electrodes, electrode truncation and imperfections, and asymmetry in the electrode structure. The octopole and dodecapole terms (A4 and A6) are generally the only significant components; odd-order components are usually zero due to trap and electric field symmetry. The mass shifts that such fields cause are due to differences in electric field strength, particularly near the electrodes. A positive contribution from a higher-order term indicates that the field is stronger than a pure quadrupole field; the opposite is true for a negative higher order term. Stronger fields will cause ion oscillatory frequencies to increase (à la Eqns. (5), (6), (8), and (9)), whereas weaker fields will have the opposite effect. A further distinction is made between even- and odd-order terms. Even-order fields will either increase or decrease the electric field intensity symmetrically, whereas odd-order fields will increase the field intensity near one electrode and decrease it near the opposite electrode. The effect of the odd-order field is thus to displace the ion cloud from the center of the trap and decrease the electric field strength acting on the ion cloud because the ions will tend to reside in the region with the lowest field strength, resulting in a downward frequency shift for both positive and negative odd-order terms. These are important considerations to take into account when calibrating secular frequency scan mass spectra.

CONCLUSION

We have introduced a simple method for mass calibration of secular frequency scan data. Calibration errors less than 0.1% were typical but can be improved by keeping the rf amplitude constant and increasing the data collection rate. The method can be generalized to account for any arbitrary sweep of the ac frequency and rf amplitude and frequency. Secular frequency scans linear in m/z can also be performed using this algorithm.

What is claimed:

1. A system, the system comprising:

a mass spectrometer comprising an ion trap; and a central processing unit (CPU), and storage coupled to the CPU for storing instructions that when executed by the CPU cause the system to: apply an inverse Mathieu q scan to the ion trap, wherein the instructions that when executed by the CPU further cause the system to: apply a constant radio frequency (RF) signal to the ion trap and vary a frequency of the AC signal as a function of time, wherein the frequency of the AC signal is swept nonlinearly while the RF signal is held constant for an entire scan cycle such that a plurality of ejected ions have a mass to charge ratio proportional to an ejection time, wherein the ejection time is of a plurality of ejected ions.

2. The system according to claim 1, wherein the inverse Mathieu q scan comprises nonlinearly applying an alternating current (AC) signal to the ion trap that varies as a function of time.

3. The system according to claim 1, wherein the AC signal is in resonance with a secular frequency of ions of different mass-to-charge ratios trapped within the ion trap.

4. The system according to claim 1, wherein the ion trap is selected from the group consisting of: a hyperbolic ion trap, a cylindrical ion trap, a linear ion trap, a rectilinear ion trap.

5. The system according to claim 1, wherein the mass spectrometer is a miniature mass spectrometer.

6. The system according to claim 1, further comprising an ionization source.

7. A method for operating an ion trap of a mass spectrometer, the method comprising apply an inverse Mathieu q scan to the ion trap, wherein applying the inverse Mathieu q scan comprises applying the inverse Mathieu q scan further comprises applying a constant radio frequency (RF) signal to the ion trap and nonlinearly applying an alternating current (AC) signal to the ion trap that varies as a function of time, wherein a frequency of the AC signal varies as a function of time, wherein the frequency of the AC signal is swept nonlinearly while the RF signal is held constant for an entire scan cycle such that a plurality of ejected ions have a mass to charge ratio proportional to an ejection time, wherein the ejection time is of a plurality of ejected ions.

8. The method according to claim 7, wherein the AC signal is in resonance with a secular frequency of ions od different mass-to-charge ratios trapped within the ion trap.

9. The method according to claim 7, wherein applying the inverse Mathieu q scan extends a mass range of the mass spectrometer without instrumental modification.

10. The method according to claim 7, wherein the inverse Mathieu q scan is applied in a manner that excites a precursor ion while a second AC signal ejects a product ion from the ion trap.

11. The method according to claim 10, wherein both the excitation of the precursor ion and the ejection of the product ion occur simultaneously.

12. The method according to claim 7, wherein the method further comprises ejecting one or more target ions at a target mass-to-charge ratio from the ion trap while non-target ions at a higher or lower mass-to-charge ratio remain in the ion trap.

13. The method according to claim 7, wherein the method further comprises simultaneously monitoring multiple ions.

14. The method according to claim 7, wherein the method further comprises simultaneously monitoring multiple precursor ion to product ion transitions.

15. The method according to claim 7, wherein the inverse Mathieu q scan is applied in a manner that ion injection, ion cooling, and mass scanning occur in a single step.

16. A system, the system comprising:

a mass spectrometer comprising an ion trap; and a central processing unit (CPU), and storage coupled to the CPU for storing instructions that when executed by the CPU cause the system to: apply an inverse Mathieu q scan to the ion trap, wherein the instructions that when executed by the CPU further cause the system to: apply a constant radio frequency (RF) signal to the ion trap and vary a frequency of the AC signal, wherein the frequency of the AC signal is swept nonlinearly while the RF signal is held constant for an entire scan cycle such that a plurality of ejected ions have a mass to charge ratio proportional to an ejection time, wherein the ejection time is of a plurality of ejected ions.

* * * * *